US009913515B2

(12) United States Patent
Lin

(10) Patent No.: US 9,913,515 B2
(45) Date of Patent: Mar. 13, 2018

(54) COVER-TYPE CONTAINING STRUCTURE FOR FLEXIBLE ENCLOSURES

(71) Applicant: Che-Wen Lin, New Taipei (TW)

(72) Inventor: Che-Wen Lin, New Taipei (TW)

( * ) Notice: Subject to any disclaimer, the term of this patent is extended or adjusted under 35 U.S.C. 154(b) by 266 days.

(21) Appl. No.: 14/723,149

(22) Filed: May 27, 2015

(65) Prior Publication Data

US 2015/0305456 A1 Oct. 29, 2015

Related U.S. Application Data

(60) Division of application No. 13/652,330, filed on Oct. 15, 2012, now abandoned, which is a continuation-in-part of application No. 12/955,678, filed on Nov. 29, 2010, now abandoned, which is a continuation-in-part of application No. PCT/CN2009/000596, filed on May 27, 2009.

(30) Foreign Application Priority Data

May 30, 2008 (CN) ..... 2008 1 0028408

(51) Int. Cl.
*A45F 3/04* (2006.01)
*A45C 9/00* (2006.01)
(Continued)

(52) U.S. Cl.
CPC ..... *A45C 9/00* (2013.01); *A45C 3/04* (2013.01); *A45C 7/0077* (2013.01);
(Continued)

(58) Field of Classification Search
CPC ... A45C 2009/007; A45C 7/0077; A45C 9/00; A45C 3/04; A45C 7/0086;
(Continued)

(56) References Cited

U.S. PATENT DOCUMENTS 3,061,057 A 10/1962 Miller
4,081,061 A 3/1978 Tucker
(Continued)

FOREIGN PATENT DOCUMENTS

CN 2101393 U 4/1992
CN 2756055 Y 2/2006
(Continued)

*Primary Examiner* — Corey Skurdal
(74) *Attorney, Agent, or Firm* — Muncy, Geissler, Olds & Lowe, P.C.

(57) ABSTRACT

A cover-type containing structure for flexible enclosures primarily includes a front cover sheet, a rear cover sheet and a flexible enclosure. The front cover sheet includes a first joining edge and a cover piece, whereas the rear cover sheet includes a cover assembly corresponding to the cover piece. The flexible enclosure includes a second joining edge and by engaging the first joining edge with the second joining edge, the front cover sheet and the flexible enclosure are fixed. Besides, the containing structure further includes a holding portion. Under a contained state, the holding portion is used to contain smaller objectives; whereas, in an unfolded state, in addition to using the flexible enclosure to contain larger objectives, the holding portion can be also used to contain smaller objectives. The present invention can be also applied to a piece of clothing combined with a bag unit or other flexible enclosure.

3 Claims, 44 Drawing Sheets

(51) Int. Cl.

| | |
|---|---|
| ***A45F 4/12*** | (2006.01) |
| ***A45C 3/04*** | (2006.01) |
| ***A45C 7/00*** | (2006.01) |
| ***A45F 3/02*** | (2006.01) |
| ***A45F 3/00*** | (2006.01) |
| ***A45C 13/10*** | (2006.01) |

(52) U.S. Cl.
CPC ..... *A45C 7/0086* (2013.01); *A45C 13/1069* (2013.01); *A45C 13/1076* (2013.01); *A45F 3/005* (2013.01); *A45F 3/02* (2013.01); *A45F 3/04* (2013.01); *A45F 4/12* (2013.01); *A45C 2009/007* (2013.01); *A45C 2013/1015* (2013.01)

(58) Field of Classification Search
CPC ..... A45C 13/1069; A45C 13/1076; A45C 2013/1015; A45F 3/005; A45F 3/02; A45F 3/04; A45F 3/06; A45F 4/12
See application file for complete search history.

(56) References Cited

U.S. PATENT DOCUMENTS

| | | | | |
|---|---|---|---|---|
| 4,117,874 | A | 10/1978 | Berenguer | |
| 5,544,792 | A | 8/1996 | Arnwine | |
| 5,743,448 | A | 4/1998 | Tsai | |
| 5,774,912 | A | 7/1998 | Dominique | |
| 5,819,999 | A | 10/1998 | Tennant | |
| 5,964,384 | A | 10/1999 | Young | |
| 6,279,706 | B1 * | 8/2001 | Mao | A45C 5/14 16/113.1 |
| 6,305,587 | B1 * | 10/2001 | Miller | A45C 7/0068 224/153 |
| 6,530,507 | B2 * | 3/2003 | Oh | A45C 5/14 190/18 A |
| D483,940 | S | 12/2003 | Dolan | |
| 6,923,352 | B2 * | 8/2005 | Oh | A45C 5/14 190/1 |
| 7,395,930 | B2 * | 7/2008 | Tauchen | A45C 3/00 190/109 |
| 7,617,956 | B1 | 11/2009 | Sabbah | |
| 8,292,136 | B2 * | 10/2012 | Tonelli | A45C 13/38 224/250 |
| 8,820,596 | B1 * | 9/2014 | Bergquist | A45F 4/02 224/153 |
| 2007/0102460 | A1 | 5/2007 | Lottman | |

FOREIGN PATENT DOCUMENTS

| | | | |
|---|---|---|---|
| CN | 101336768 | A | 1/2009 |
| CN | 201274838 | Y | 7/2009 |
| DE | 4436845 | A1 | 4/1996 |
| DE | 29614835 | U1 | 3/1997 |
| GB | 2393112 | A | 3/2004 |
| JP | 9206117 | A | 8/1997 |

* cited by examiner

COVER-TYPE CONTAINING STRUCTURE FOR FLEXIBLE ENCLOSURES

CROSS REFERENCE TO RELATED APPLICATIONS

This application is a Divisional of application Ser. No. 13/652,330, filed Oct. 15, 2012, which is a Continuation-in-Part of application Ser. No. 12/955,678, filed on 29 Nov. 2010, now abandoned, which is a Continuation of International Application No. PCT/CN2009/000596 filed on 27 May 2009, for which priority is claimed under 35 U.S.C. § 120; and this application claims priority of Application No. 200810028408.4 filed on May 30, 2008 under 35 U.S.C. § 119; the entire contents of which are hereby incorporated by reference.

BACKGROUND OF THE INVENTION a) Field of the Invention

The present invention relates to a cover-type containing structure for flexible enclosures 3, and more particular to a multi-functional structure which applies a fastening mode to facilitate a user to quickly contain and access a flexible enclosure 3, such as a bag unit 10 or a piece of clothing.

b) Description of the Prior Art

In a modern industrial society which is highly developed, a need for most people to carry all kinds of personal belongings in a simpler and handier way has been increased significantly. For example, to reduce the use of plastic bags for environmental protection, a person should bring his or her own recycle shopping bag while shopping in a mall. In addition, to keep from cold or rain due to temperature change or when a raining season comes, he or she should carry personally a thin overcoat, a windbreaker or all kinds of clothing. However, the existing related structures which are designed to provide a user to fold and contain, whether being applied to the recycle shopping bag, the thin overcoat, the windbreaker or all kinds of clothing, are not able to achieve the effects of simplicity, quick containing and accessing. Furthermore, as being limited to a product framework, these existing structures are only provided with a single function of containing and not equipped with a complex function of containing objectives and providing a design of funny appearance at a same time.

Taking as an example the existing recycle shopping bag, the thin overcoat or the windbreaker that is carried personally, a mode of roll-up for containing is usually applied.

Referring to FIG. 1, it shows a schematic view of an ordinary recycle shopping bag in an unfolded state. The recycle shopping bag includes primarily a bag unit 3, a handle 31, a cover piece 300, a male containing piece 304 and a female containing piece 305, wherein the cover piece 300 further includes a fixing end 302 and an open end 303, and is fixed at an exterior side of the bag unit 3 by the fixing end 302. The male containing piece 304 is provided at a proper position of the open end 303 and the female containing piece 305 is provided at a position corresponding to an upper side of the male containing piece 304 by a proper distance. Referring to FIG. 2, it shows the ordinary recycle shopping bag which is rolled up. Upon containing, the bag unit 3 is first folded to form a same width as that of the cover piece 300 and is then rolled up underneath the open end 303 of the cover piece 300, along with the handle 31. When the bag unit 3 is rolled up to result in a same size of the cover piece 300, the bag unit 3 is next contained by the male containing piece 304 of the open end 303 and the female containing piece 305 is fixed, enabling the bag unit 3 to be fixed underneath the cover piece 300 after being rolled up.

In addition to the abovementioned recycle shopping bag, the personal thin overcoat or the windbreaker (not shown in the drawings) sold on existing markets also uses the similar roll-up mode and is provided with a single function that only the size can be reduced after roll-up, not having other functions of use. Therefore, it is very imperfect for the user, as the convenience of use and the complex multi-function cannot be provided.

SUMMARY OF THE INVENTION

The primary object of the present invention is to provide a cover-type containing structure for flexible enclosures, which uses a fastening mode to facilitate a user to quickly contain and access a flexible enclosure such as a bag unit or a piece of clothing, as well as to provide a complex function of using a smaller holding portion and a larger containing space at a same time, under an unfolded state. The present invention includes primarily a front cover sheet, a rear cover sheet, a connection portion and a flexible enclosure, wherein the front cover sheet is provided with a first joining edge and a cover piece, the rear cover sheet is provided with a cover assembly corresponding to the cover piece and the connection portion is provided underneath the front cover sheet at a position opposite to the rear cover sheet, thereby connecting the two sheets. The flexible enclosure is provided with a second joining edge which is engaged with the opposite first joining edge of the front cover sheet, thereby fixing the front cover sheet and the flexible enclosure.

A second object of the present invention is to provide a cover-type containing structure for flexible enclosures, wherein an exterior side of the front cover sheet or an inner or exterior side of the rear cover sheet is further provided with a holding portion to provide an additive function of putting in an objective, in addition to containing the flexible enclosure. Furthermore, a side wall of the containing structure that is connected with the holding portion can be further provided with a buckle and a belt to facilitate a user to carry as a bag unit when necessary.

A third object of the present invention is to provide a cover-type containing structure for flexible enclosures, wherein the second joining edge is partially engaged with the first joining edge and a containing port is formed at a place where the first joining edge is not engaged with the second joining edge. When the unfolded flexible enclosure is accessed, the opened rear cover sheet can be put into the containing space between the front cover sheet and the flexible enclosure from the containing port.

A fourth object of the present invention is to provide a cover-type containing structure for flexible enclosures, wherein a side wall is provided between the front cover sheet and the cover piece; whereas, the flexible enclosure is provided with a joining portion to connect with the corresponding side wall. The joining portion assumes an annulus-like unit, a radius of which is a little smaller than that of the side wall and an interior of which is formed with the containing space. As the side wall is overlapped and encloses the joining portion and an upper wall of the annulus-like joining portion is abutted toward an upper wall of the side wall, a first containing portion will be formed in an un-abutted space between a lower wall of the joining portion and the side wall, thereby containing the folded rear cover sheet. An inner containing space of the annulus-like joining portion is combined with the front cover sheet to form a second containing portion which further includes a port to connect with the flexible enclosure, thereby allowing the folded flexible enclosure to be contained in the second containing portion from the port.

A fifth object of the present invention is to provide a cover-type containing structure for flexible enclosures, which is applied to a bag unit and is provided with an extension function by an extension portion to extend and put the holding portion at a bottom in the flexible enclosure, wherein an end of the extension portion is connected to the second joining edge and the other end is connected to the first joining edge. Therefore, if the holding portion is loaded too heavily, the holding portion can be extended and put at the bottom in the flexible enclosure by the extension portion, without causing an opening to be suspended and deformed, as the holding portion which is connected to the opening is too heavy.

A sixth object of the present invention is to provide a cover-type containing structure for flexible enclosures, which is applied to a piece of clothing combined with a bag unit carried on a back or at a side and snapped horizontally to a user's waist. The exterior side of the front cover sheet or the inner or exterior side of the rear cover sheet is further connected with the holding portion to provide the additive function of putting in an objective, in addition to containing the clothing. A side or a rear of the containing structure that is connected with the holding portion can be further provided with an outer belt to facilitate using as a side pack, a backpack or a waist bag. When the clothing is contained, the outer belt of the rear cover sheet can facilitate carrying the bag unit and the clothing that is contained in the containing space.

A seventh object of the present invention is to provide a cover-type containing structure for flexible enclosures, which is applied to a piece of clothing combined with a bag unit. The present invention is further provided with plural through-holes for the clothing, allowing plural end parts of an inner belt (single shoulder strap or dual shoulder strap) to pass through the through-holes of the clothing and to be engaged with the bag unit. Next, the first joining edge is engaged with the corresponding second joining edge to fix the front cover sheet and the clothing, wherein an upper end and a lower end of the inner belt pass through respectively the plural through-holes of the clothing to connect with an upper rim and a lower rim of the front cover sheet, such that weight of the bag unit can be supported when a user is wearing the clothing.

An eighth object of the present invention is to provide a cover-type containing structure for flexible enclosures, which is applied to a piece of clothing combined with a bag unit. The present invention is provided with a mask unit between the front cover sheet and the rear cover sheet. A side of the mask unit is provided with a connection side to connect with the bag unit. The connection side is located at an upper rim of the mask unit and is connected with the upper rim of the front cover sheet or the first joining edge. In addition, the mask unit is further provided with a sheath piece to sheath and fix the mask unit on an outer periphery of the bag unit from top to bottom, thereby achieving a rain-proofing effect for the bag unit.

A ninth object of the present invention is to provide a cover-type containing structure for flexible enclosures, which is applied to a piece of clothing combined with a bag unit. The clothing and the bag unit are loosely or fixedly connected. For the fixed connection mode, the first joining edge and the second joining edge are engaged by gluing, hot pressing or sewing. For the loose connection mode, on the other hand, the first joining edge and the second joining edge are added respectively with a first movable joining piece and a second movable joining piece (such as a zipper, a snap latch or a hook-and-loop fastener), thereby providing a movable dismantlement function to the clothing and the bag unit. Therefore, when the clothing or the bag unit is damaged or gets dirty, it can be dismantled and replaced for use.

A tenth object of the present invention is to provide a cover-type containing structure for flexible enclosures, which is applied to a piece of clothing combined with a bag unit. The rear cover sheet is provided with a second holding portion; the containing mode of the rear cover sheet and the second holding portion is that by using the containing port or the containing portion, the rear cover sheet is put into the containing space between the front cover sheet and the clothing. In addition, the second holding portion, after the rear cover sheet has been put in, is located inside a pocket of the clothing. The pocket is provided with a pocket layer and the second holding portion is above the pocket layer. As the pocket is connected with the second holding portion, when wearing the clothing, the user can easily put his or her hand into an opening of the pocket to take an objective, such as a wallet or a cell phone, which was originally put in the second holding portion of the bag unit, out of the pocket.

An eleventh object of the present invention is to provide a cover-type containing structure for flexible enclosures, which is applied to a hat. The front cover sheet is a little larger than the rear cover sheet and both sheets are indented cover units, opposite to each other and in a semicircular shape. The cover sheets are connected with each other by the connection portion, such that the front cover sheet can be entirely sheathed on an exterior side of the rear cover sheet, thereby forming the containing space between the front cover sheet and the rear cover sheet. Therefore, the flexible enclosure (rain coat) can be put into the containing space of this hat structure while not in use, and can be used to shade from sun or keep warm when the user goes out everyday. But when it rains, the flexible enclosure (rain coat) can be taken out of the containing space for use.

A twelfth object of the present invention is to provide a cover-type containing structure for flexible enclosures, which is applied to a piece of clothing worn on an objective (including a pet), such as a rain coat or a windbreaker used for a dog. A left side and a right side of the front cover sheet are connected respectively with a male snap and a female snap. When wearing, the front cover sheet is aligned underneath and the rear cover sheet is aligned above a body of the objective (pet); whereas, by fixing the male snap with the female snap, the front and rear cover sheets are worn and fixed on the body of the objective (pet). When using the flexible enclosure (clothing), the rear cover sheet is opened by the cover piece and the cover assembly, and then the flexible enclosure (clothing) is taken out, unfolded and covered on the pet. In a mean time, the rear cover sheet is put in through the containing port, allowing the rear cover sheet to be contained in the containing space between the front cover sheet and the flexible enclosure (clothing). A front side of the containing structure is provided with an annular belt, above which is a fixing ring, at a place connecting to front sides of the front and rear cover sheets. Therefore, the user can hook a pull rope, which is provided with a hook ring, at the fixing ring to pull the objective (pet) on a ground. The embodiment can be also used for any objective, including all kinds of bags, articles for daily use, people (infants) or animals.

A thirteenth object of the present invention is to provide a cover-type containing structure for flexible enclosures, which is used in an objective to be carried (including a pet).

The flexible enclosure (bag) is primarily folded from the extension portion and is then contained between the front cover sheet and the rear cover sheet. When wearing the flexible enclosure (bag), the rear cover sheet is aligned underneath and the front cover sheet is aligned above the body of a pet, followed by fixing the male snap with the female snap to wear and fix the front cover sheet and the rear cover sheet on the body of the objective (pet). When using the flexible enclosure (bag), the front cover sheet is opened by the cover piece and the cover assembly, the flexible enclosure (bag) is taken out of the containing space between the front sheet and the rear cover sheet and then unfolded. When in use, the objective (pet) is put into the flexible enclosure (bag) from the opening from bottom to top and then the flexible enclosure (bag), which is loaded with the objective (pet), is carried by a hand or on a shoulder with a handle. A front side of the containing structure is provided with an annular belt, above which is a fixing ring, at a place connecting to the front sides of the front and rear cover sheets. Therefore, the user can hook a pull rope, which is provided with a hook ring, at the fixing ring and can selectively contain the flexible enclosure (bag) between the front cover sheet and the rear cover sheet. The objective (pet) can be pulled on a ground by hooking the pull rope at the fixing ring, or the front cover sheet can be opened to load the objective (pet) into the unfolded flexible enclosure (bag) and then the flexible enclosure (bag), which is loaded with the object (pet), can be carried by a hand or on a shoulder, with a handle. The present embodiment can also be used for any objective, including all kinds of bags, articles for daily use, people (infants) or animals.

A fourteenth object of the present invention is to provide a cover-type containing structure for flexible enclosures, which is applied to a wiping cloth for cleaning purposes, for examples, devices with display screens, touch screens or optical elements such as smart phone, hand-held computer, camera, spectacles or eyeglasses, to which requires maintaining the screens and optical elements clean and neat. When the items such as cellphone or eyeglasses are not in use, they can be rolled along with the flexible enclosure and placed into the containing port storing in the containing space between the front cover sheet and the rear cover sheet and then closed by the corresponding cover piece and cover piece assembly. In addition, the containing structure is provided with a clipping piece thereby clamping and fixing the containing structure to the preferable objective (e.g. the user's shirt or pant pocket) such that it can prevent the personal items placed inside the containing structure from inadvertently losing.

A fifteenth object of the present invention is to provide a cover-type containing structure for flexible enclosures, which is applied to an outer belt of a bag unit, so that the outer belt can be concealed in the containing structure when not in use. For examples, in case the user simply wants to carry a backpack by using a handle, or using an additional shoulder strap to carry the bag and do not wish being affected by the dual shoulder straps swinging away, the containing structure of the embodiment can be applied to have the straps concealed completely. When not in use, the lower ends of flexible enclosure (the outer belt) can be folded in curve shape within the containing space. When using flexible enclosure (the outer belt), the rear cover sheet is to be opened and inserted from the containing port, such that the rear cover sheet can be placed inside the containing space between the front cover sheet and the holding portion.

A sixteenth object of the present invention is to provide a cover-type containing structure for flexible enclosures, wherein the exterior side of the front cover sheet and the exterior side of the flexible enclosure can be further provided with corresponding textures and patterns to improve a sense of aesthetics or contrast to a different visual effect. When the holding portion is used alone, the front cover sheet and the holding portion will manifest the partial textures or patterns. On the other hand, when the flexible enclosure is unfolded, the front cover sheet and the holding portion can manifest the textures or patterns corresponding to the flexible enclosure, thereby improving a sense of aesthetics, providing a funny appearance and contrasting to a different visual effect.

To enable a further understanding of the said object and the technological methods of the invention herein, the brief description of the drawings below is followed by the detailed description of the preferred embodiments.

DETAILED DESCRIPTION OF THE PREFERRED EMBODIMENTS

Figure 1:
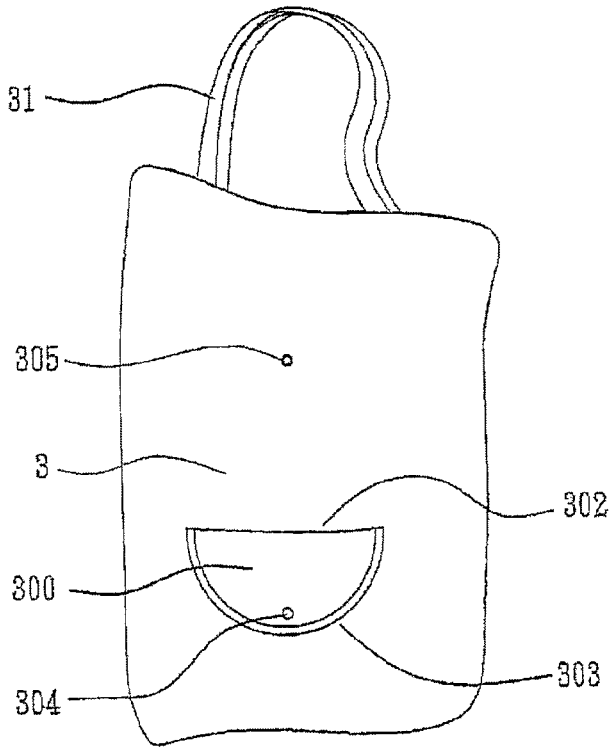
FIG. 1 shows a schematic view of a conventional shopping bag in an unfolded state.
Figure 2:
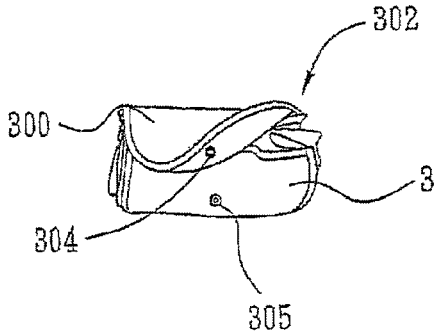
FIG. 2 shows a schematic view of the conventional shopping bag which is rolled up.
Figure 3:
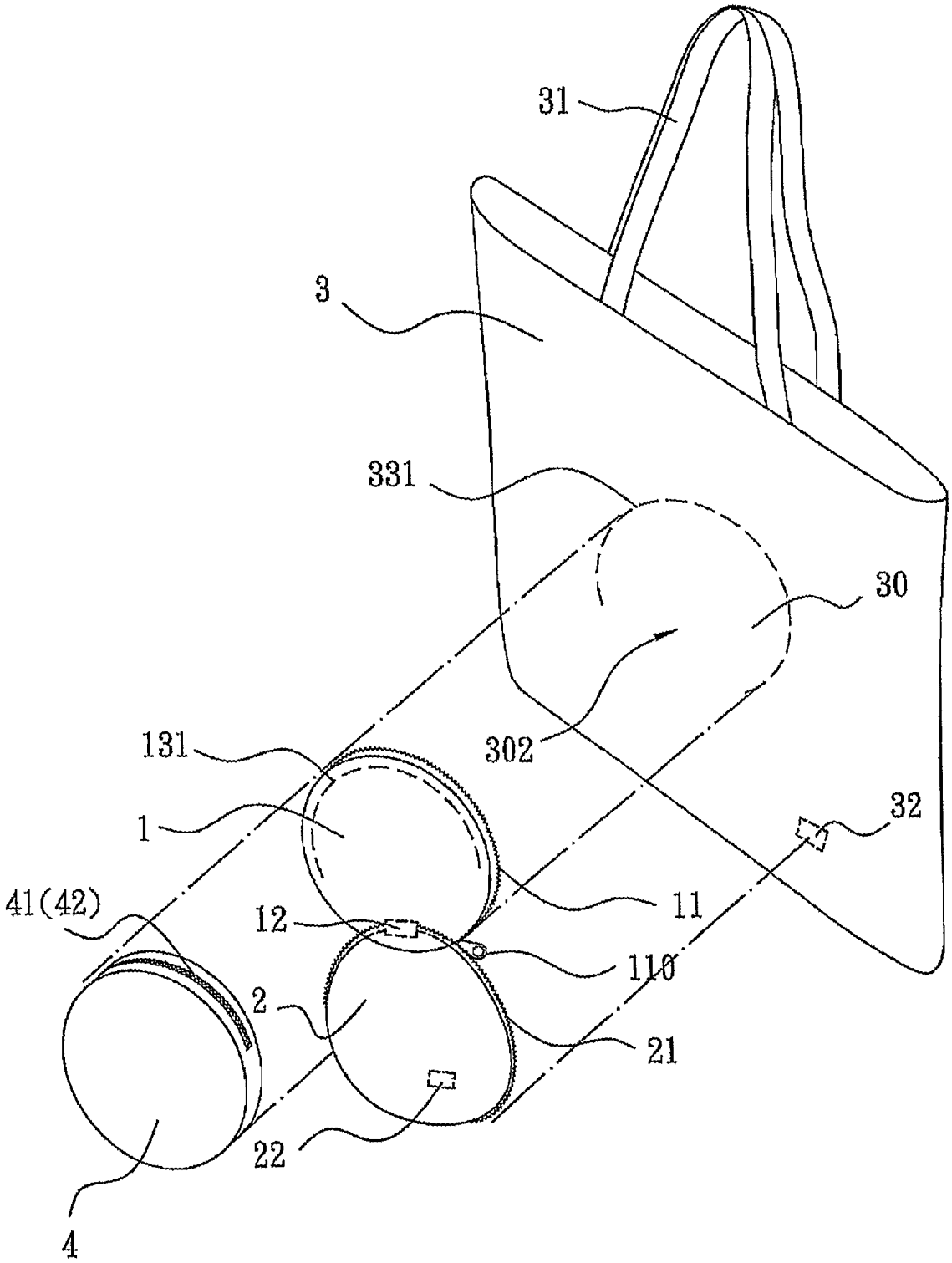
FIG. 3 shows an exploded view of a first embodiment of the present invention in an unfolded state.
Figure 4:
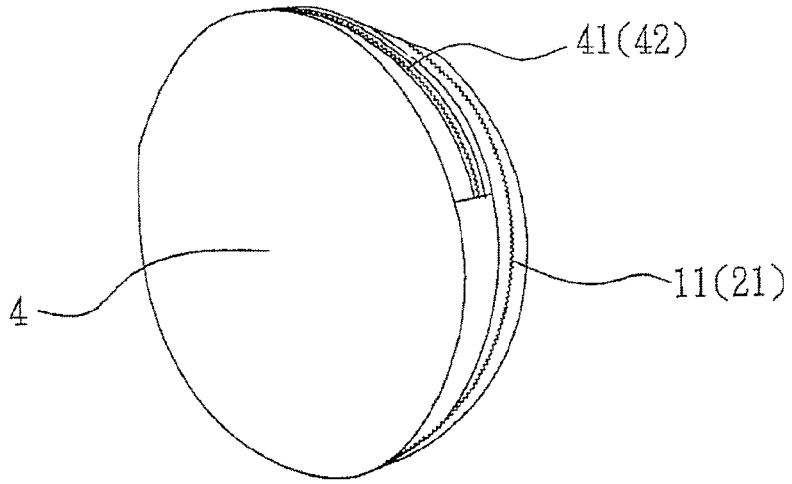
FIG. 4 shows a schematic view of the first embodiment of the present invention in a contained state.
Figure 5:
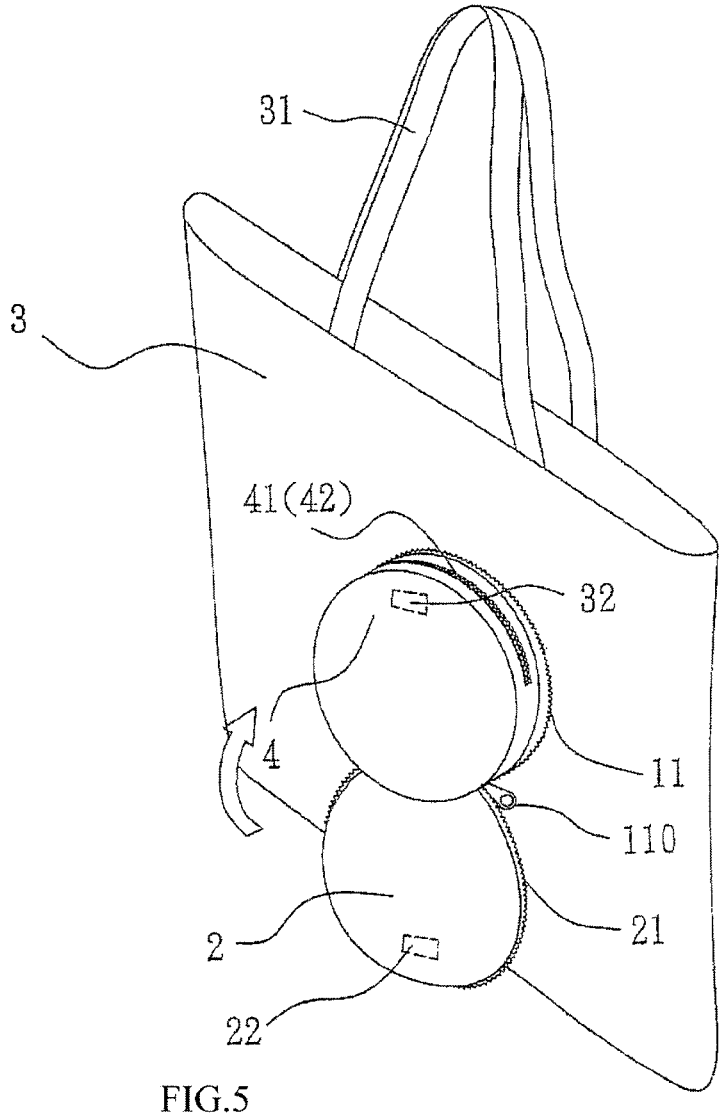
FIG. 5 shows a schematic view of the first embodiment of the present invention in an unfolded state.
Figures 6, 7, 8, 9:
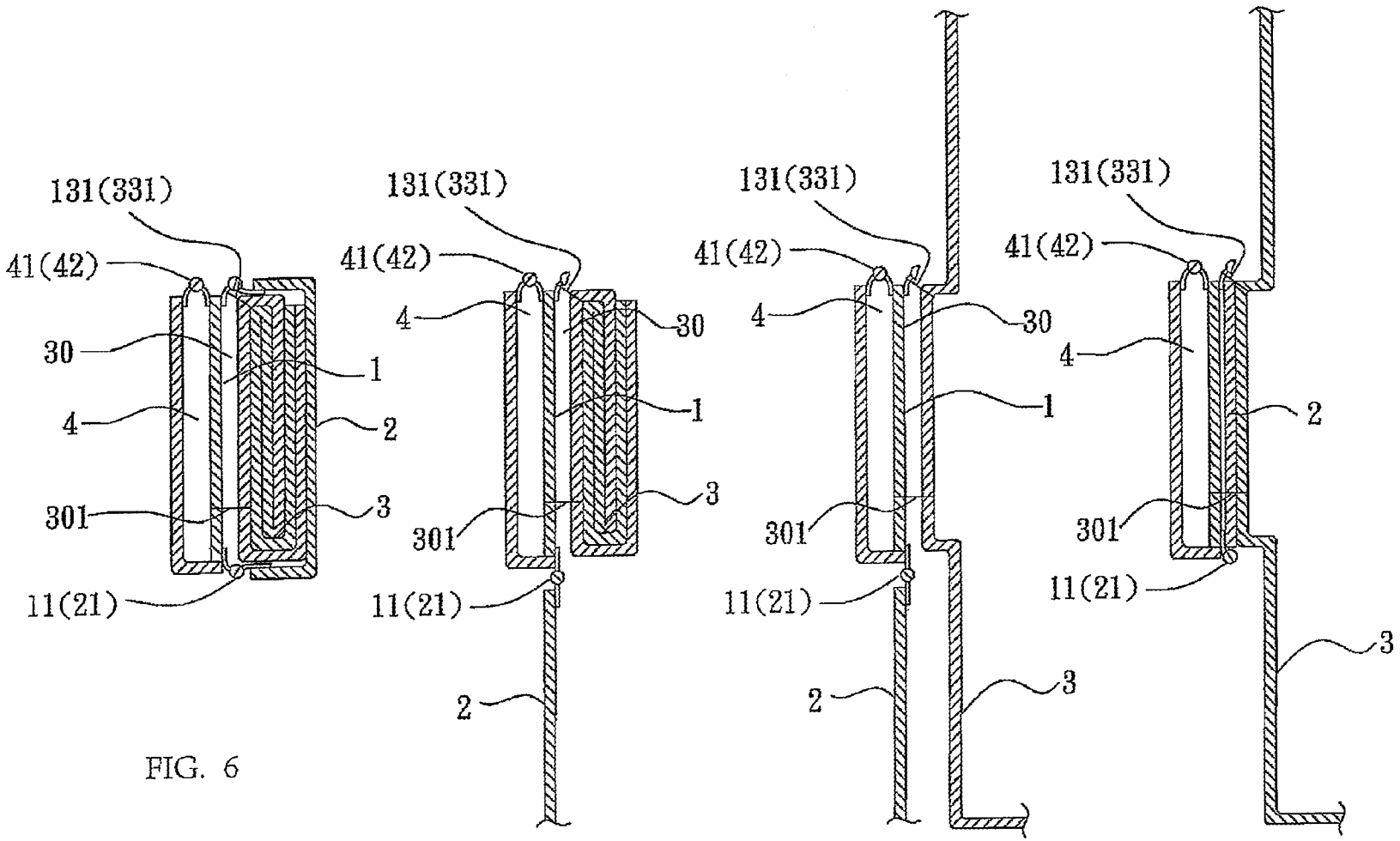
FIGS. 6 to 9 show schematic views of a cross section of the first embodiment of the present invention in the contained and unfolded states.

Referring to FIGS. 3 to 5, a first embodiment of the present invention comprises primarily a front cover sheet 1, a rear cover sheet 2, a connection portion 12 and a flexible enclosure 3, wherein an edge of the front cover sheet 1 is provided with a first joining edge 131 and a cover piece 11. The first joining edge 131 can be also provided at the rear cover sheet 2, between the front cover sheet 1 and the rear cover sheet 2 or at the connection portion 12. An edge of the rear cover sheet 2 is provided with a cover assembly 21 which corresponds to the cover piece 11; whereas, the cover piece 11 and the cover assembly 21 are a single-headed zipper and include a first pull piece 110. The connection portion 12 is provided underneath the front cover sheet 1, at a corresponding position above the rear cover sheet 2 to connect the two sheets. For most of the embodiments as illustrated in the present invention, the flexible enclosure 3 is provided with a second joining edge 331 which is engaged with the first joining edge 131 at the first cover sheet 1 and fixes the front cover sheet 1 on a surface of the flexible enclosure 3 primarily, wherein, a circumferential length of the first joining edge 131 with the corresponding second joining edge 331 assumes in circular, semi-circular shape, a rectangular shape, a semi-rectangular shape or an U-shape, such that covering area formed by the afore-mentioned shape can be more effectively contained with more stuffs placed therein. In addition, the overall size or length, the square measure, the measure of area, or the scale of covering area of the flexible enclosure 3 is larger or longer than the front cover sheet 1, the rear cover sheet 2, or the containing space 3 formed therebetween. The flexible enclosure 3 can be applied to different type of products, for examples, a piece of clothing, an expandable bag, an foldable wiping cloth or a long strap, etc.

An exterior side of the front cover sheet 1 can be further connected with a holding portion 4 by which another additive function of putting in an objective is provided, in addition to containing the flexible enclosure 3. The holding portion 4 is provided with a switching piece 41 and a switching assembly 42 to facilitate a user to open and close the holding portion 4 and access an objective therein at any time, wherein the switching mode of the switching piece 41 and the switching assembly 42 includes a zipper, a hook-and-loop fastener, a snap or a magnetic button. In the present embodiment, in addition to that the exterior side of the front cover sheet 1 can be connected with the holding portion 4, an interior side (as shown in FIGS. 20 to 23 of a second embodiment) or an exterior side (not shown in the drawings) of the rear cover sheet 2 can be further connected with the holding portion 4 to form a bag unit 10. As the structures are roughly the same, further description is not disclosed. In the present embodiment, a side of the rear cover sheet 2 corresponding to the flexible enclosure 3 can be further provided with a fixing piece 22 and a fixing assembly 32 to fix the rear cover sheet 2 on a surface of the flexible enclosure 3, such that the rear cover sheet 2 will not be suspended from the surface of the flexible enclosure 3 and swing; the fixing piece 22 and the fixing assembly 32 include a zipper, a hook-and-loop fastener, a snap latch or a magnetic button.

Besides, in addition to the above-mentioned fixing structure for the rear cover sheet 2, the fixing assembly 32 can also be provided on an exterior surface of the holding portion 4, corresponding to the position of the fixing piece 22 of the rear cover sheet 2. The turned rear cover sheet 2 can be fixed on the exterior surface of the holding portion 4 (as shown in FIG. 5) by the fixing piece 22 and the fixing assembly 32. For this embodiment, the holding portion 4 is provided on an exterior surface of the front cover sheet 1 (as shown in FIG. 3). However, under the condition there's no holding portion 4 provided in the embodiment, the fixing assembly 32 is directly provided on the exterior surface of the front cover sheet 1, allowing the fixing piece 22 of the rear cover sheet 2 to be aligned with and fixed at the fixing assembly 32 provided on the front cover sheet 1 (not shown in the drawing), after the rear cover sheet 2 has been turned. Therefore, the rear cover sheet 2 will not be suspended from the surface of the flexible enclosure and swing. The fixing piece 22 and the fixing assembly 32 include a zipper, a hook-and-loop fastener, a snap latch or a magnetic button, and if the zipper is used for implementation, then a double-headed zipper will allow the turned rear cover sheet 2 to be fixed on the exterior surface of the front cover sheet 1 or the holding portion 4 (not shown in the drawing). Accordingly, the fixing piece 22 provided by the rear cover sheet 2 corresponds to the fixing assembly 22 provided on the surface of the flexible enclosure 3, the front cover sheet 1 or the holding portion 4. The rear cover sheet 2 is fixed at the flexible enclosure 3, the front cover sheet 1 or the holding portion 4 by the fixing piece 22 and the fixing assembly 32, allowing the rear cover sheet 2 not to be suspended from the surface of the flexible enclosure 3 and swing.

Referring to FIGS. 6 to 9, as the second joining edge 331 and the first joining edge 131 are engaged partially and a containing port 301 is formed at a place where the two edges are not engaged, when accessing the unfolded flexible enclosure 3, the rear cover sheet 2 can be put into a containing space 30 between the front cover sheet 1 and the flexible enclosure 3 from the containing port 301. On the contrary, after containing the folded flexible enclosure 3, the rear cover sheet 2 can be taken out of the containing port 301; whereas, the rear cover sheet 2 and the front cover sheet 1 can be fixed by a single-headed zipper and the first pull piece 110 (as shown in FIG. 5). Besides, to stably engage the front cover sheet 1 at the flexible enclosure 3 and to allow the rear cover sheet 2 that is contained in the containing port 301 to be latched into the containing space 30 without falling out of the containing port 301, a preferred structure of the present embodiment is that a circumferential length of the first joining edge 131 which is partially engaged with the second joining edge 331 is set to be at least a half of an entire circumferential length of the front cover sheet 1.

Figure 10:
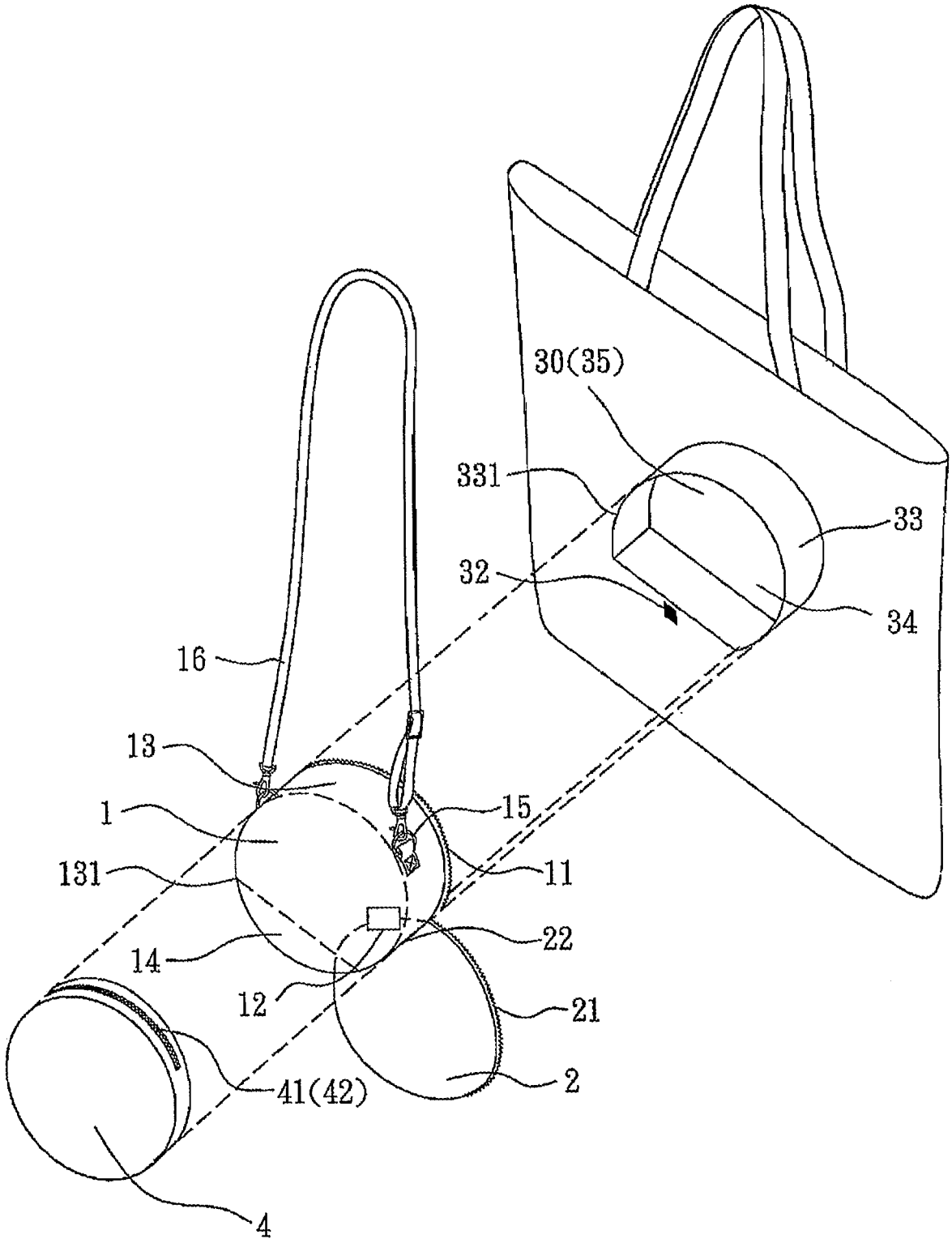
FIG. 10 shows an exploded view of a second embodiment of the present invention in an unfolded state.
Figure 11:
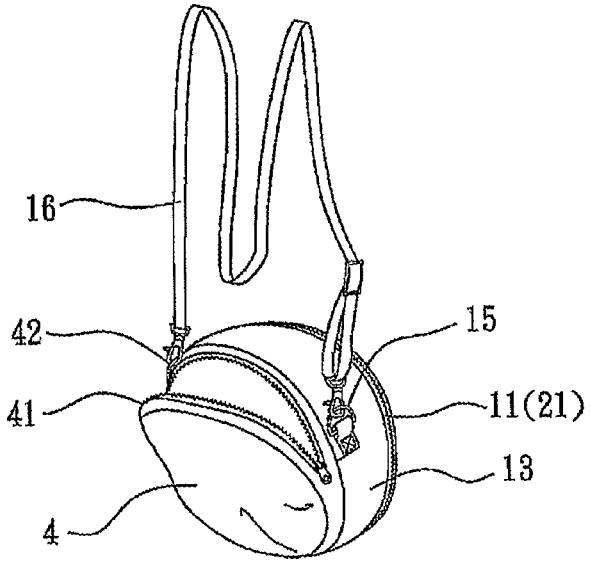
FIG. 11 shows a three-dimensional schematic view of the second embodiment of the present invention in a contained state.
Figure 12:
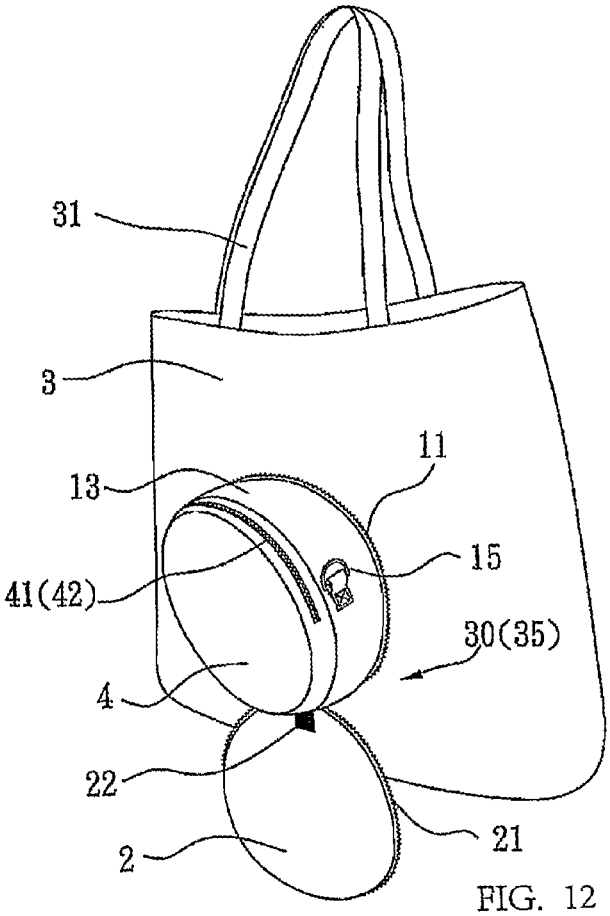
FIG. 12 shows a three-dimensional schematic view of the second embodiment of the present invention in an unfolded state.
Figure 13:
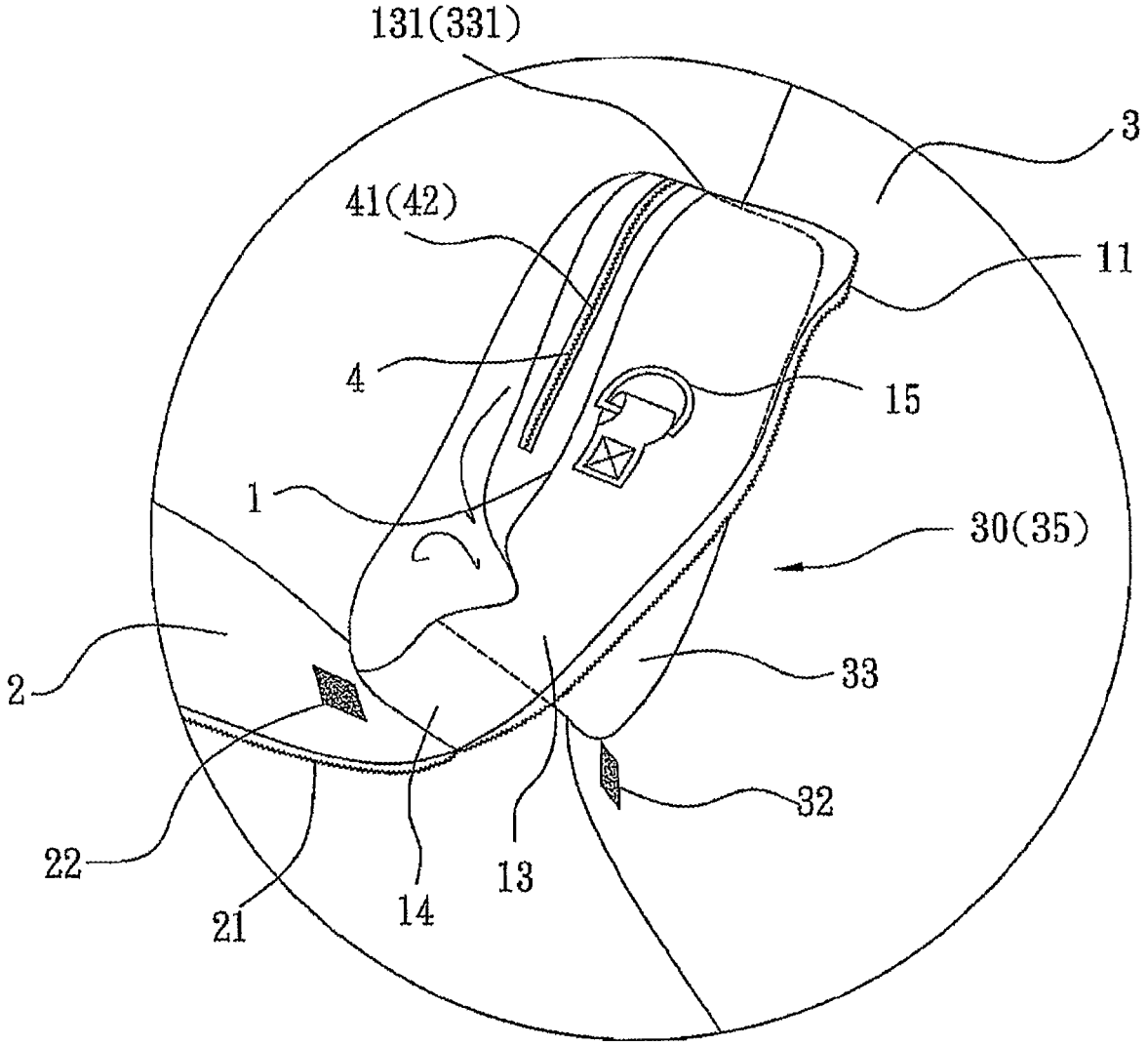
FIG. 13 and FIG. 14 show partial schematic views of the second embodiment of the present invention in the unfolded state.
Figure 14:
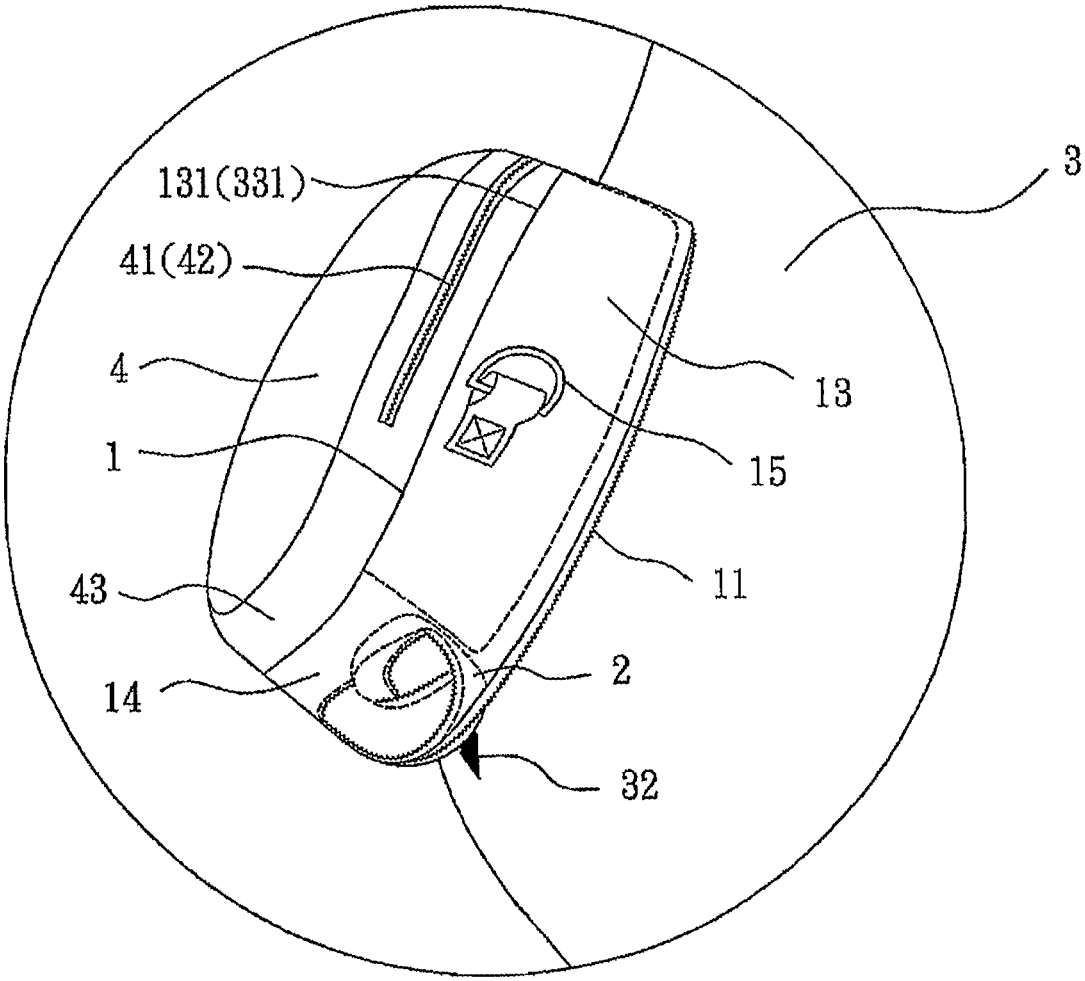
Figure 18:
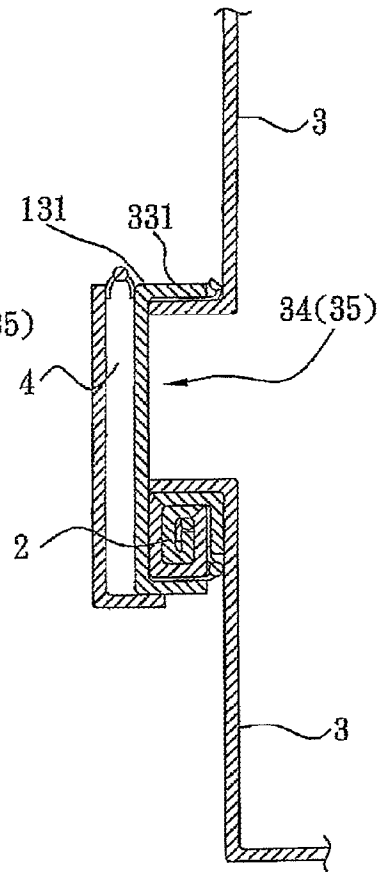
FIGS. 15 to 18 show schematic views of a cross section of the second embodiment of the present invention in the contained and unfolded states.
Figure 17:
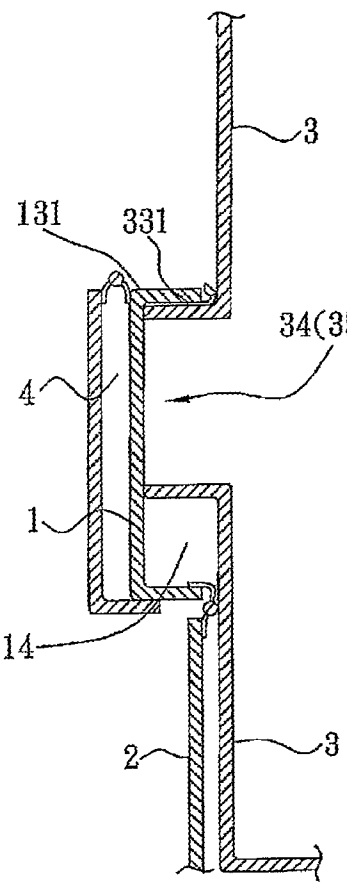
Figure 16:
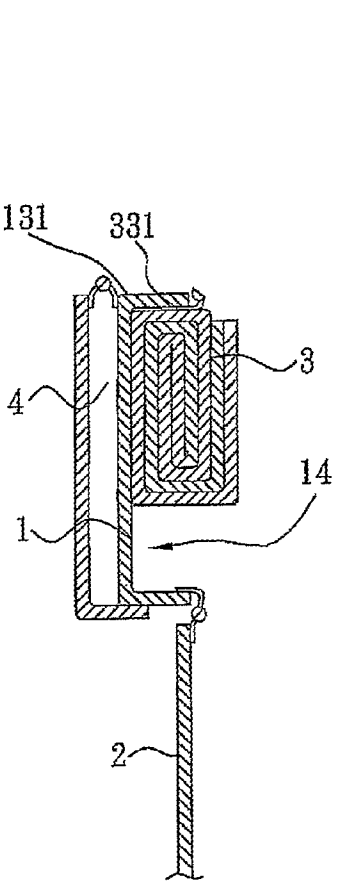
Figure 15:
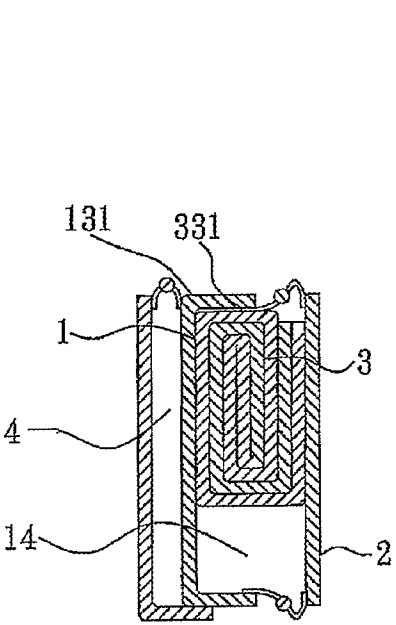
Figure 20:
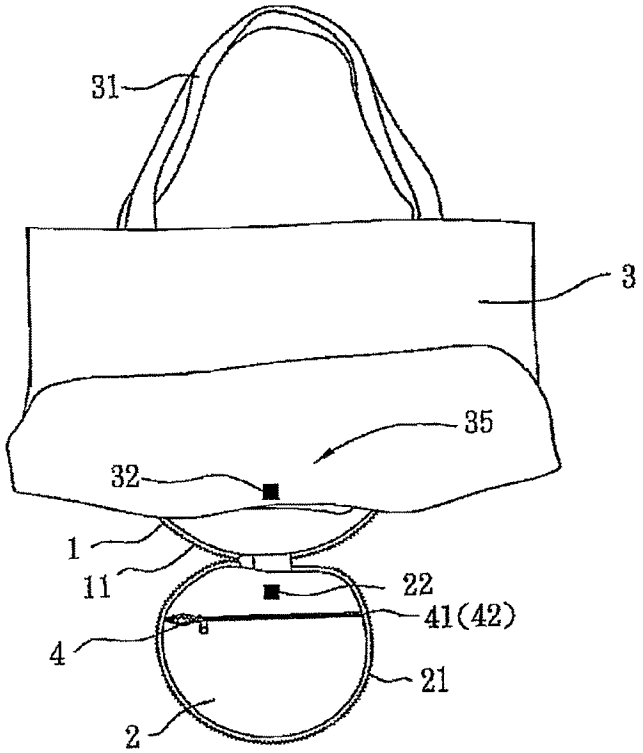
FIGS. 19 to 23 show schematic views of containing steps of the first and second embodiments of the present invention.
Figure 19:
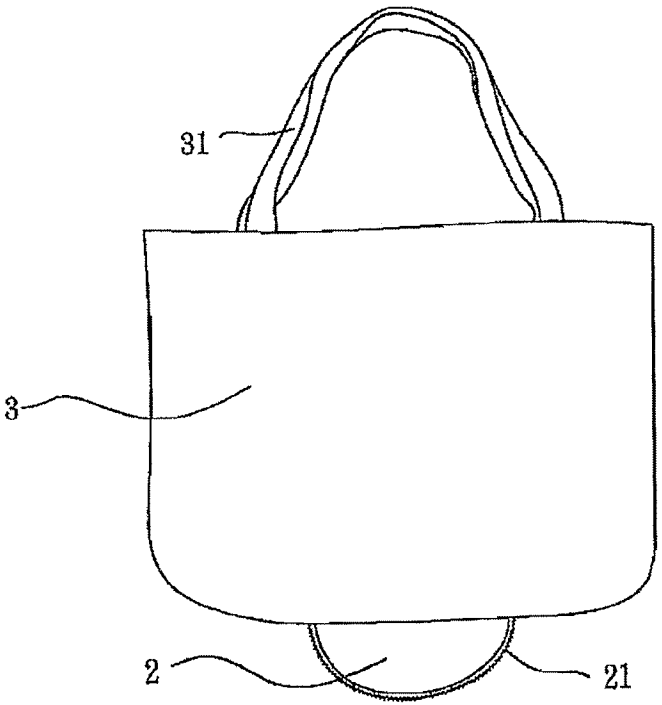
Figure 23:
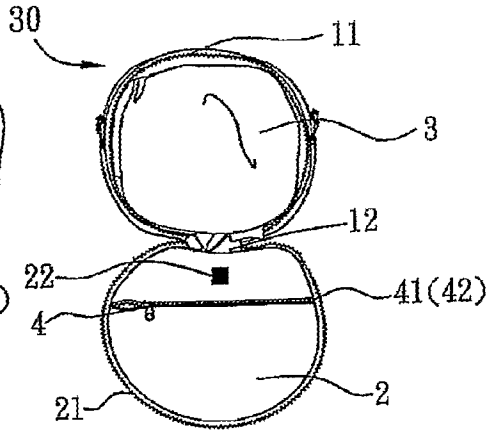
Figure 22:
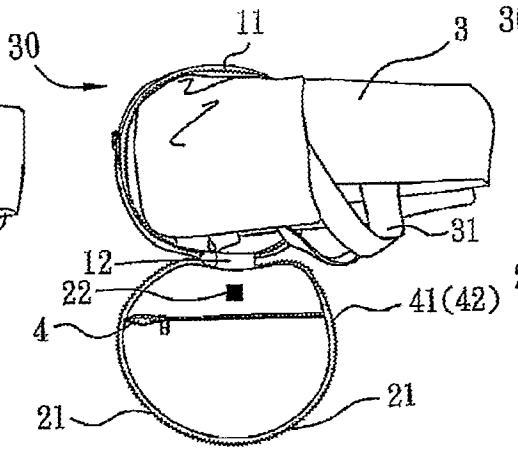
Figure 21:
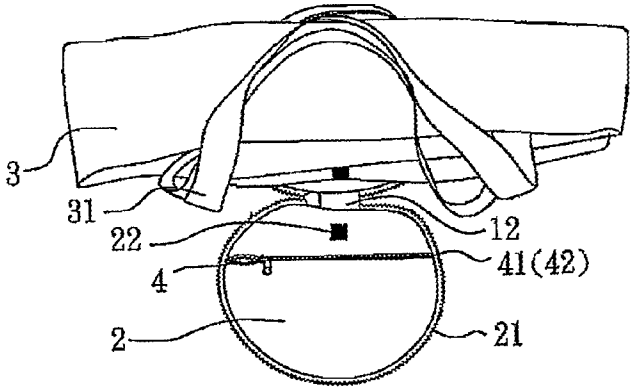

Referring to FIGS. 10 to 12, in addition to the components included in the first embodiment, a second embodiment of the present invention further includes a side wall 13 between the front cover sheet 1 and the cover piece 11, with that the flexible enclosure 3 is provided with a joining portion 33 corresponding to the side wall 13. The joining portion 33 assumes an annulus-like unit, a radius of which is a little smaller than that of the side wall 13 and an interior of which is formed with the containing space 30. The second joining edge 331 is abutted at and connected with the first joining edge 131, allowing the side wall 13 to overlap and enclose the joining portion 33. When the flexible enclosure 3 is folded and contained in a second containing portion 35 and is closed by the cover piece 11 and the cover assembly 21, the side wall 13 of the containing structure that is connected with the holding portion 4 can be further provided with a buckle 15 and a belt 16 to serve as a backpack, facilitating a user to carry personal belongings. As described above and same as the first embodiment, the holding portion 4 of the present embodiment is provided with the switching piece 41 and the switching assembly 42 to facilitate a user to open and close the holding portion 4 and access an objective therein at any time; the switching mode includes a zipper, a hook-and-loop fastener, a snap latch or a magnetic button.

Referring to FIGS. 13 to 18, as the second joining edge 331 is abutted at a top rim of and connected with the first joining edge 131, an upper wall of the annulus-like joining portion 33 is abutted toward an upper wall of the side wall 13, forming a first containing portion 14 in an un-abutted space between a lower wall of the joining portion 33 and the side wall 13 to contain the folded rear cover sheet 2 (or any wall of the annulus-like joining portion 33 is abutted toward any wall of the side wall 13 to form the first containing portion 14 in the un-abutted space). Moreover, the second containing portion 35 is formed after the inner containing space 30 of the annulus-like joining portion 33 has been combined with the front cover sheet 1, and the second containing portion 35 further includes a port 34 to connect with the flexible enclosure 3. Therefore, the folded flexible enclosure 3 can be contained in the second containing portion 35 through the port 34. On the other hand, the rear cover sheet 2 is further provided with a fixing piece 22 which is located underneath the first containing portion 14 and a fixing assembly 32 which is located underneath the joining portion 33. By the fixing piece 22 and the fixing assembly 32, the folded rear cover sheet 2 can be contained in the first containing portion 14 and then fixed, wherein the fixing piece 22 and the fixing assembly 32 are a hook-and-loop fastener or a snap latch.

As shown in FIGS. 19 to 23, when a user is to fold and contain the flexible enclosure 3 in the second containing portion 35 (FIG. 20), he or she should first put downward the holding portion 4 and the exterior side of the front cover sheet 1. At this time, the flexible enclosure 3 and the rear cover sheet 2 will face upward and the rear cover sheet 2 will be lifted open. When containing, the flexible enclosure 3 is folded from outside to inside to be located in the containing space 30 between the front cover sheet 1 and the rear cover sheet 2, whereas the front cover sheet 1 and the rear cover sheet 2 are closed by the cover piece 11 and the cover assembly 21. In the present embodiment, in addition to that the exterior side of the front cover sheet 1 can be connected with the holding portion 4, the interior side or the exterior side (not shown in the drawings) of the rear cover sheet 2 can be further provided with the holding portion 4 which is equipped with the switching piece 41 and the switching assembly 42, facilitating a user to open and close the holding portion 4 to access an objective therein at any time.

Figure 24:
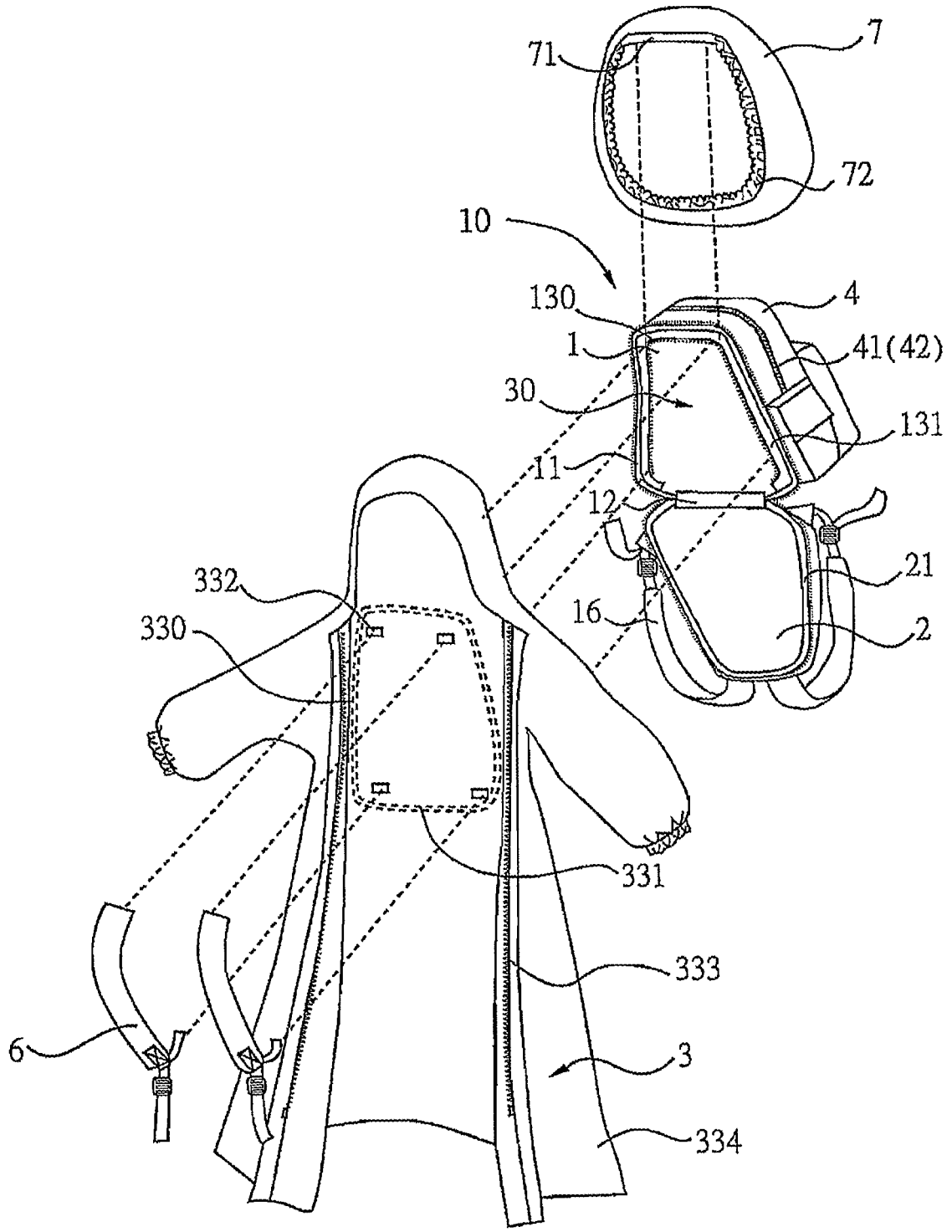
FIG. 24 shows an exploded view of a first implementation of the present invention to a piece of clothing, in an unfolded state.

In addition to being applied to the flexible enclosure which includes the recycle shopping bag or other kind of bag, the containing structure disclosed above can be further applied to implementations of all kinds of clothing, such as a sport shirt, an overcoat and a piece of clothes. Referring to FIG. 24, a first implementation of the present invention is a flexible enclosure 3 (clothing) combined with a bag unit 10, which is a backpack structure including a front cover sheet 1, a rear cover sheet 2, a connection portion 12, an outer belt 16 and a flexible enclosure 3 (clothing), wherein an edge of the front cover sheet 1 is provided with a first joining edge 131 and a cover piece 11; whereas, the first joining edge 131 is provided at a parallel side of the bag unit 10 corresponding to the flexible enclosure 3 (clothing), on the edge of the front cover sheet 1 in the drawing. An edge of the rear cover sheet 2 is provided with a cover assembly 21 corresponding to the cover piece 11; whereas, the cover piece 11 and the cover assembly 22 can be implemented as a zipper. The connection portion 12 is provided at a corresponding position between a side of the front cover sheet 1 and the rear cover sheet 2 to connect the two sheets. The clothing 3 includes a second joining edge 331 and an inner belt 6, wherein the second joining edge 331 is engaged with the first joining edge 131 of the front cover sheet 1 and fixes the front cover sheet 1 at a rear position of the flexible enclosure 3 (clothing). For the flexible enclosure 3 (clothing) and the bag unit 10, in addition to using a fixed joining mode (gluing, hot pressing or sewing) for the first joining edge 131 and the second joining edge 331, the first joining edge 131 and the second joining edge 331 can be also added respectively with a first movable joining piece 130 and a second movable joining piece 330 (such as a zipper, a snap latch, a magnetic button or a hook-and-loop fastener), thereby providing the flexible enclosure 3 (clothing) and the bag unit 10 with a movable dismantlement function that when the flexible enclosure 3 (clothing) or the bag unit 10 is damaged or gets dirty, it can be dismantled and replaced for use.

The flexible enclosure 3 (clothing) can be further opened with plural through-holes 332, allowing plural end parts of the inner belt 6 (a single shoulder strap or a dual shoulder strap at back) to pass through the through-holes 332 from the interior of the flexible enclosure 3 (clothing) to combine outward with the bag unit 10. Next, the first joining edge 131 is engaged with the corresponding second joining edge 331 to fix the front cover sheet 1 and the flexible enclosure 3 (clothing), wherein an upper end part and a lower end part of the inner belt 6 pass through the plural through-holes 332 of the flexible enclosure 3 (clothing) and then are connected with the upper rim and the lower rim of the front cover sheet 1, such that weight of the bag unit 10 can be supported when a user is wearing the flexible enclosure 3 (clothing).

Besides, a mask unit 7 is provided between the front cover sheet 1 and the rear cover sheet 2. A side of the mask unit 7 is provided with a connection side 71 which is connected with the bag unit 10; the connection side 71 is provided at an upper rim of the mask unit 7 and is connected with the upper rim of the first joining edge 131 of the front cover sheet 1. In addition, the mask unit 7 is further provided with a sheath piece 72 which can sheath the mask unit 7 from top to bottom at an outer periphery of the bag unit 10, thereby achieving a rain-proofing effect for the bag unit 10.

The rear cover sheet 2 is provided with an outer belt 16 which is a dual belt or a single belt at a back (not shown in the drawing); whereas, an upper end and a lower end of which are provided respectively at an upper side and a lower side of the exterior side of the rear cover sheet 2, allowing a user to carry the bag unit 10 and the flexible enclosure 3 (clothing) which is contained in the containing space 30 from the outer belt 16 of the rear cover sheet 2, when the flexible enclosure 3 (clothing) is contained. The outer belt 16 is loosely or fixedly connected with the bag unit 10 (which belongs to a prior art and is thus not described further). In the present embodiment, the exterior side of the front cover sheet 1 is connected with a holding portion 4 to provide an additive function of putting in an objective, in addition to containing the clothing 3. The holding portion 4 is provided with a switching piece 41 and a switching assembly 42 to facilitate a user to open and close the holding portion 4 to access an objective therein at any time, wherein the switching mode of the switching piece 41 and the switching assembly 42 includes a zipper, a hook-and-loop fastener, a snap latch or a magnetic button. In the present embodiment, in addition to that the exterior side of the front cover sheet 1 can be connected with the holding portion 4, the inner side or the exterior side (not shown in the drawing) of the rear cover sheet 2 can be further connected with the holding portion 4. As the structures are roughly the same, no further description is provided.

As shown in FIGS. 25 to 31, the flexible enclosure 3 (clothing) is taken out of the containing space 30 of the bag unit 10 and then worn on a user, wherein the front cover sheet 1 is fixed at a rear side, close to a center, of the flexible enclosure 3 (clothing); whereas, the holding portion 4 is connected at the exterior side of the front cover sheet 1, allowing a user to put in an objective. A front side of the flexible enclosure 3 (clothing) is provided with a left and right forepart 334, each of which is further provided with a closing piece 333. After wearing the flexible enclosure 3 (clothing), a user can use the closing pieces 333 to close the left and right foreparts 334.

Figure 25:
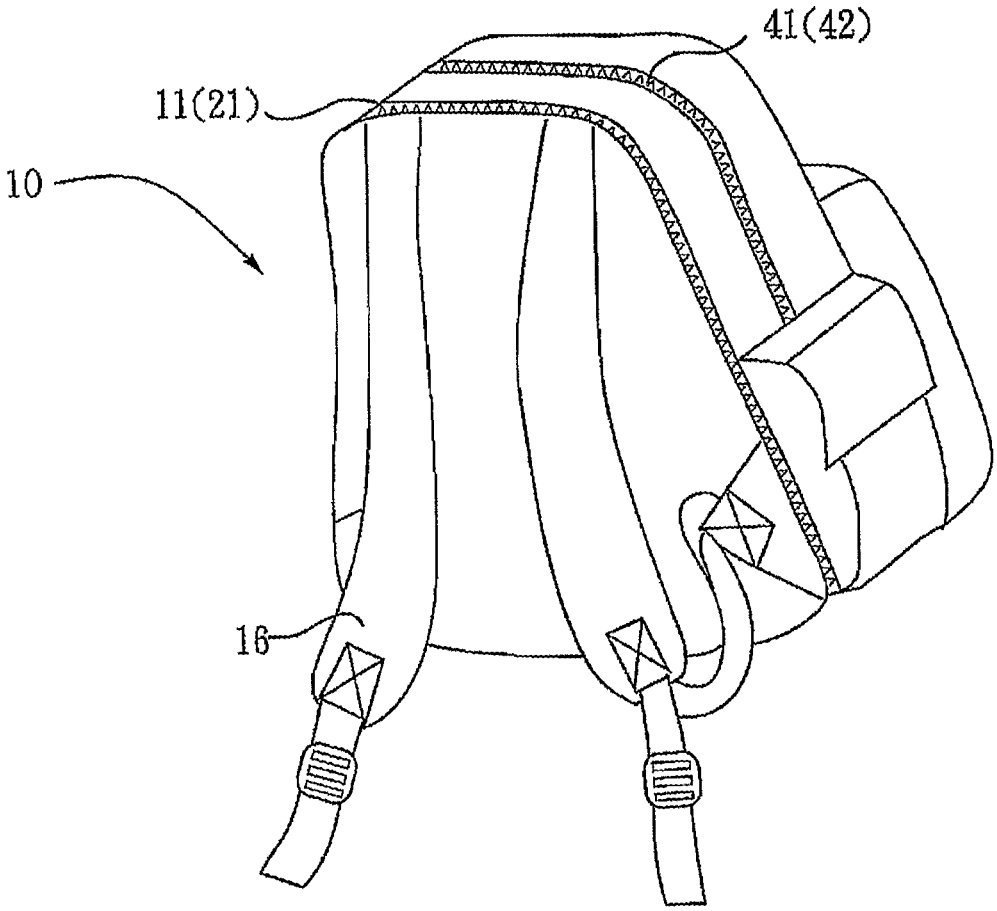
FIG. 25 shows a schematic view of the first implementation of the present invention to the clothing, after containing
Figure 26:
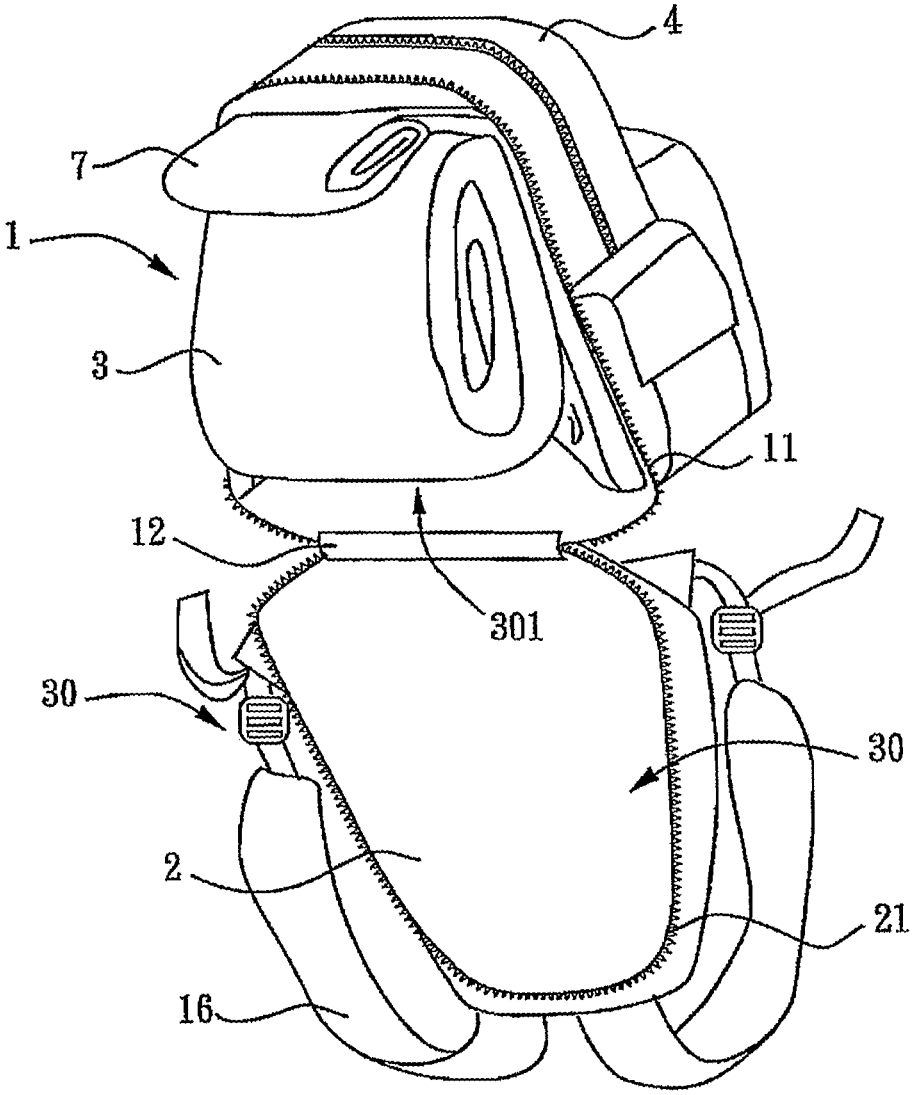
FIG. 26 shows a schematic view of the first implementation of the present invention to the clothing, in a partially unfolded state.
Figure 27:
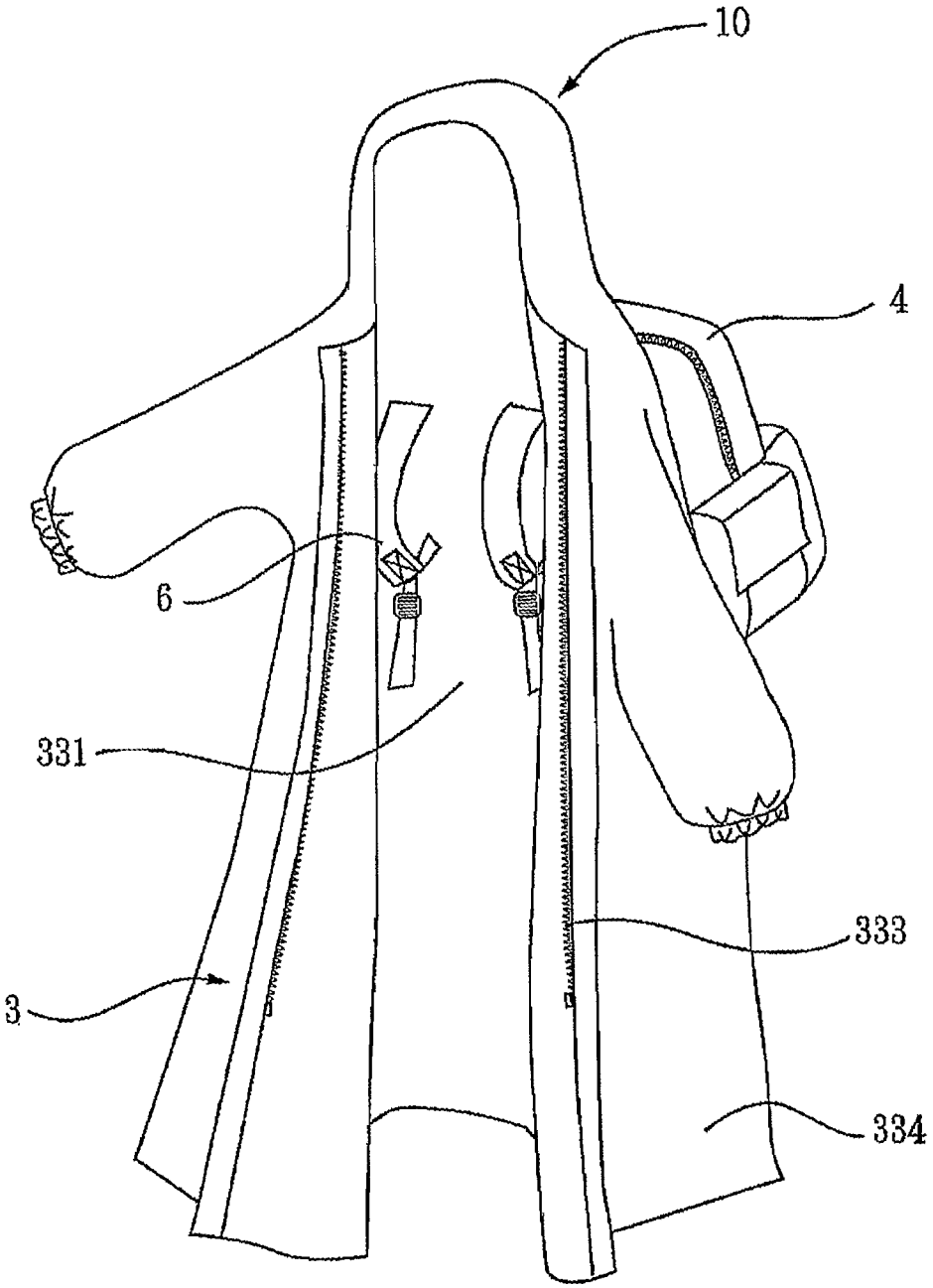
FIG. 27 shows a schematic view of the first implementation of the present invention to the clothing, in the unfolded state.
Figure 28:
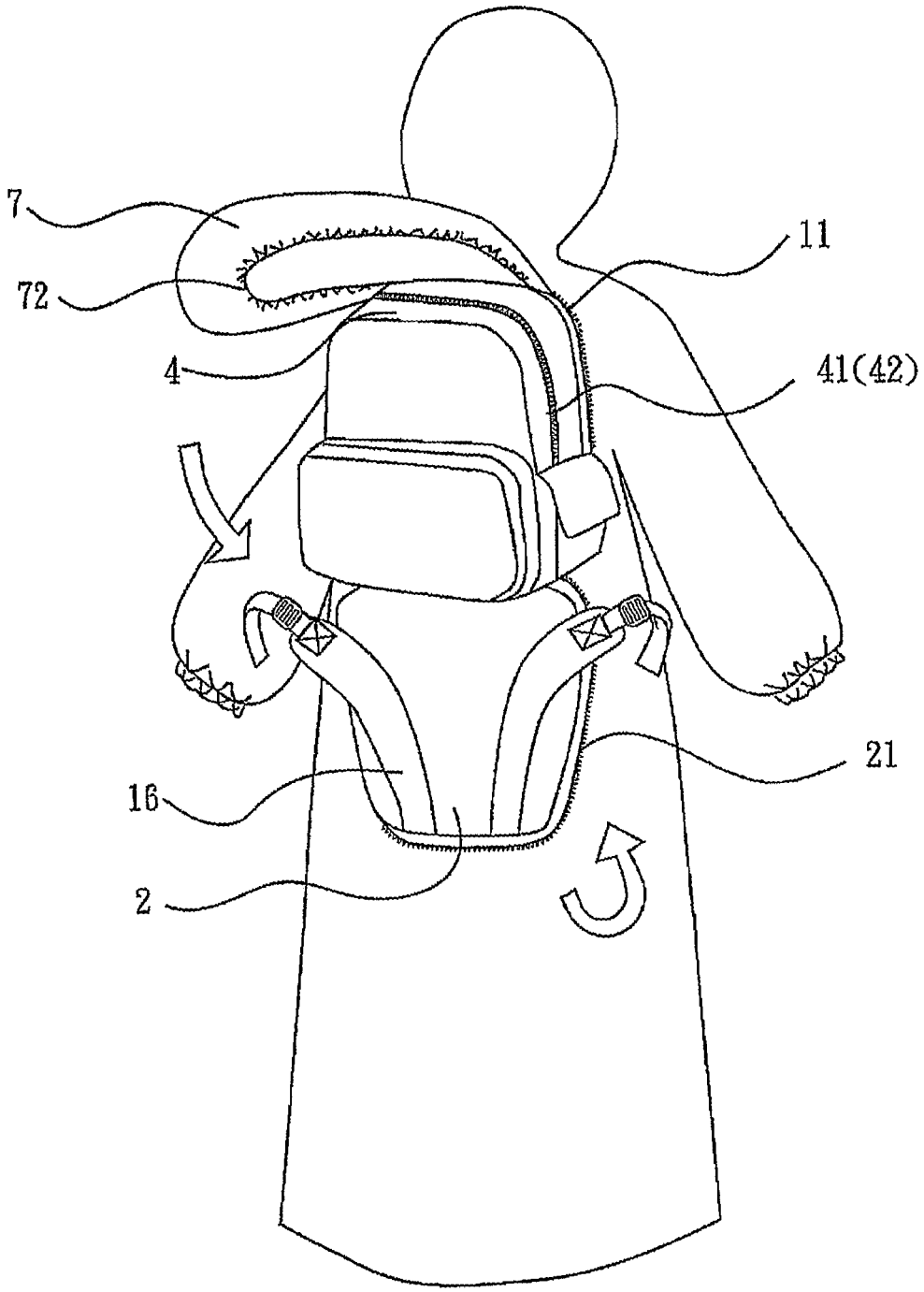
FIG. 28 and FIG. 29 show schematic views of expansion operations of the first implementation of the present invention to the clothing.
Figure 29:
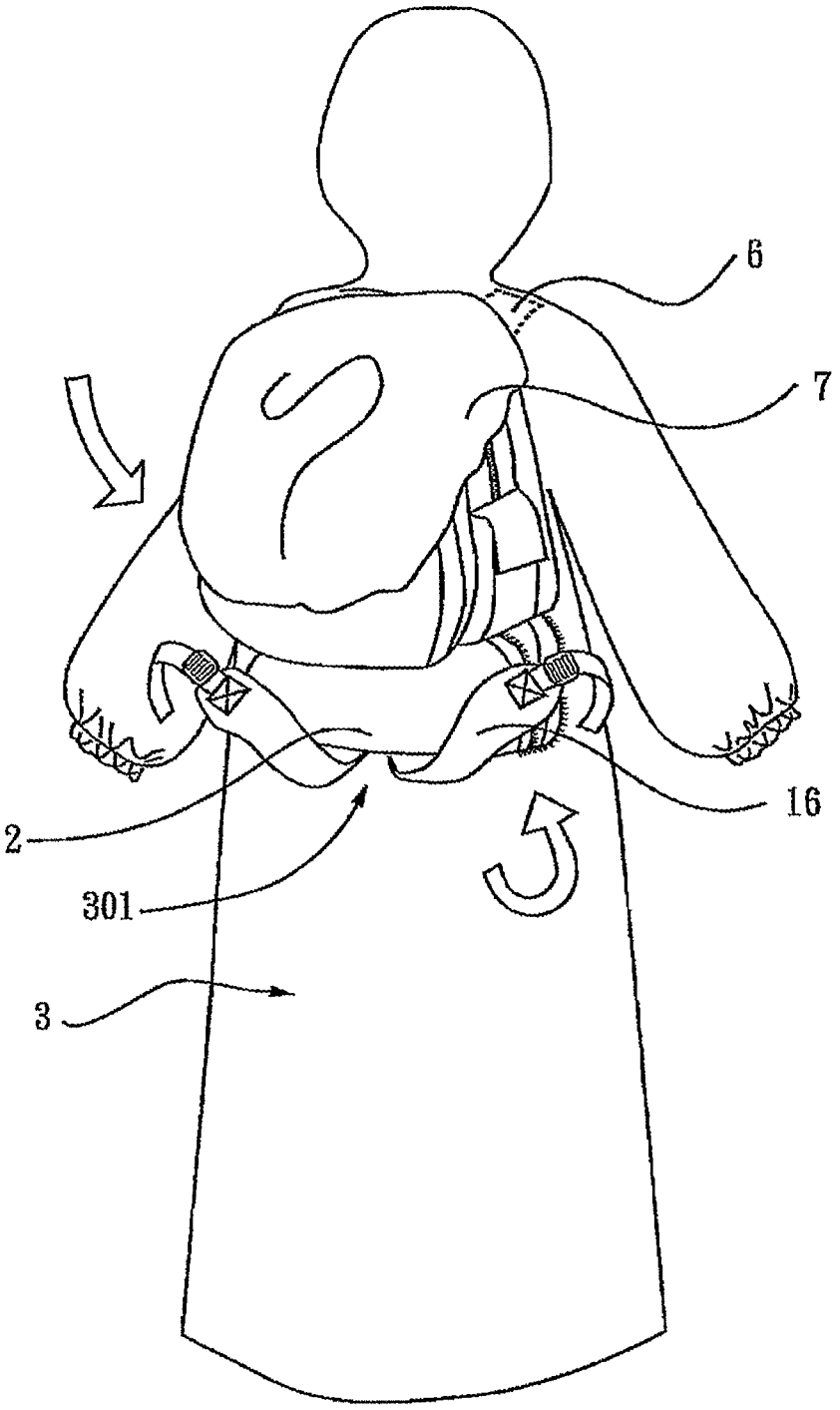
Figure 30:
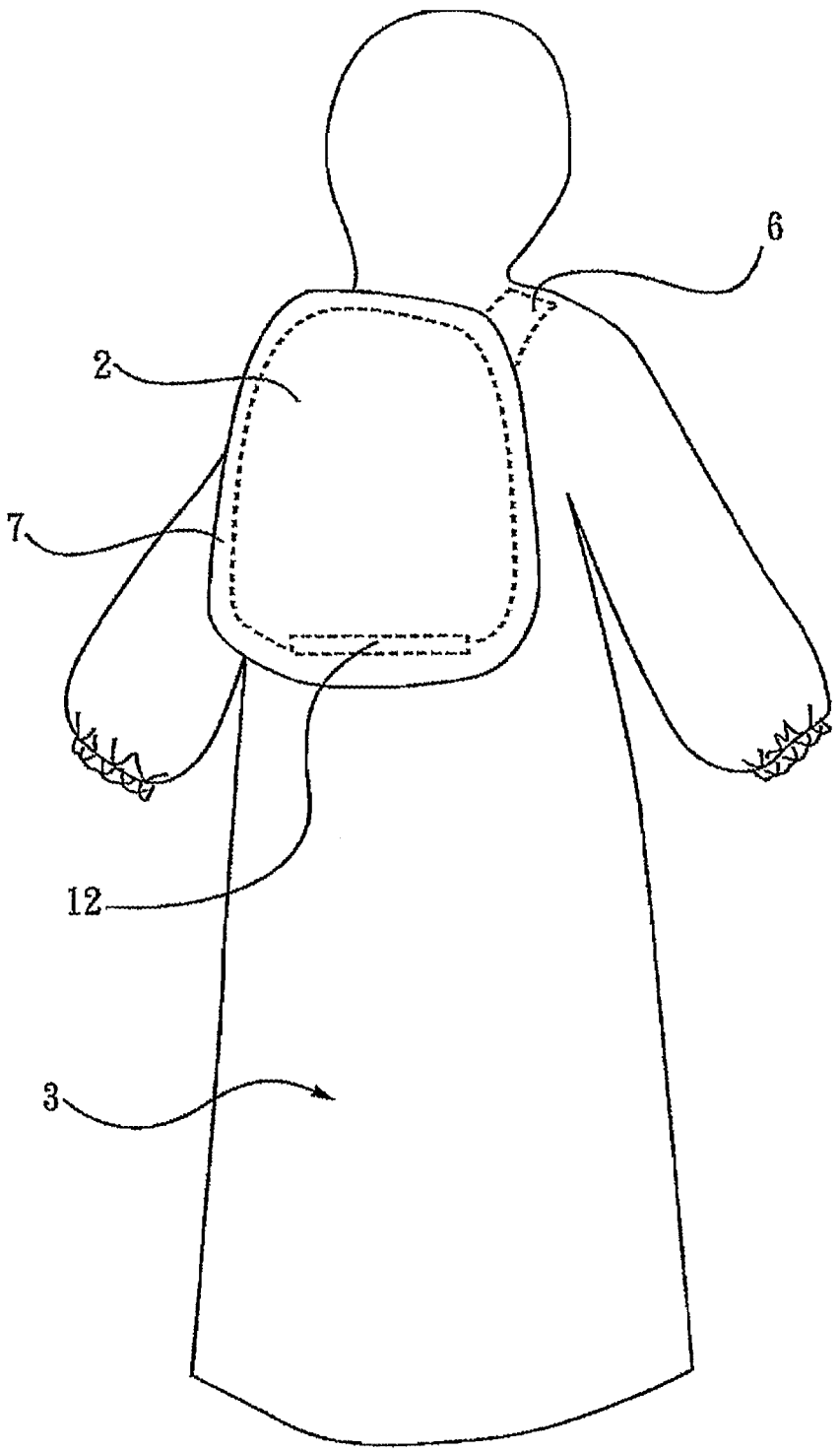
FIG. 30 and FIG. 31 show schematic views of the first implementation of the present invention to the clothing, after unfolding.
Figure 31:
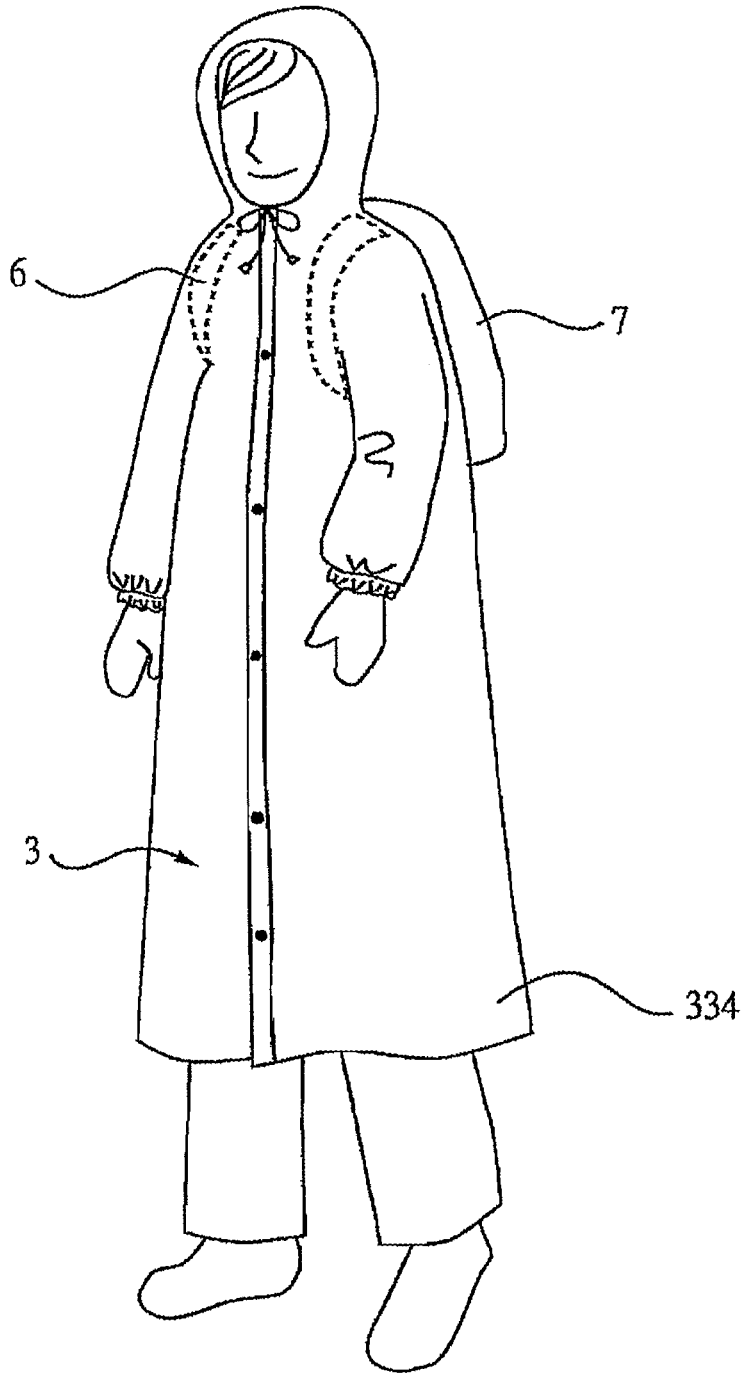

The rear cover sheet 2 is connected with the front cover sheet 1 from the connection portion 12 and when the rear cover sheet 2 is not yet contained in the containing space 30, it is located underneath the holding portion 4. As shown in FIG. 29 and FIG. 30, after the rear cover sheet 2 has been contained in the containing space 30, it will be hidden behind the holding portion 4 and lie between the holding portion 4 and the flexible enclosure 3 (clothing). As shown in FIG. 26, when the flexible enclosure 3 (clothing) and the mask unit 7 are not used, the holding portion 4 is first made to face downward and the rear cover sheet 2 is lifted open to expose the containing space 30, facilitating putting the flexible enclosure 3 (clothing) and the mask unit 7 into the containing space 30 after folding. When folding, the mask unit 7 and the flexible enclosure 3 (clothing) can be folded downward and the flexible enclosure 3 (clothing) is folded toward a center from four sides. At this time, the mask unit 7 and the flexible enclosure 3 (clothing) will become a rectangle after folding, a little smaller than the front cover sheet 1 and above the front cover sheet 1, to be contained in the containing space 30 and closed by the cover piece (assembly) 11 (21), as shown in FIG. 25. After the containing space 30 has been closed, the flexible enclosure 3 (clothing) is put into the containing space 30 and a user can still open the holding portion 4 from the switching piece (assembly) 41 (42) above the holding portion 4 to put into or access an objective. When the flexible enclosure 3 (clothing) is contained, the flexible enclosure 3 (clothing) and the inner belt 6 are closed in the containing space 30 between the rear cover sheet 2 and the front cover sheet 1 by the cover piece 11 and the cover assembly 21 and a user can utilize the outer belt 16 above the rear cover sheet 2 (as shown in FIGS. 29 to 31) and use the holding portion 4 as the bag unit 10.

Figure 32:
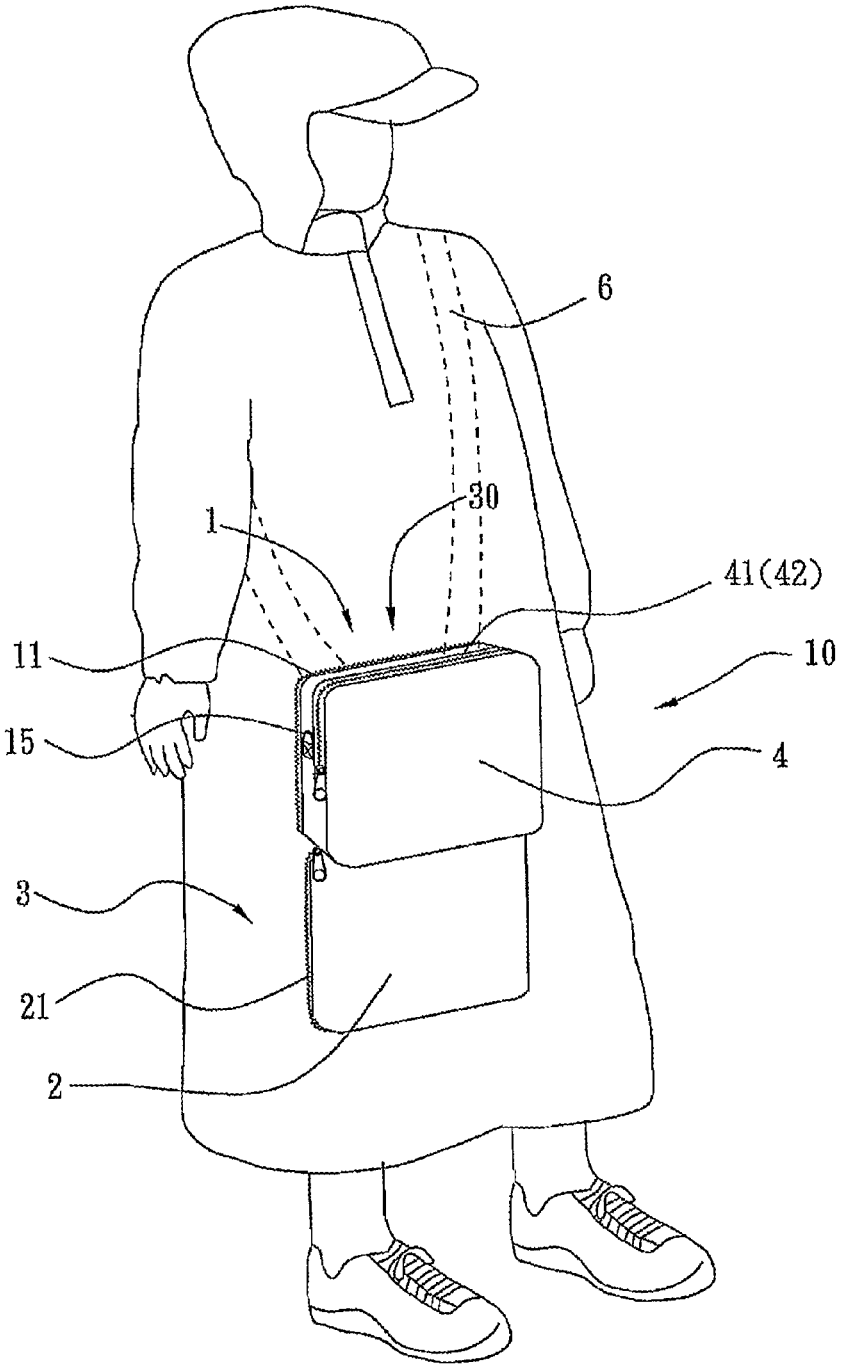
FIG. 32 and FIG. 33 show schematic views of a second implementation of the present invention to the clothing, in an unfolded state.
Figure 33:
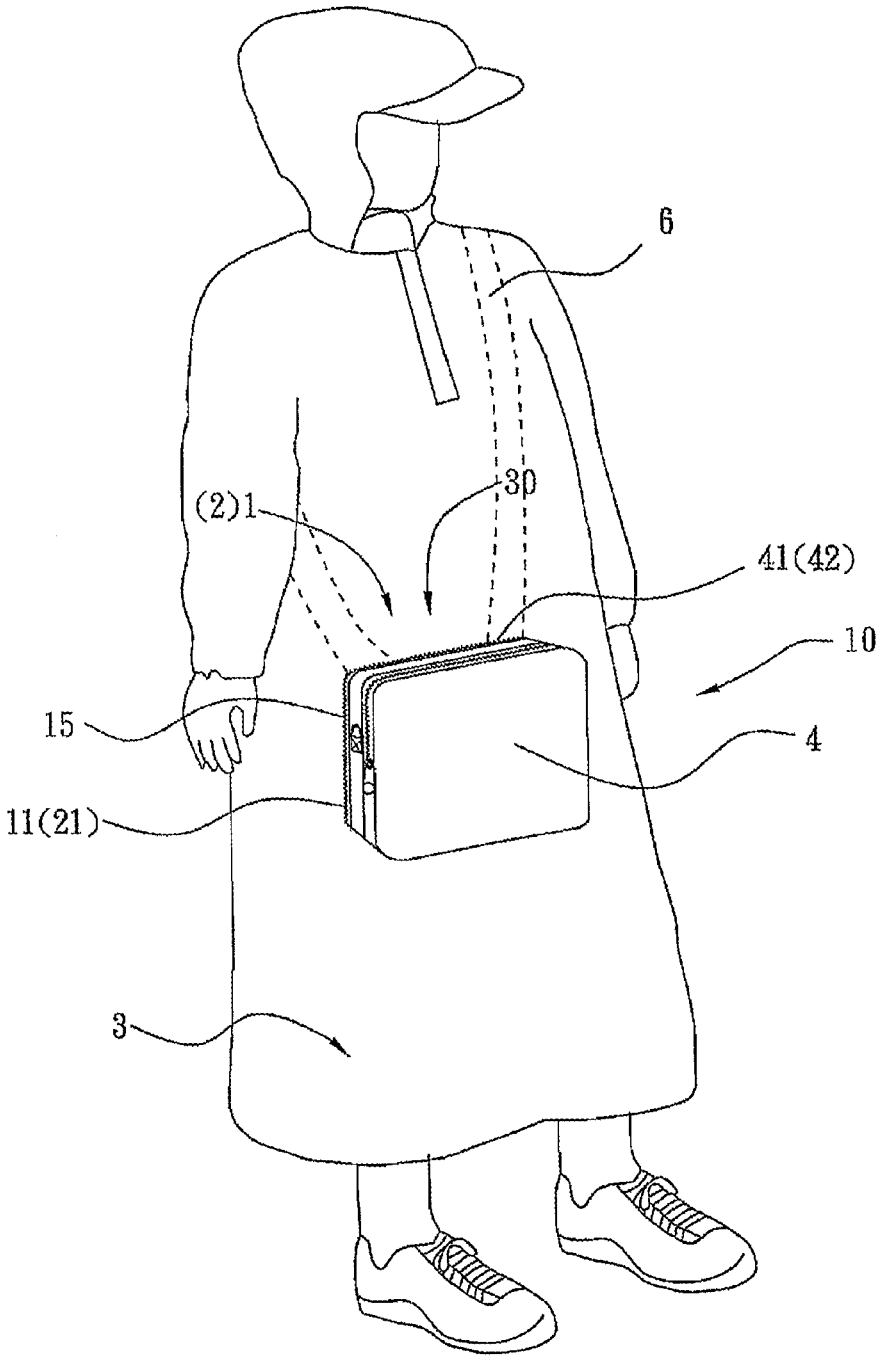

Referring to FIG. 32 and FIG. 33, a second implementation of the present invention is a flexible enclosure 3 (clothing) combined with a bag unit 10, which is a bag unit 10 worn at a side (usually called a side pack). The structures and elements included are all the same as those of the bag unit 10 in the first embodiment, with a primary difference being that the bag unit 10 is worn at a side or at a front of a human body by a single belt. Therefore, the outer belt 16 (not shown in the drawings) and the inner belt 6 are all connected by the single belt at a left and right end of the bag unit 10. When the flexible enclosure 3 (clothing) is not used, the containing mode is the same as that of the first embodiment where the flexible enclosure 3 (clothing) and the inner belt 6 are contained in the containing space 30 (not shown in the drawings) after folding, and are closed by the cover piece (assembly) 11 (21). When the flexible enclosure 3 (clothing) is contained, the storage function of the bag unit 10 can be still used. In addition, two sides of the bag unit 10 are provided respectively with a buckle 15 and an outer belt 16 (not shown in the drawings) which is movably engaged with the buckle 15, allowing a user to carry on a shoulder.

Figure 34:
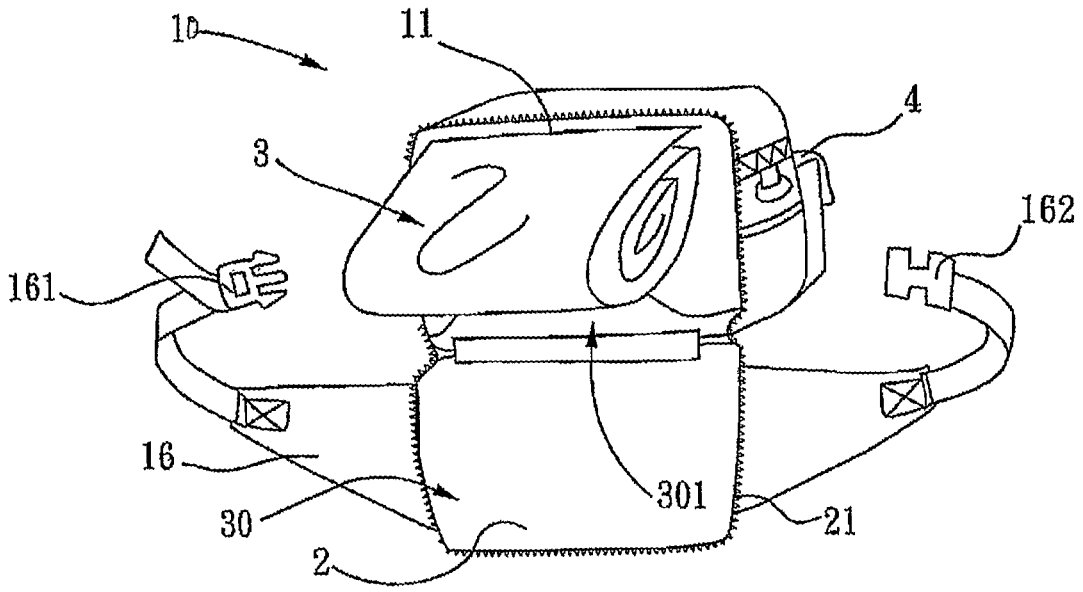
FIG. 34 shows a schematic view of a third implementation of the present invention to the clothing, in a partially unfolded state.
Figure 35:
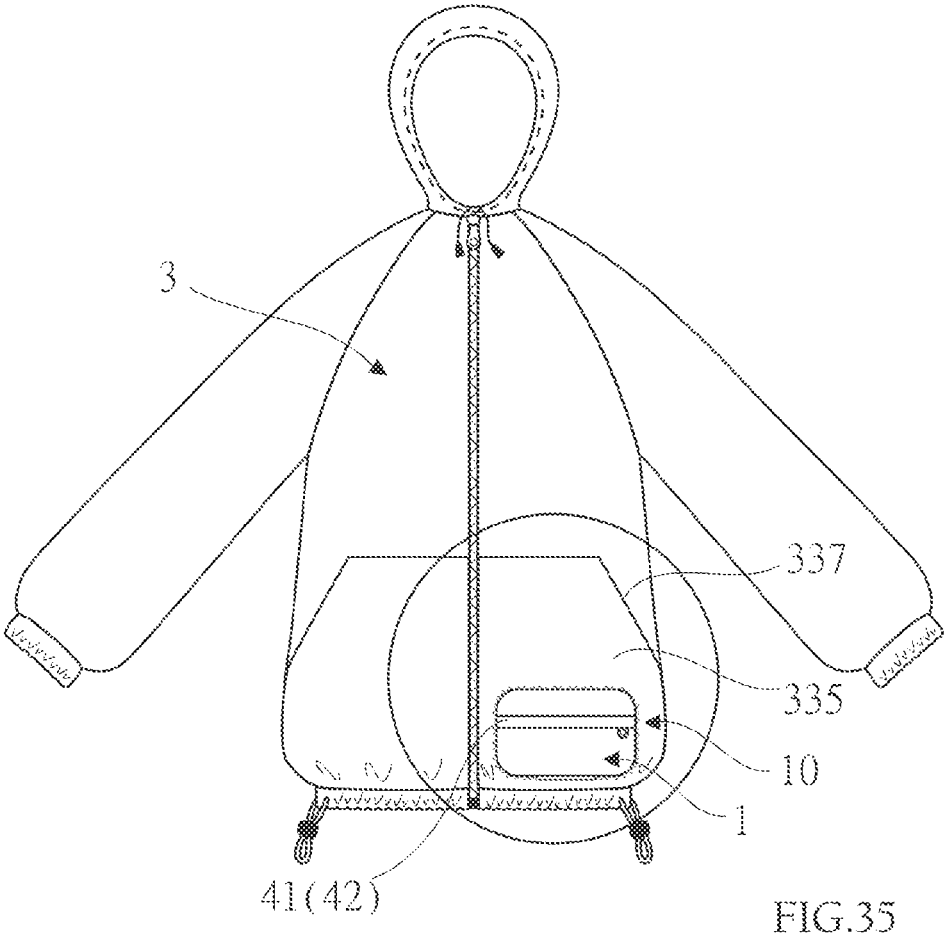
FIGS. 35 to 39 show schematic views of an unfolding process of a third embodiment of the present invention which is used in the clothing.
Figure 36:
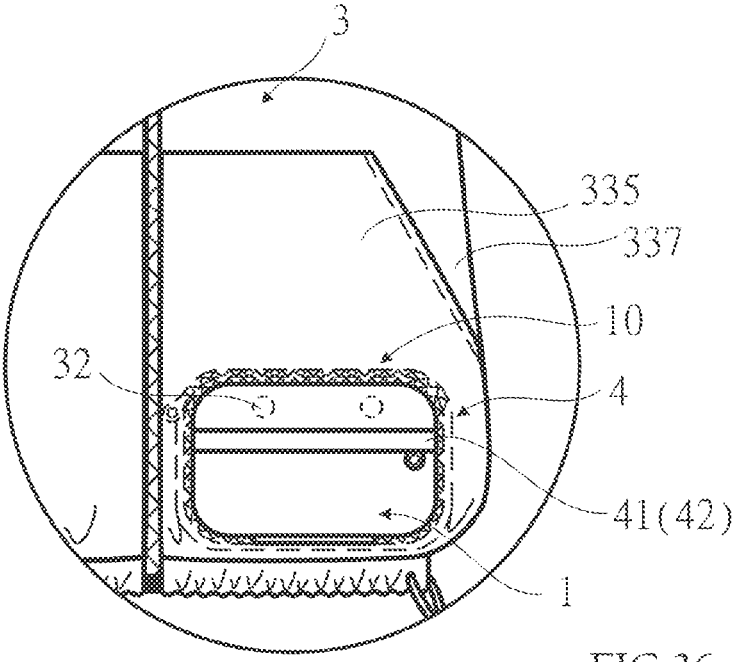
Figure 37:
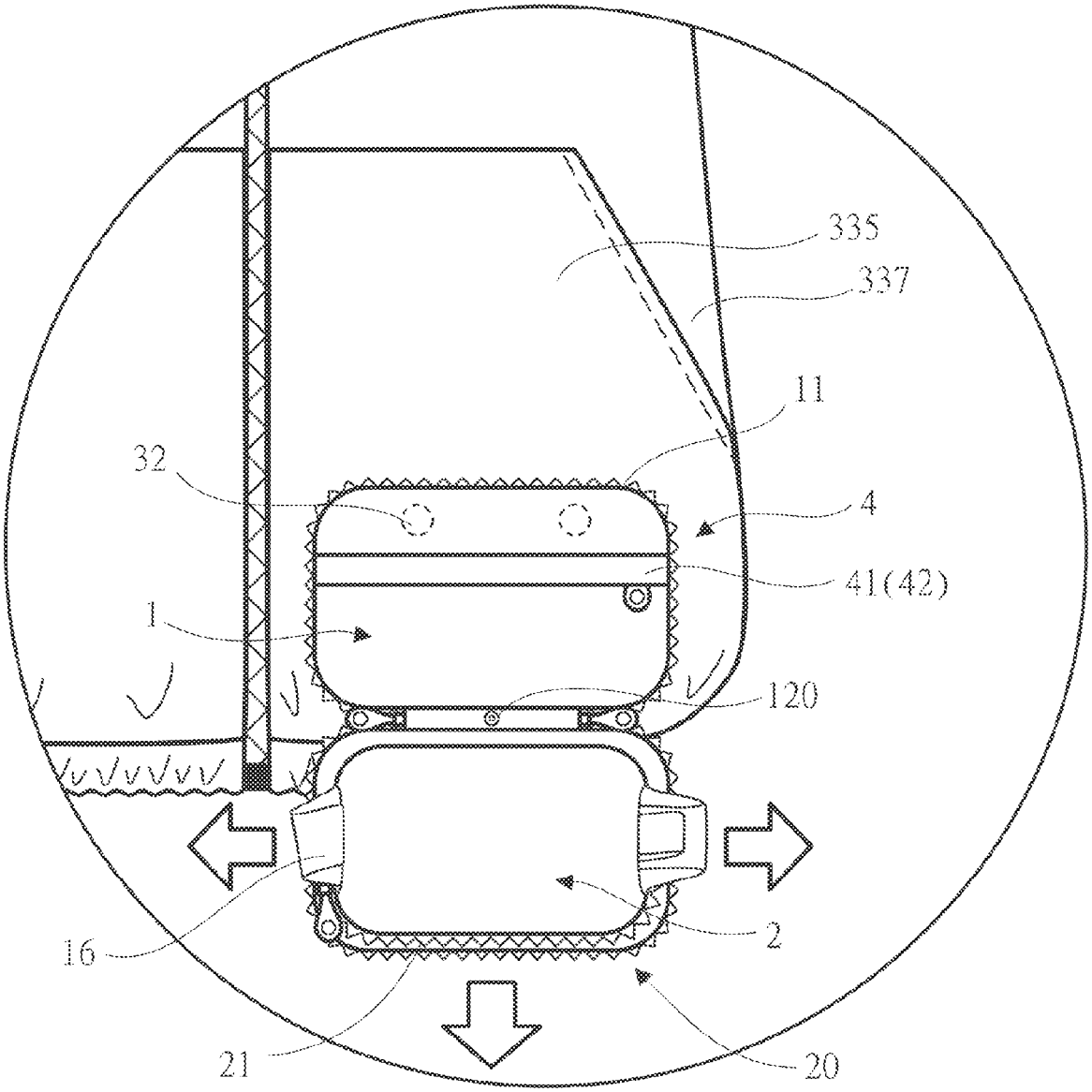

As shown in FIG. 34, a third embodiment of the present invention is a flexible enclosure 3 (clothing) combined with a bag unit 10, which is transversally fixed at a user's waist (usually called a waist bag). The structures and elements included are the same as those of the side bag unit 10 in the second embodiment, with a primary difference being that the bag unit 10 is connected to a left and right side by the outer belt 16 and is transversally fixed at a user's waist after engaging a male snap 161 with a female snap 162 at open ends of the outer belt 16. As an inner size of the holding portion 4 of the bag unit 10 of the present embodiment is smaller than that of the bag unit 10 in the abovementioned two embodiments, the inner belt 6 is not needed when the loading is not heavy, such that the weight of the bag unit 10 can be supported when a user is wearing the flexible enclosure 3 (clothing). When the flexible enclosure 3 (clothing) is not used, the containing mode is the same as that of the two abovementioned embodiments where the flexible enclosure 3 (clothing) is contained in the containing space 30 after folding, and is closed by the cover piece (assembly) 11 (21). When the flexible enclosure 3 (clothing) is contained, the storage function of the bag unit 10 can be still used. When the clothing 3 is contained, the outer belt 16 which is transversally connected at two sides of the bag unit 10 can be fixed on a waist by a user. Besides, the outer belt 16 is loosely or fixedly connected with the bag unit 10 (which belongs to a prior art and is thus not described further).

As shown in FIGS. 35 to 40, the front cover sheet 1 is fixed at a surface of a pocket 335 on the flexible enclosure 3 (clothing). A surface of the front cover sheet 1 is provided with a switching piece 41 and a switching assembly 42; whereas, a rim of the front cover sheet 1 is fixed at an exterior side of the flexible enclosure 3 (clothing), such that a range within the rim of the front cover sheet 1 can be covered on the surface of the flexible enclosure 3 (clothing), thereby constituting the holding portion 4 to contain objectives.

To allow the rear cover sheet 2 not to be suspended from the surface of the flexible enclosure 3 (clothing) and swing, the rear cover sheet 2 can also be provided with a fixing piece 22 corresponding to a fixing assembly 32 provided on the flexible enclosure 3 (clothing). By the fixing piece 22 and the fixing assembly 32, the rear cover sheet 2 can be fixed on the surface of the flexible enclosure 3 (clothing) (referring to FIG. 3); the fixing piece 22 and the fixing assembly 32 include a zipper, a hook-and-loop fastener, a snap latch or a magnetic button.

Figure 40:
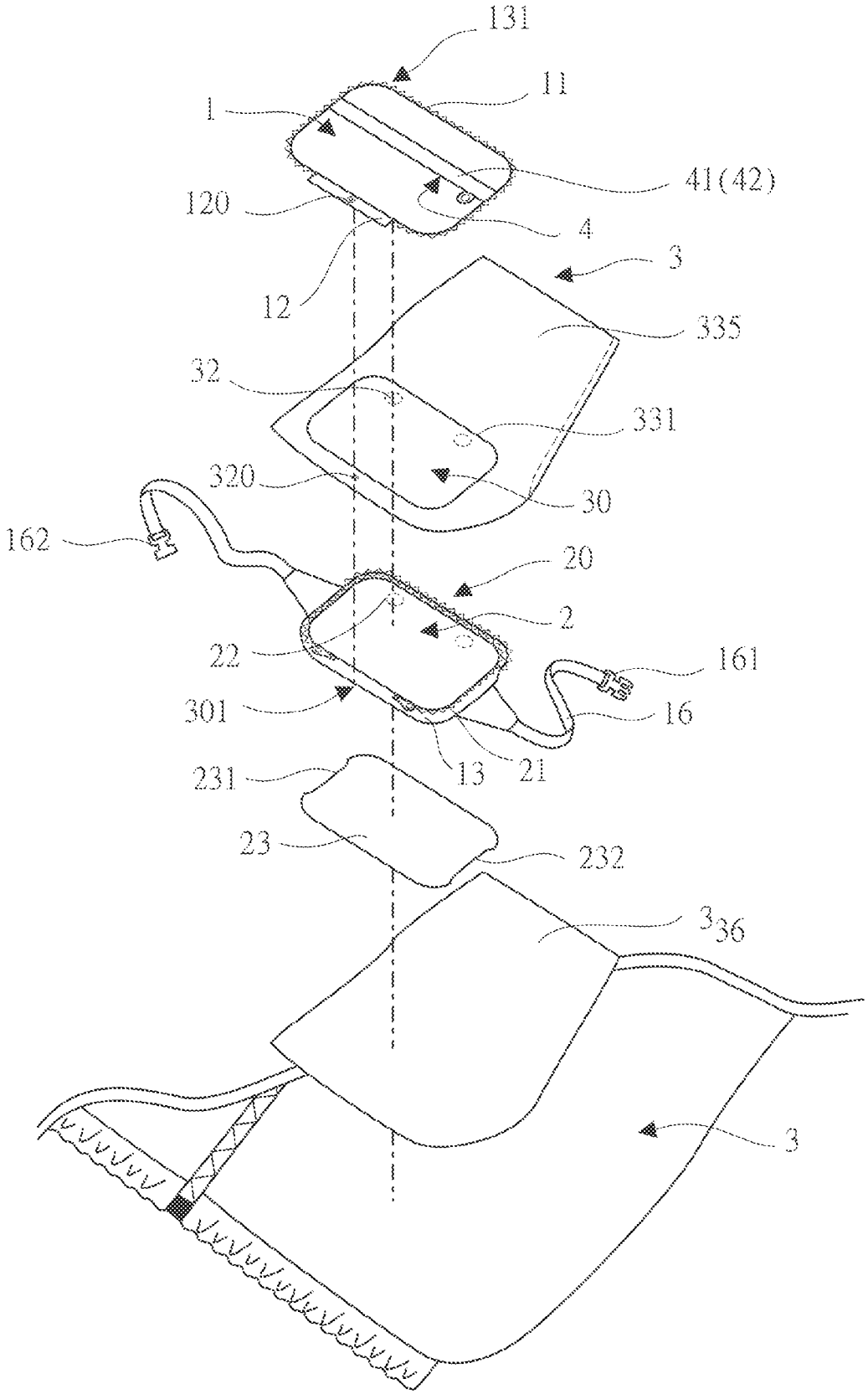
FIG. 40 shows an exploded view of an unfolded state of the third embodiment of the present invention which is used in the clothing.
Figure 41:
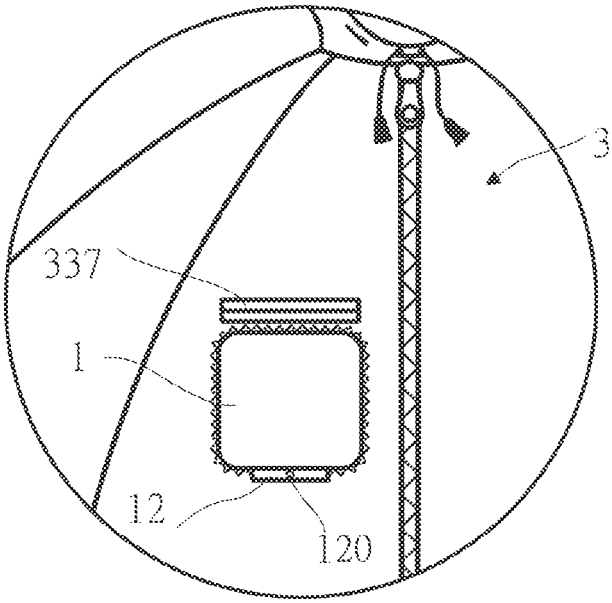
FIGS. 41 to 44 show schematic views of an unfolded state of a fourth embodiment of the present invention which is used in the clothing.
Figure 42:
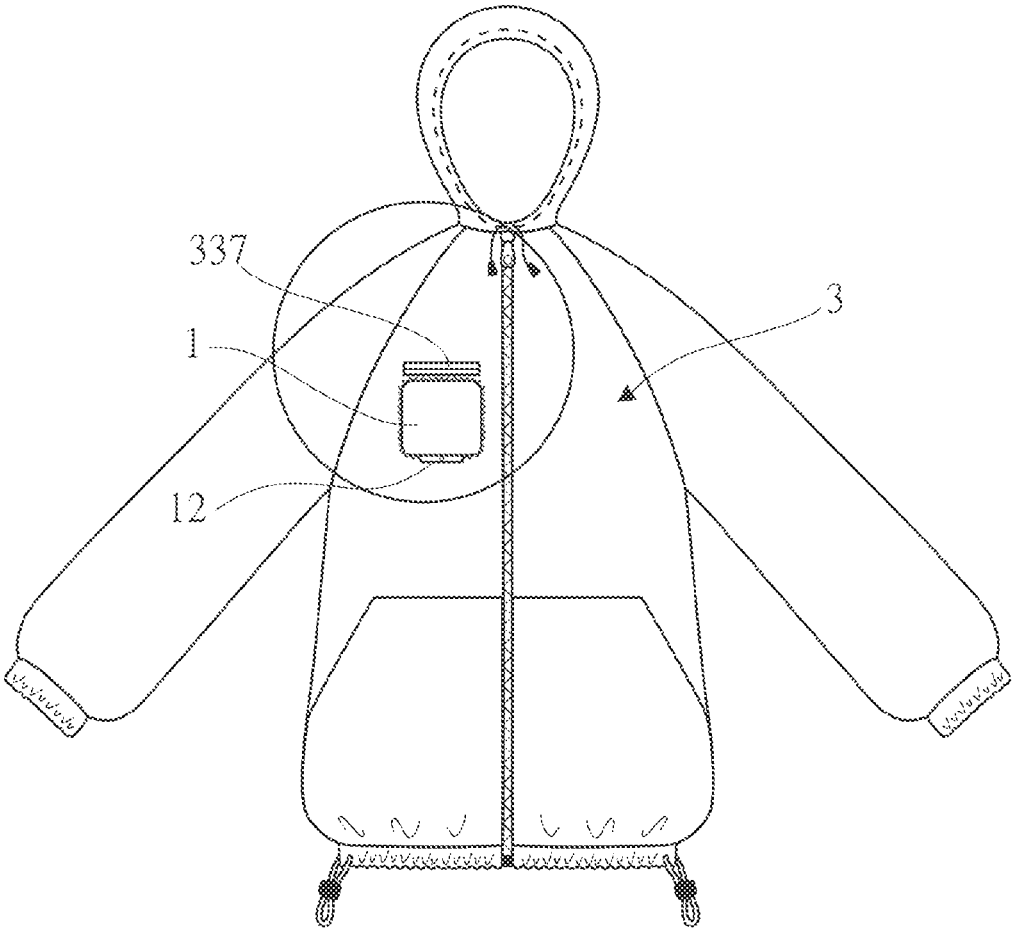
Figure 43:
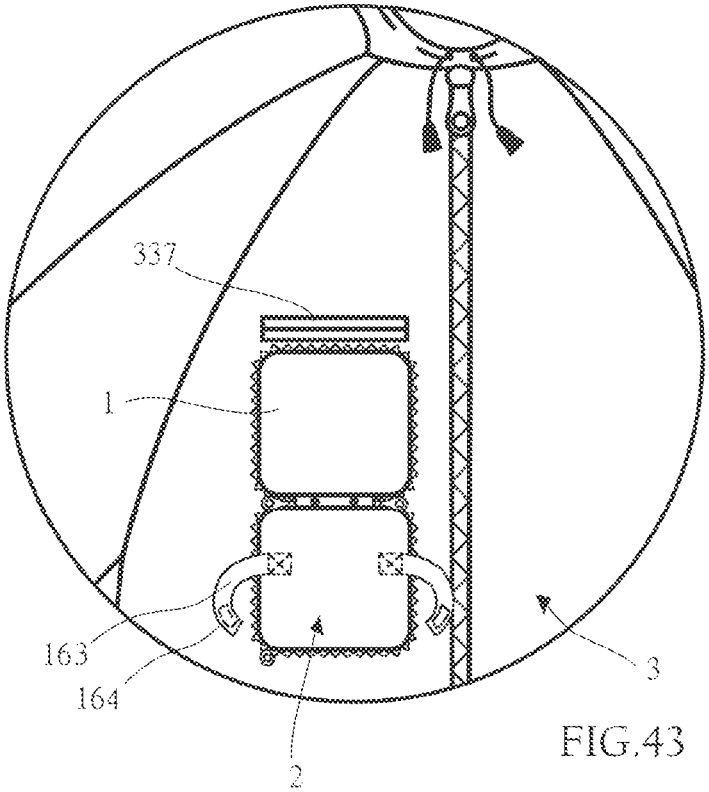
Figure 44:
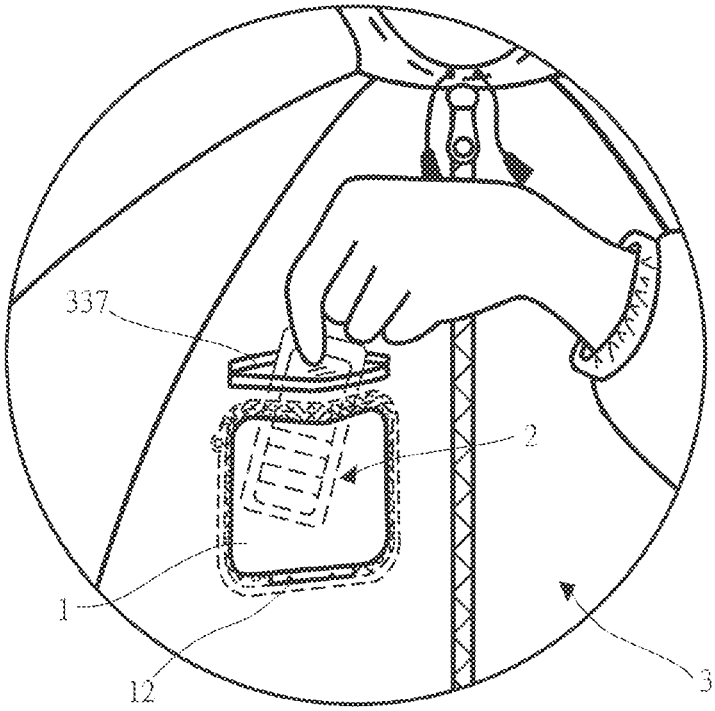

The rear cover sheet 2 of a waist bag of the present embodiment is provided with a second holding portion 20; whereas, the containing mode of the rear cover sheet 2 and the second holding portion 20 is as described in the above-mentioned embodiments. As the second joining edge 331 and the first joining edge 131 are joined locally, and the containing port 301 (as shown in FIGS. 6 to 9) or the containing portion 14 (as shown in FIGS. 15 to 18) is formed at a place where the two edges are not engaged, when accessing the flexible enclosure 3 (clothing), the rear cover sheet 2 can be put into a containing space 30 between the front cover sheet 1 and the flexible enclosure 3 (clothing) from the containing port 301 or the containing portion 14. In addition, after the rear cover sheet 1 has been put in, the second holding portion 20 is located inside the pocket 335 of the flexible enclosure 3 (clothing). The pocket 335 is provided with a pocket layer 336 and the second holding portion 20 is located above the pocket layer 336 (as shown in FIG. 40). As the pocket 335 is connected with the second holding portion 20, the user can easily put his or her hand into a pocket opening 337 of the pocket 335 when wearing the flexible enclosure 3 (clothing), to take an objective, which was previously put in the second holding portion 20, out of the bag unit 10 (waist bag), such as a wallet or a cell phone.

A rim of the cover assembly 21 of the rear cover sheet 2 is further provided with a side wall 13. Two sides of the side wall 13 are connected with an outer belt 16, allowing the user to carry on a shoulder for use (not shown in the drawings). In addition, two ends of the outer belt 16 can be loosely or fixedly connected with the side wall 13. Besides, the outer belt 16 can be connected with a left side and a right side of the rear cover sheet 2 and is transversally fixed at a user's waist by engaging the male and female snaps 161, 162 at the open ends of the outer belt 16. The rear cover sheet 2 is provide with a first interlining 23 which is equipped with a left and right opening 232, 232. When transforming the waist bag into the flexible enclosure 3 (clothing) for use, the user can put two ends of the outer belt 16 into the first interlining 23 from the left and right opening 231, 232 at the first.

To allow the rear cover sheet 2, which has been put into the containing space, not to fall out of the containing port 301, the rear cover sheet 2 is provided at least with a fixing piece 22 and a fixing assembly 32 which is at a side opposite to the flexible enclosure 3 (clothing). The fixing assembly 32 is provided at the surface of the flexible enclosure 3 (clothing) and behind the front cover sheet 1. By the fixing piece 22 and the fixing assembly 32, the rear cover sheet 2 is fixed in the containing space between the front cover sheet 1 and the flexible enclosure 3 (clothing); the fixing piece 22 and the fixing assembly 32 include a zipper, a hook-and-loop fastener, a snap latch or a magnetic button. Moreover, the connection portion 12, which is located between the front cover sheet 1 and the rear cover sheet 2, is provided with a sealing piece 120 which is closed by a sealing assembly 320 opposite to the containing port 301, allowing the rear cover sheet 2 not to fall out of the containing port 301; the sealing piece 120 and the sealing assembly 320 include a zipper, a hook-and-loop fastener, a snap latch or a magnetic button.

Figure 38:
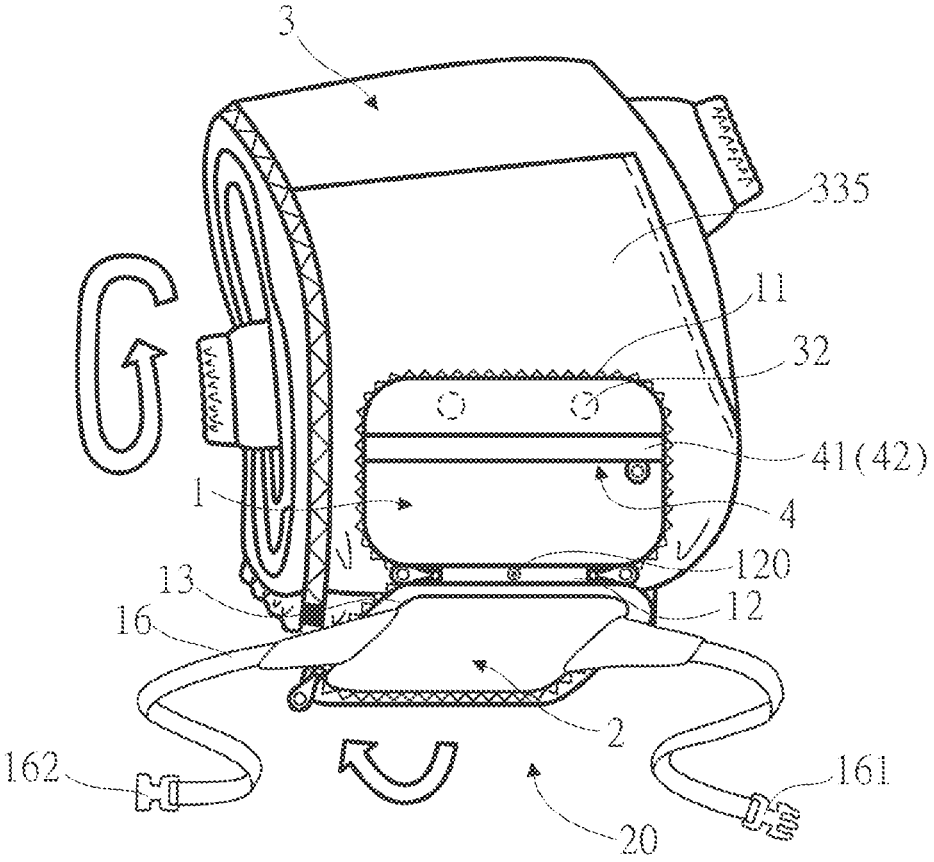
Figure 39:
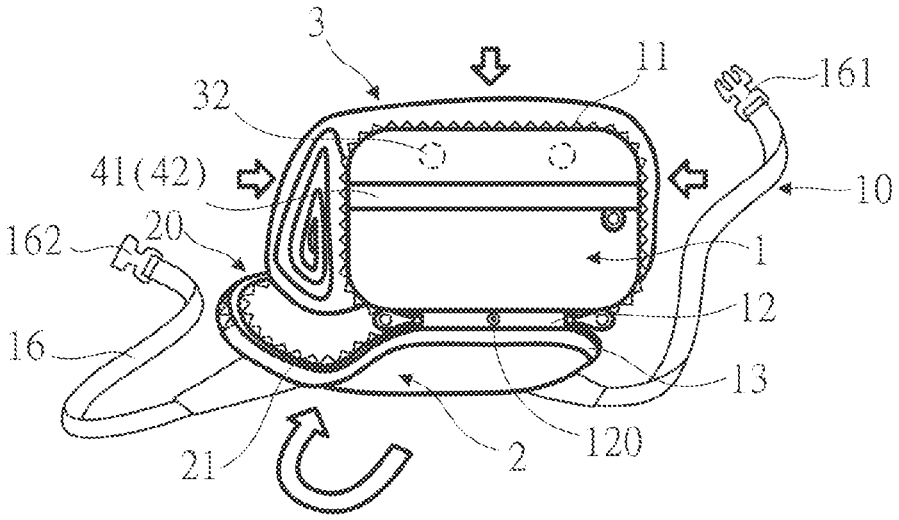

Referring to FIGS. 41 to 44, in addition to being applied to the waist bag, the present invention can be also used in a cell phone pouch or a wallet. The embodiment is about the same structure as the above-mentioned waist bag, wherein the rear cover sheet 2 is provided with a second holding portion 5; whereas, the containing mode of the rear cover sheet 2 and the second holding portion 5 is as described in the above-mentioned embodiments. As the second joining edge 331 and the first joining edge 131 are locally engaged and the containing port 301 (as shown in FIGS. 6 to 9) or the containing portion 14 (as shown in FIGS. 15 to 18) is formed at a place where the two edges are not engaged, the flexible enclosure 3 (clothing) should use an even lighter material and a simpler cutting design to reduce a size after folding, such that the size of the folded flexible enclosure 3 (clothing) can be closer to the size of a cell phone pouch or a wallet. The containing mode is the same as the above-mentioned embodiments, wherein by the containing port 301 or the containing portion 14, the rear cover sheet 2 is put into the containing space 30 between the front cover sheet 1 and the flexible enclosure 3 (clothing); whereas, the second holding portion 20, after the rear cover sheet 2 has been put in, is located inside the chest pocket 335 of the flexible enclosure 3 (clothing). As the pocket 335 is connected with the second holding portion 20, the user can easily put his or her hand into a pocket opening 337 of the pocket 335 when wearing the flexible enclosure 3 (clothing), to take an objective, which was originally put in the second holding portion 20, out of the bag unit 10 (cell phone pouch or wallet), such as a wallet or a cell phone. As shown in FIG. 38, the rear cover sheet 2 of the bag unit 10 (cell phone pouch or wallet) can be further provided with a binding strip 163 and an adjustment piece 164. The adjustment piece 164 can be used to adjust the binding strip 163 to a proper length and to fix the bag unit 10 (cell phone bag or wallet) on an arm of the user or a waist band of the clothes (not shown in the drawing), thereby facilitating carrying.

Figure 45:
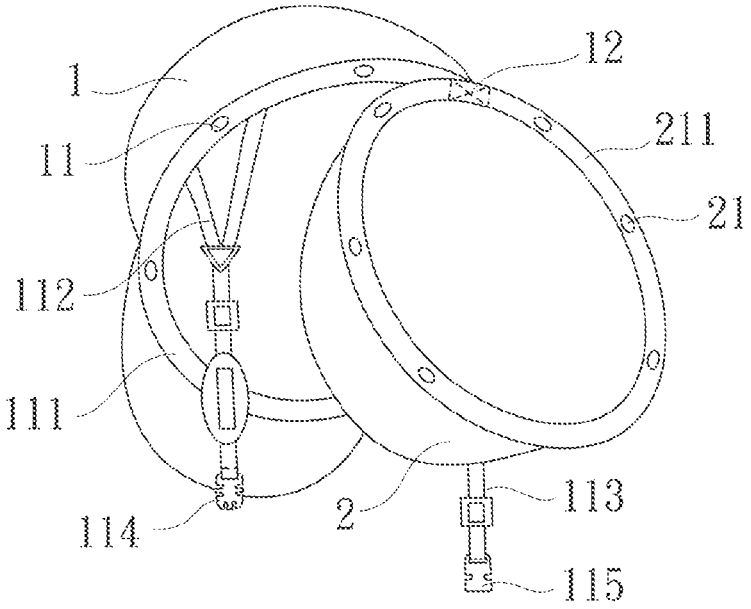
FIG. 45 shows a schematic view of the fourth embodiment of the present invention, in a partially unfolded state.
Figure 46:
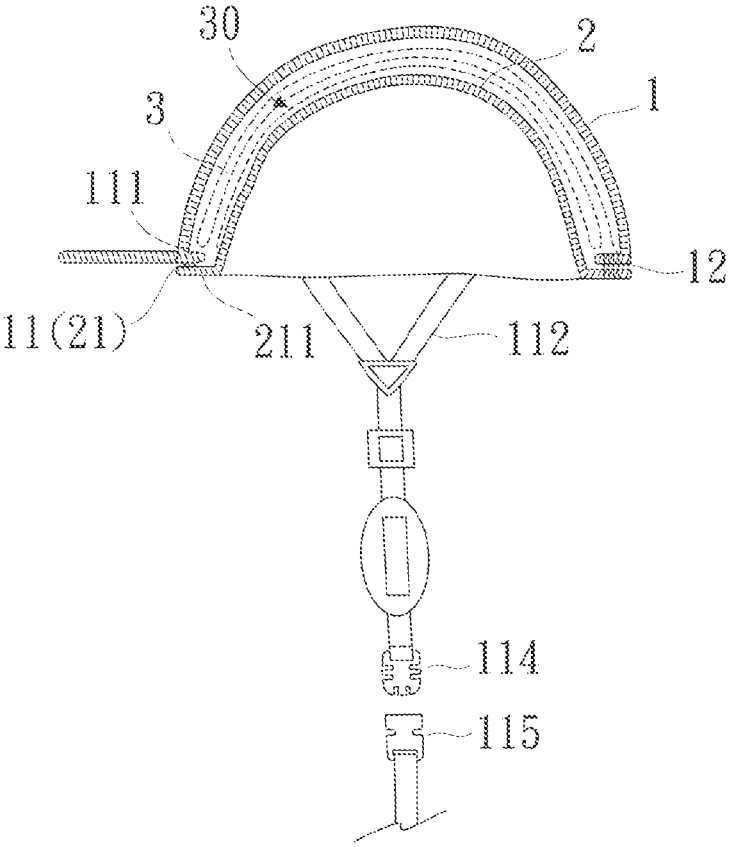
FIG. 46 shows a cross-sectional view of the fourth embodiment of the present invention, in an assembly state.
Figure 47:
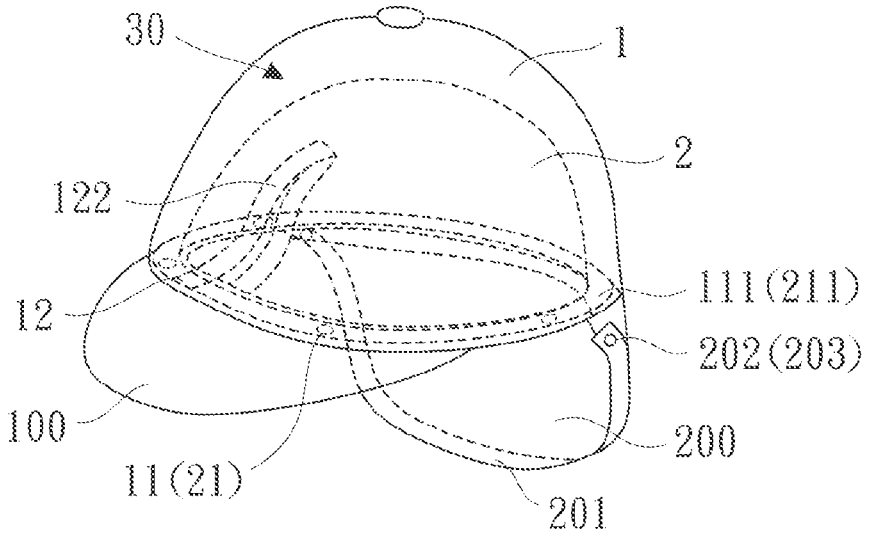
FIGS. 47 to 49 show schematic views of a partial assembly state and an unfolded state of another variation of the fourth embodiment of the present invention.
Figure 48:
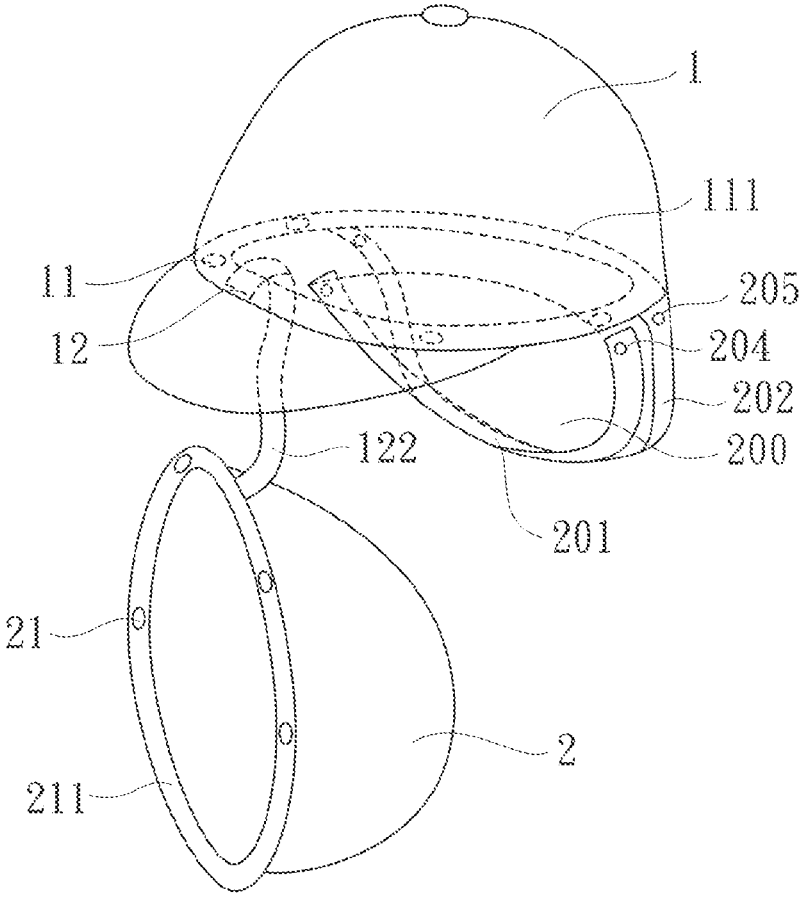

Referring to FIG. 45 and FIG. 46, a fourth embodiment of the present invention applies the flexible enclosure 3 to a hat, comprising primarily the front cover sheet 1, the rear cover sheet 2, the connection portion 12 and the flexible enclosure 3. The front cover sheet 1 is a little larger than the rear cover sheet 2, and both sheets are indented cover units, opposite to each other and in a semicircular shape. The sheets are connected with each other by the connection portion 12, allowing the front cover sheet 1 to be entirely sheathed on the exterior side of the rear cover sheet 2, thereby forming the containing space 30 between the front cover sheet 1 and the rear cover sheet 2. Therefore, when the flexible enclosure 3 (rain coat) is not in use, it can be put into the containing space 30. Besides, an edge of the front cover sheet 1 is provided with a first annular edge 111 which is equipped with a cover piece 11. An edge of the rear cover sheet 2 is provided with a second annular edge 211 which is opposite to the first annular edge 111 of the front cover sheet 1, and the second annular edge 211 is equipped with the cover assembly 21 which is opposite to the cover piece 11 of the first annular edge 111. The connection portion 12 is located at the front cover sheet 1, at a position opposite to a lower rear side of the rear cover sheet 2, with the connection method of sewing or other means, so that by fixing the cover assembly 21 with the cover piece 11, the rear cover sheet 2 can be sheathed and sealed in the front cover sheet 1. On the other hand, a left side and a right side of the front cover sheet 1 can be provided with a pair of male gripe 112 and female gripe 113, at a location opposite to the user's ears. In addition, open ends of the male and female gripes 112, 113 are provided respectively with a male snap 114 and a female snap 115. By engaging the male snap 114 with the female snap 115, the above-mentioned hat can be fixed at the user's neck to prevent from sliding off.

Figure 49:
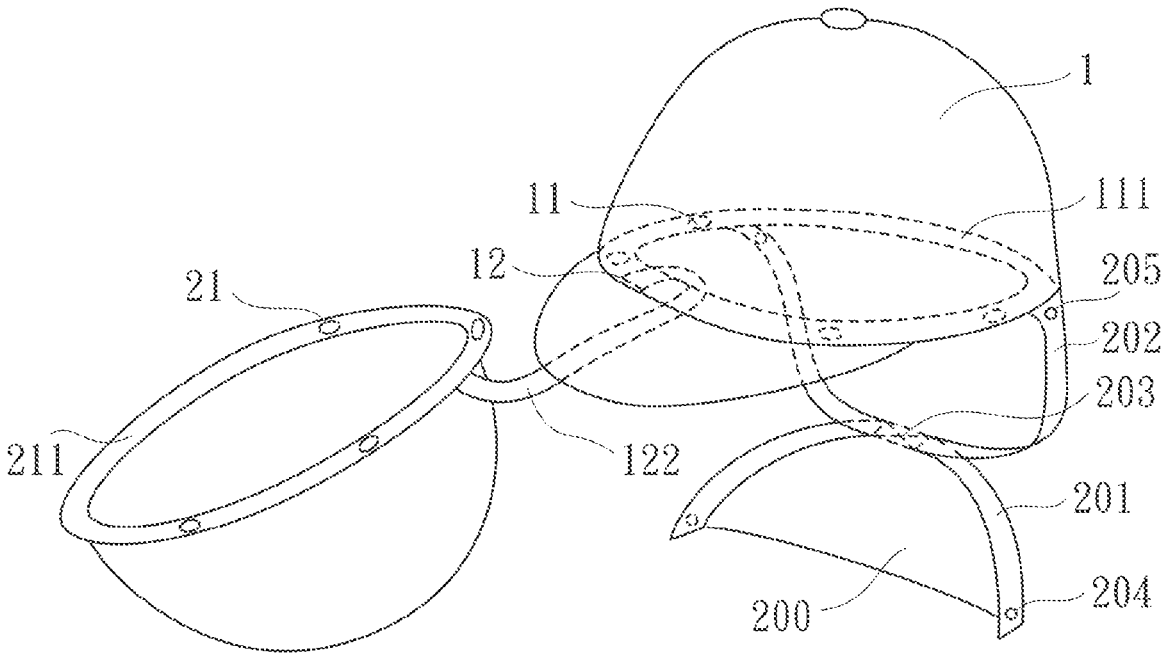
Figure 50:
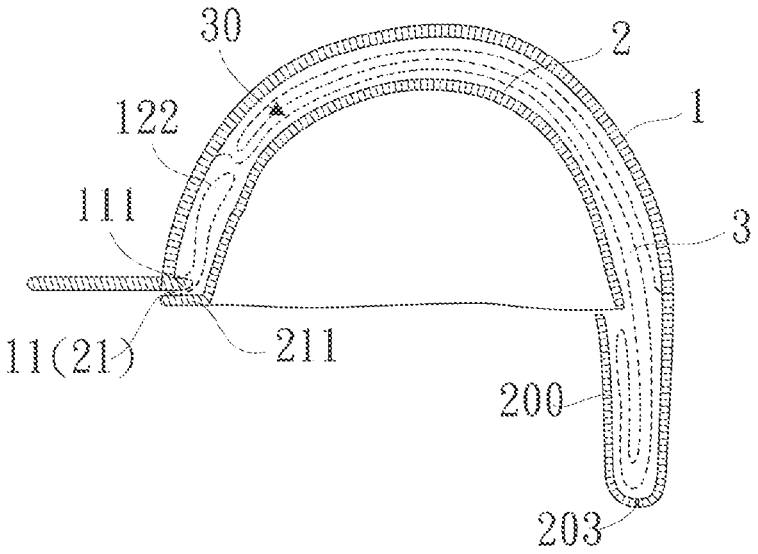
FIG. 50 shows a cross-sectional view of another variation of the fourth embodiment of the present invention, in an assembly state.
Figure 51:
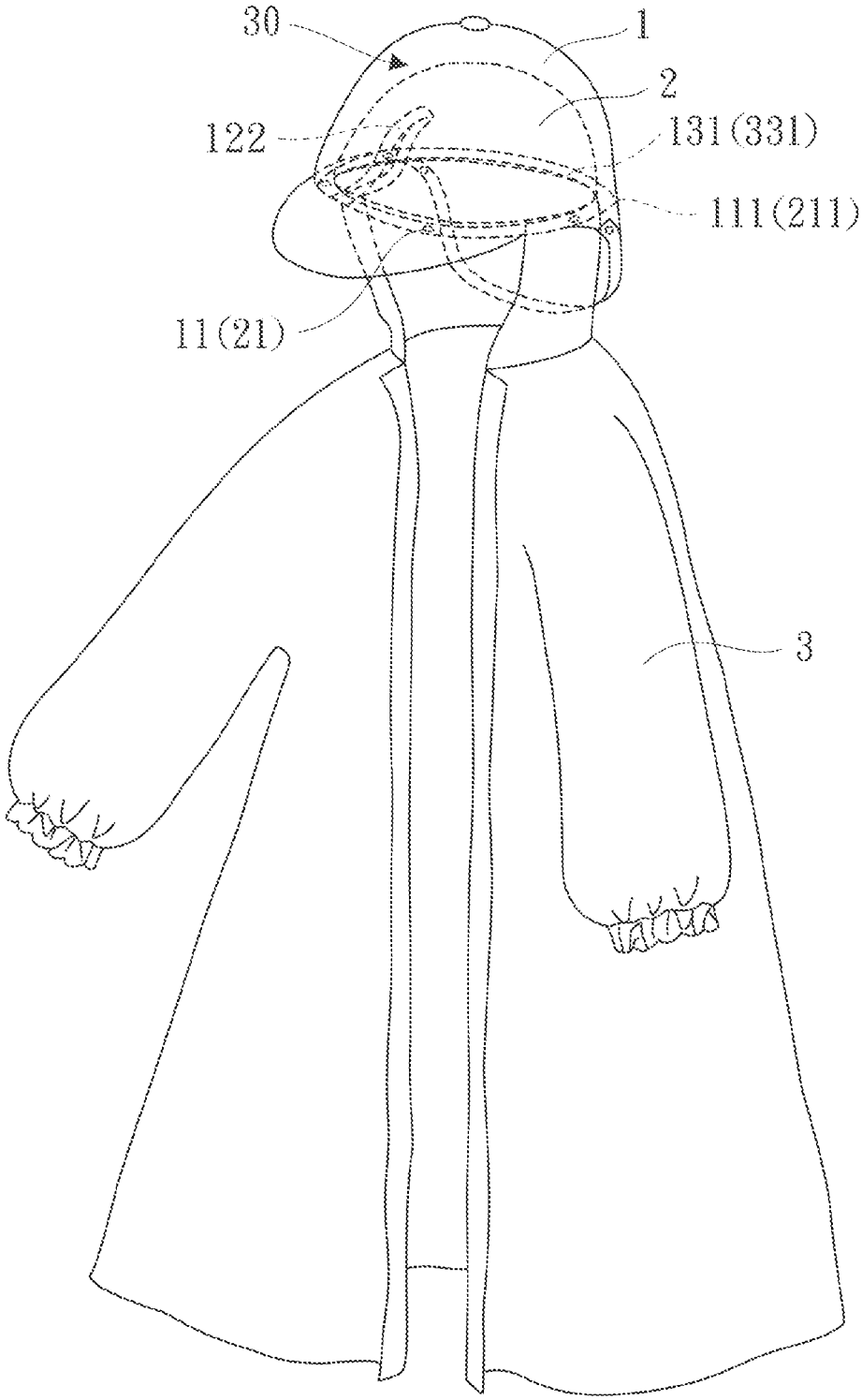
FIGS. 51 and 52 show a schematic view of an unfolded state and an exploded view, according to another variation of the fourth embodiment of the present invention.
Figure 52:
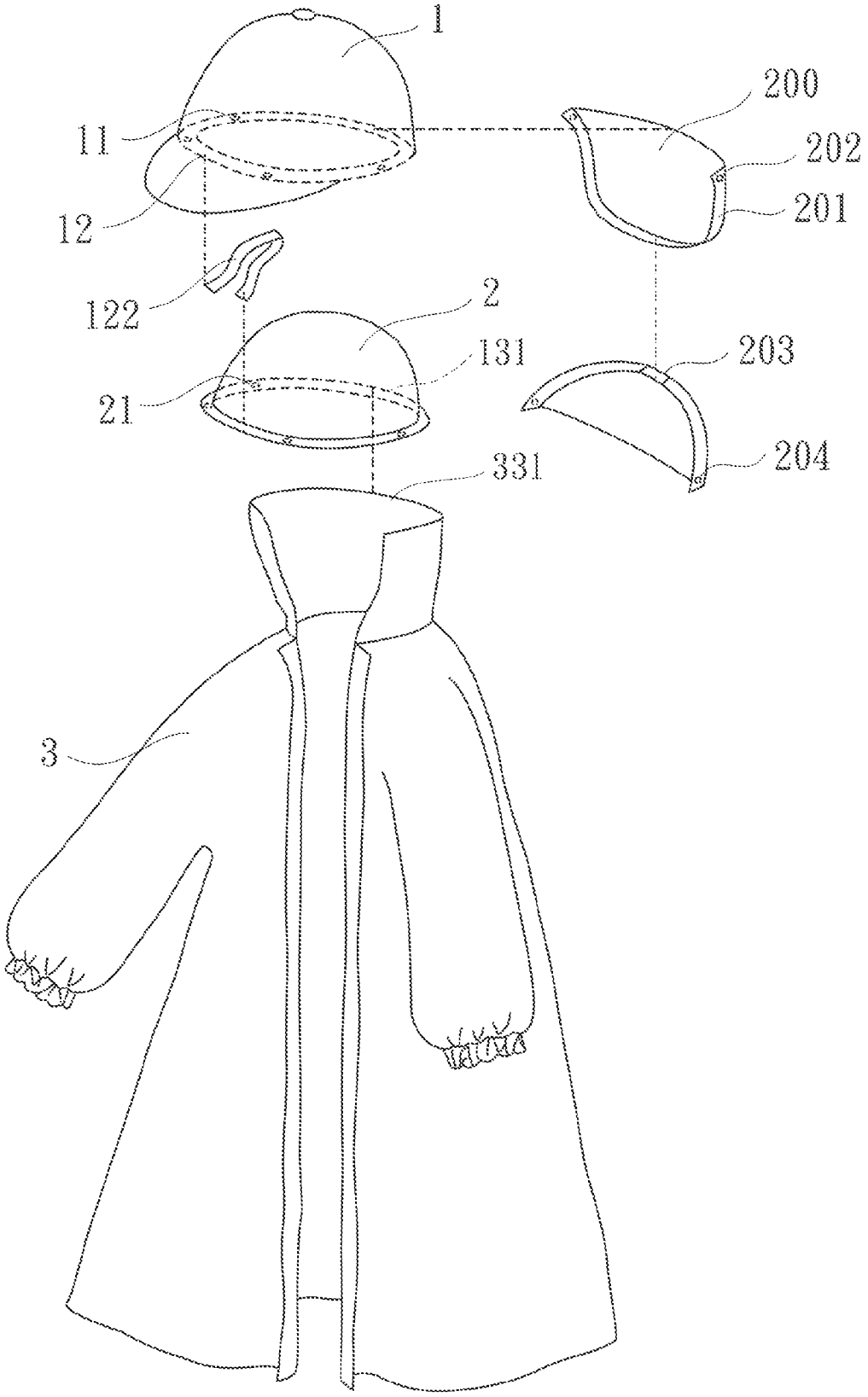

Referring to FIGS. 46 to 52, it shows a second embodiment applied to the hat. The primary variation lies in that a rear side of the front cover sheet 1 is elongated and extended to a place close to the user's neck and a bottom of the elongated part of the front cover sheet 1 is provided with a lower connection portion 203 and a lower cover sheet 200 (as shown in FIG. 49). By connecting the lower connection portion 203 with the lower cover sheet 200, the lower cover sheet 200 can be turned open from top to bottom, allowing the flexible enclosure (rain coat) to be easily put into or taken out of the containing space 30.

In addition, the connection portion 12, which is located underneath the front cover sheet 1 and between the rear cover sheet 2, can be also added with an extension portion or an extension strip 122, such that the rear cover sheet 2 can be turned downward and the flexible enclosure 3 (rain coat) can be more easily put into or taken out of the containing space 30. An edge of the lower cover sheet 200 of the present embodiment is provided with a lower annular edge 201 which is equipped with a lower cover piece 204. A rear edge of the front cover sheet 1 is provided with a third annular edge 202 which is opposite to the lower annular edge 201 of the lower cover sheet 200, and the third annular edge 202 is equipped with a lower cover assembly 205 which is opposite to the lower cover piece 204 of the lower annular edge 201, such that the lower cover piece 200 can be positioned and closed in an inner rear side of the front cover sheet 1 by the lower cover piece 204 and the lower cover assembly 205. As shown in FIG. 45 and FIG. 46, a left side and a right side of the front cover sheet 1, opposite to the user's ears, can also be provided with a pair of male and female gripe 112 (113) and male and female snap 114 (115), such that the above-mentioned hat structure can be fixed at the user's head to prevent from sliding off.

Figure 53:
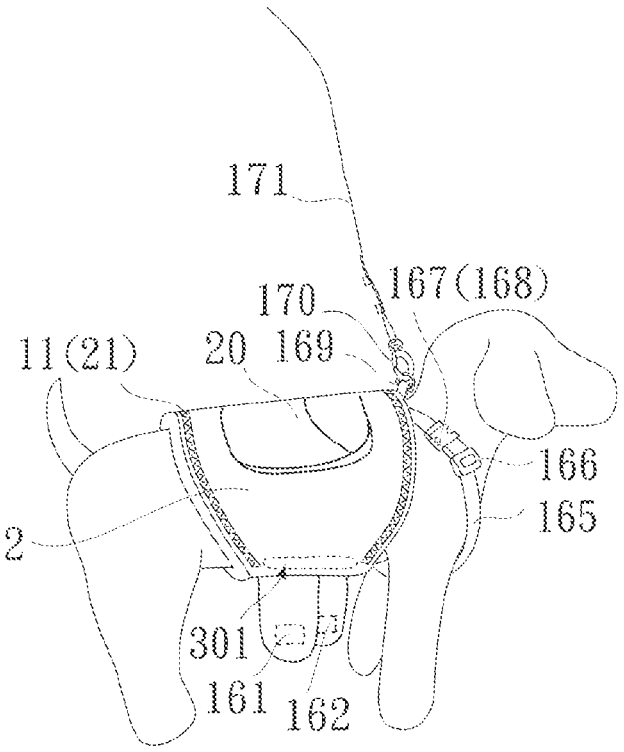
FIGS. 53 to 55 show schematic views of an unfolding process of a fifth embodiment of the present invention.
Figure 54:
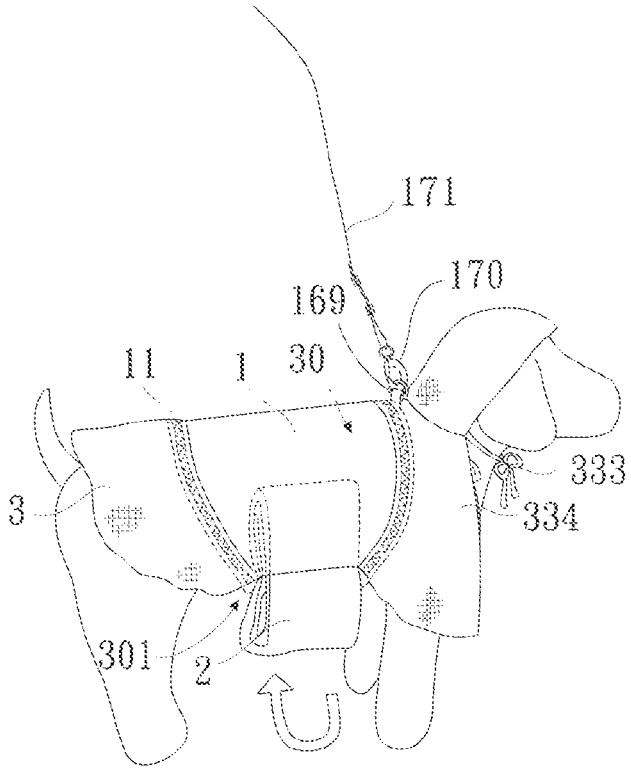
Figure 55:
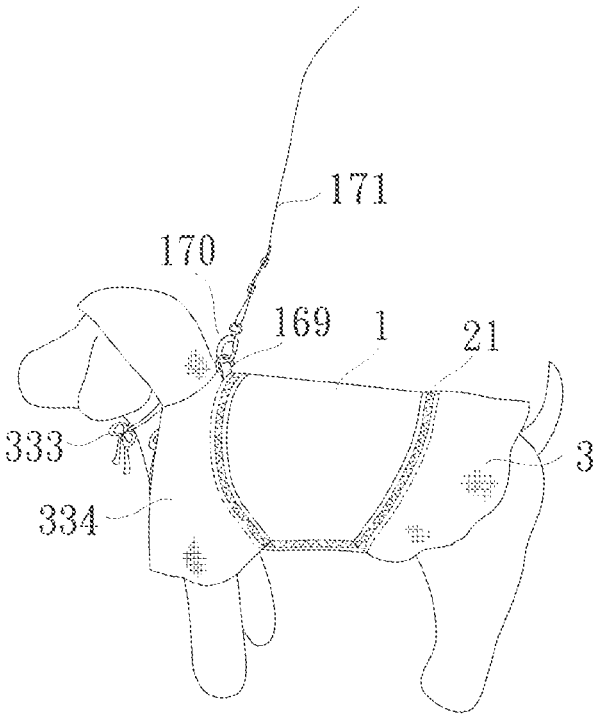

Referring to FIGS. 53 to 55, a fifth embodiment of the present invention is roughly the same as the above-mentioned flexible enclosure 3 (clothing) combined with the bag unit 10, according to the third embodiment. The difference lies in that the present embodiment applies the flexible enclosure 3 (clothing) to the clothing to be worn on a objective (including a pet), such as a rain coat or a windbreaker used for a dog. However, in addition to a pet, the present embodiment can also be used in any objective, including all kinds of bags, articles for daily use, people (infants) or animals (not shown in the drawings). A left side and a right side of the front cover sheet 1 are connected respectively with a male snap 161 and a female snap 162 and when wearing, the front cover sheet 1 is aligned underneath and the rear cover sheet 2 is aligned above the body of an objective (pet), followed by fixing the male snap 161 with the female snap 162 to wear and fix the front and rear cover sheet 1 (2) on the body of the objective (pet). Furthermore, a second holding portion 20 can be provided above the rear cover sheet 2 to facilitate the user to put in a personal objective needed by the objective (pet) from the second holding portion 20, such as a tool to clean droppings of the pet. In addition, the flexible enclosure 3 (clothing) is connected between the front cover sheet 1 and the rear cover sheet 2 and the user can cover the flexible enclosure 3 (clothing) on the body of the objective (pet) (as shown in FIG. 54). Besides, the front sides of the front cover sheet 1 and the rear cover sheet 2 are provided with an annular belt 165, an adjustment piece 166 and a pair of male and female buckle 167 (168). By the adjustment piece 166, the size of the annular belt 165 can be adjusted to facilitate wearing the annular belt 165 on the objective (pet), such as a neck, a foreleg or a limb. In addition, the annular belt 165 is fixed by the male and female buckle 167 (168). A fixing ring 169 is located above the annular belt 165, at a place connecting to the edge of the front and rear cover sheet 1 (2), thereby providing for the user to hook a pull rope 171, which is provided with a hook ring 170, at the fixing ring 169, to pull the objective (pet) to walk on a ground by the pull rope 171.

When the flexible enclosure 3 (clothing) is in a contained state, the containing port is hidden between the front cover sheet 1 and the flexible enclosure 3 (clothing) as well as hidden at a side of the objective (pet) (as shown in FIG. 53). When the flexible enclosure 3 (clothing) is to be used, the rear cover sheet 2 is opened by the cover piece 11 and the cover assembly 21; whereas, the flexible enclosure 3 (clothing), which is contained between the front cover sheet 1 and the rear cover sheet 2, is unfolded and covered on the body of the objective (pet). In the mean time, the rear cover sheet 2 is put in from the containing port 301, allowing the rear cover sheet 2 to be contained in the containing space 30 between the front cover sheet 1 and the flexible enclosure 3 (clothing) (as shown in FIG. 54). Moreover, the foreparts 334 of the flexible enclosure 3 (clothing) can be closed by a closing piece 333, allowing the flexible enclosure 3 (clothing) to be covered on the body and the head of the object (pet), achieving an effect of preventing from wind and rain (as shown in FIG. 55).

Figure 56:
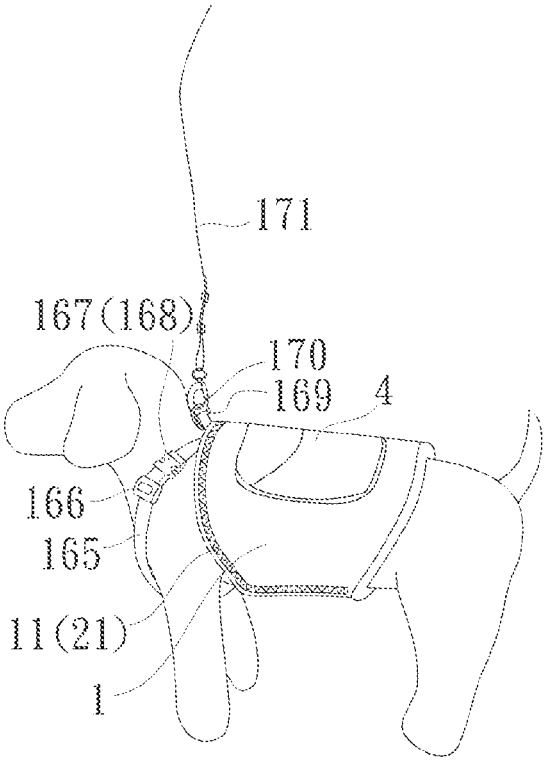
FIGS. 56 to 58 show a schematic view of an unfolding process and exploded views, according to a sixth embodiment of the present invention.
Figure 57:
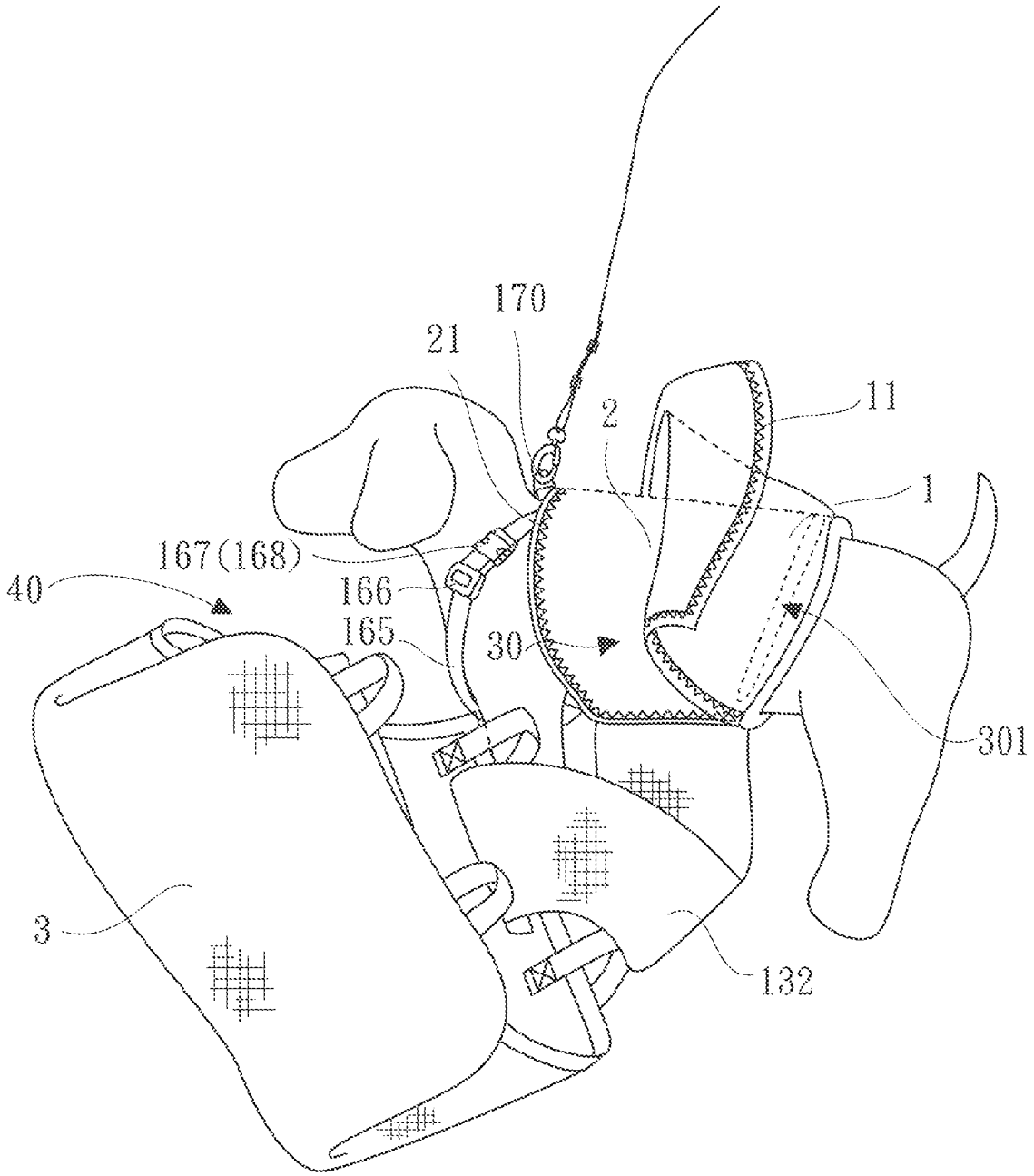
Figure 58:
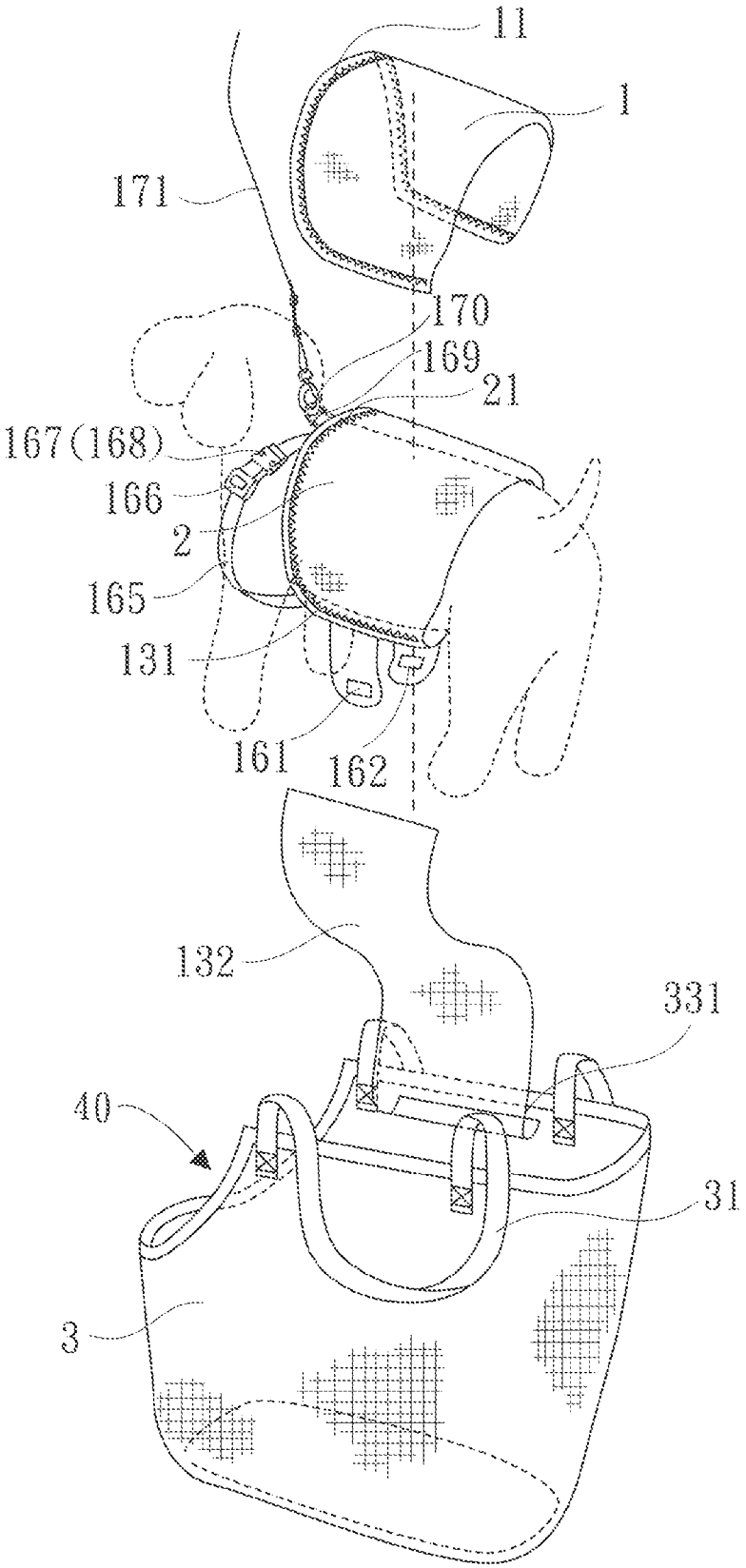
Figure 59:
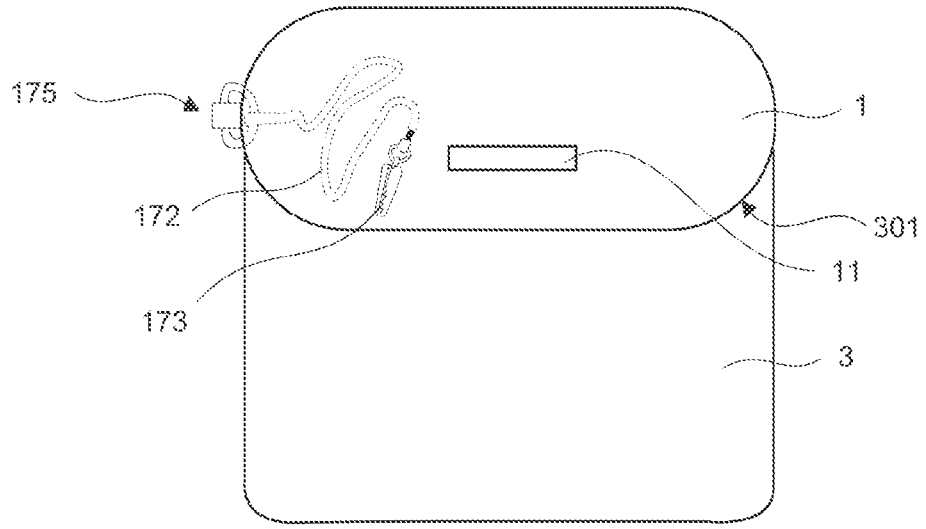
FIGS. 59 to 63 show a schematic view of an unfolding process and exploded views, according to a seventh embodiment of the present invention.

Referring to FIGS. 56 to 58, a sixth embodiment of the present invention applies the flexible enclosure 3 (bag) to the containing structure of an objective to be carried (including a pet), comprising primarily the front cover sheet 1, the rear cover sheet 2, the cover piece 11 at the rim of the front cover sheet 1, the cover assembly 21 at the rim of the rear cover sheet 2 and the flexible enclosure 3 (bag). In addition, an open and closing direction of the cover piece 11 and the cover assembly 21 is aligned with the head of a objective (pet), and the flexible enclosure 3 (bag) is folded by the extension portion 132, followed by being contained between the front cover sheet 1 and the rear cover sheet 2; wherein, a left side and a right side of the front cover sheet 1 are connected respectively with a male snap 161 and a female snap 162. The present embodiment can also be used for any objective, including all kinds of bags, articles for daily use, people (infants) or animals.

When wearing, the rear cover sheet 2 is aligned underneath and the front cover sheet 1 is aligned above the body of the objective (pet), and by fixing the male snap 161 with the female snap 162, the front and rear cover sheet 1 (2) can be worn and fixed on the body of the objective (pet). Furthermore, a first holding portion 4 can be provided above the front cover sheet 1 to facilitate the user to put in personal items of the objective (pet) from the first holding portion 4. When using the present invention, the front cover sheet 1 is opened by the cover piece 11 and the cover assembly 21; whereas, after the front cover sheet 1 has been opened and the flexible enclosure 3 (bag) has been unfolded, the front cover sheet 1 can be closed locally and directly by the cover piece 11 and the cover assembly 21 (the present embodiment can also be added with the containing port 301 and the interlining within the rear cover sheet 2, so as to put the opened front cover sheet 1 into the interlining from the containing port 301, as shown in FIG. 57). After the flexible enclosure 3 (bag) has been unfolded, its opening 40 should be aligned underneath the pet and the objective (pet) is loaded from bottom to top into the flexible enclosure 3 (bag) from the opening 40, followed by carrying the flexible enclosure 3 (bag), which is loaded with the objective (pet), by a hand or on a shoulder, with a handle 31. A front side of the opening 40 of the flexible enclosure 3 (bag) can be configured as a truncated notch, allowing the head of the objective (pet) to be exposed out of the flexible enclosure 3 (bag) from the notch-shaped opening 40.

Same as the abovementioned embodiments, a front side of the containing structure, according to the present embodiment, is provided with an annular belt 165 above which is a fixing ring 169, at a place connecting to a front side of the front and rear cover sheet 1 (2), thereby allowing the user to hook a pull rope 171, which is provided with a hook ring 170, at the fixing ring 169. The user can selectively contain the flexible enclosure 3 (bag) between the front cover sheet 1 and the rear cover sheet 2 and use the pull rope 171 to pull the objective (pet) to walk on a ground. Or, the front cover sheet 1 can be opened and the objective (pet) can be loaded into the unfolded flexible enclosure 3 (bag), followed by carrying the flexible enclosure 3 (bag), which is loaded with the objective (pet), by a hand or on a shoulder, with the handle 30.

For each abovementioned embodiment, the exterior side of the front cover sheet 1 and the exterior side of the flexible enclosure 3 (bag) can be further provided with mutually corresponding textures and patterns to improve a sense of aesthetics and contrast to a different visual effect. When the holding portion 4 is used alone, the front cover sheet 1 and the holding portion 4 can manifest the partial textures or patterns. When the flexible enclosure 3 (bag) is unfolded, the front cover sheet 1 and the holding portion 4 can manifest the textures or patterns contrasting with the flexible enclosure 3 (bag) to improve a sense of aesthetics or exhibit a different visual effect (not shown in the drawings).

Figure 62:
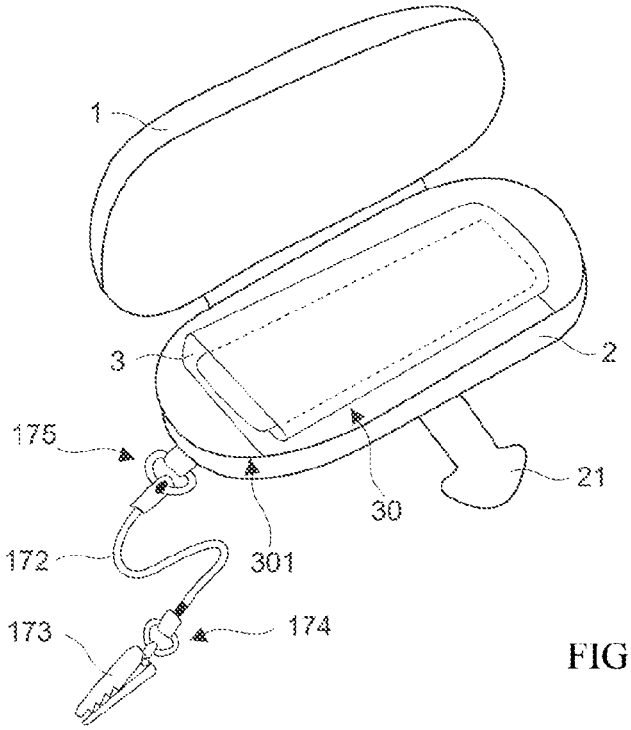
Figure 63:
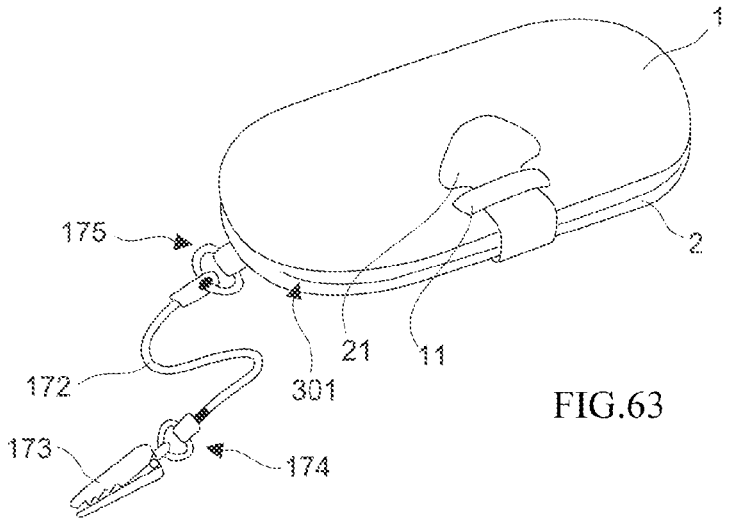
Figure 64:
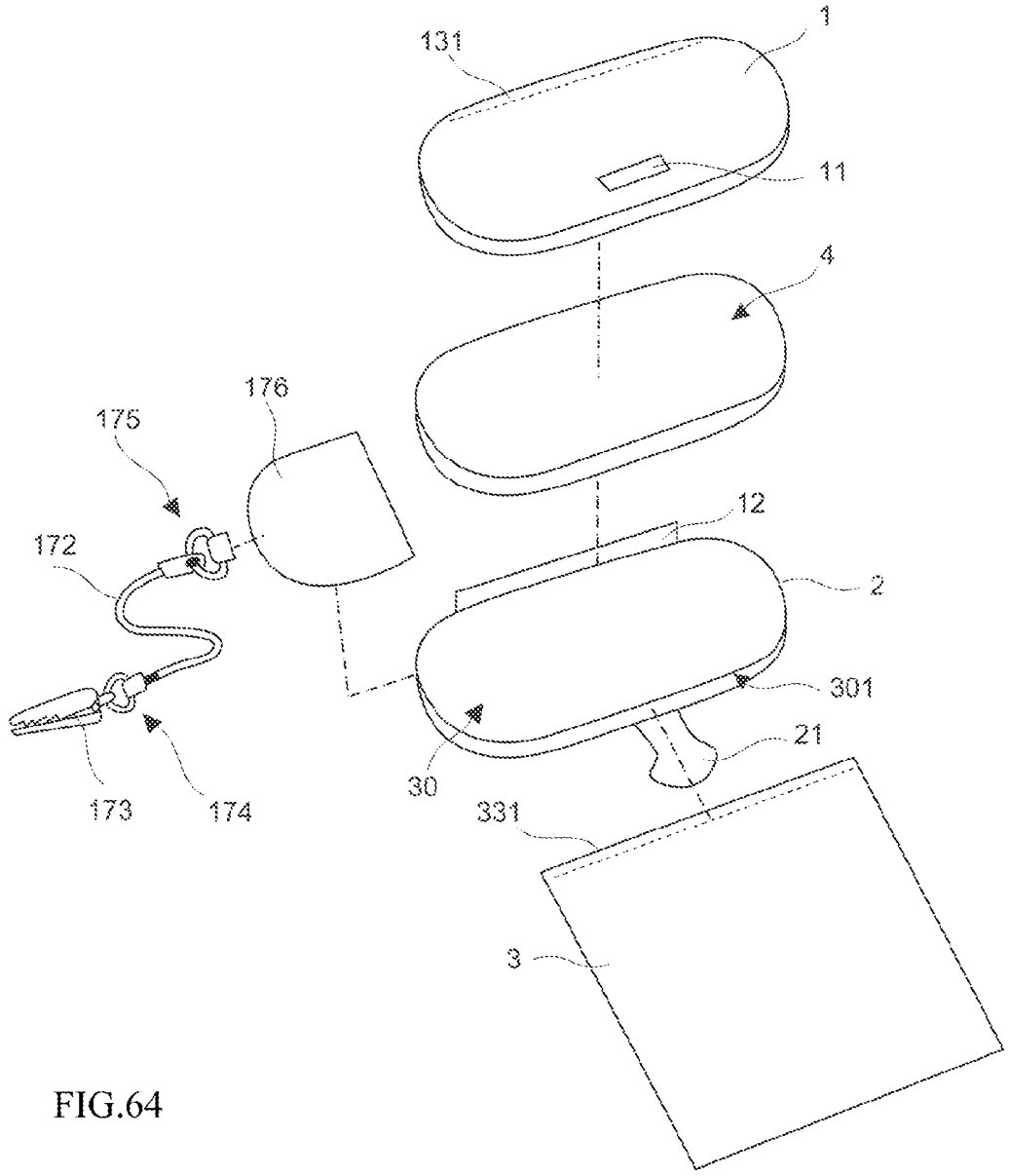
FIGS. 64 to 66 show a schematic view of an unfolding process and exploded views, according to further variation of the seventh embodiment of the present invention.
Figure 65:
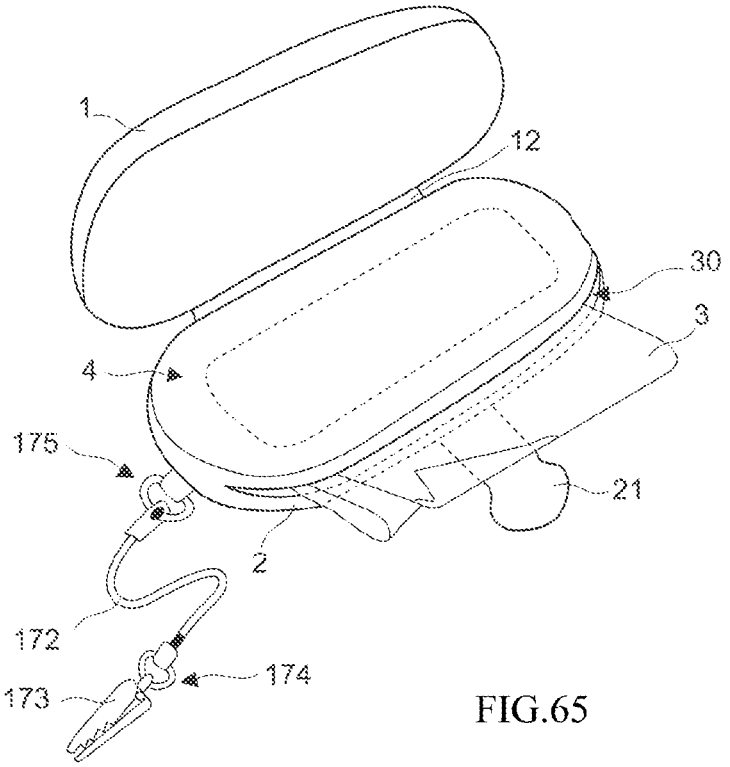
Figure 66:
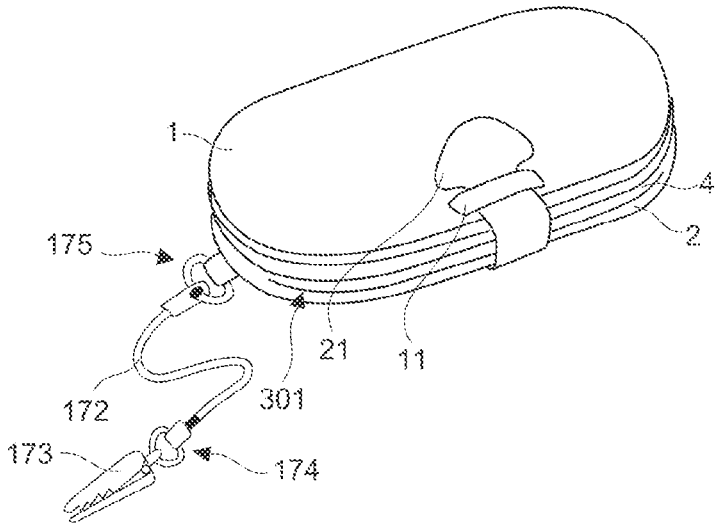

Referring to FIGS. 59 to 63, a seventh embodiment of the present invention is applied the flexible enclosure 3 to a wiping cloth for cleaning purposes, for examples, devices with display screens, touch screens or optical elements such as smart phone, hand-held computer, camera, spectacles or eyeglasses, to which requires maintaining the screens and optical elements clean and neat (devices are illustrated in doted lines in FIG. 62).

The embodiment of the invention primarily consists of a front cover sheet 1, a rear cover sheet 2, a connection portion 12 and a flexible enclosure 3, wherein, a side of the front cover sheet 1 is provided with a first joining edge 131 and a cover piece 11, a side of the rear cover sheet 2 is provided with a cover piece assembly 21 corresponding to the cover piece 11, and the connection portion 12 is disposed at an upper side corresponding between the cover piece 11 and the cover piece assembly 21. The cover piece 11 and the cover piece assembly 21 can made as a pair of buckling elements (as shown in the drawings) or can be made as a binding element (not showing in the drawings). The distinguishing feature of this embodiment is to configure the flexible enclosure 3 at the lower location approaching the containing port 301 between the front cover sheet 1 and the rear cover sheet 2, and further connect the rear cover sheet 2 with the second joining edge 331 thereby fixing the flexible enclosure 3 onto the rear cover sheet 2. When the items such as cellphone or eyeglasses are not in use, they can be rolled along with the flexible enclosure 3 and placed into the containing port 301 storing in the containing space 30 between the front cover sheet 1 and the rear cover sheet 2 and then closed by the corresponding cover piece 11 and cover piece assembly 21.

Figure 60:
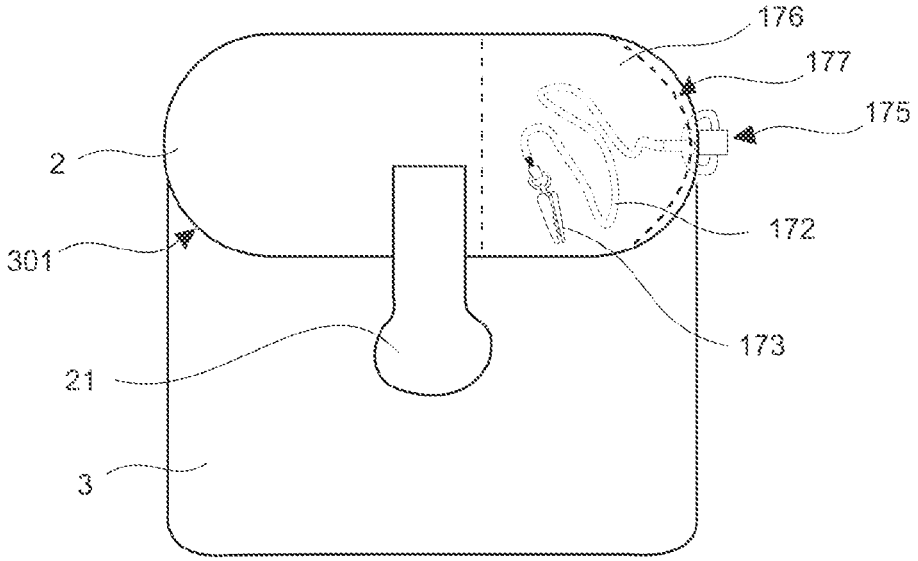
Figure 61:
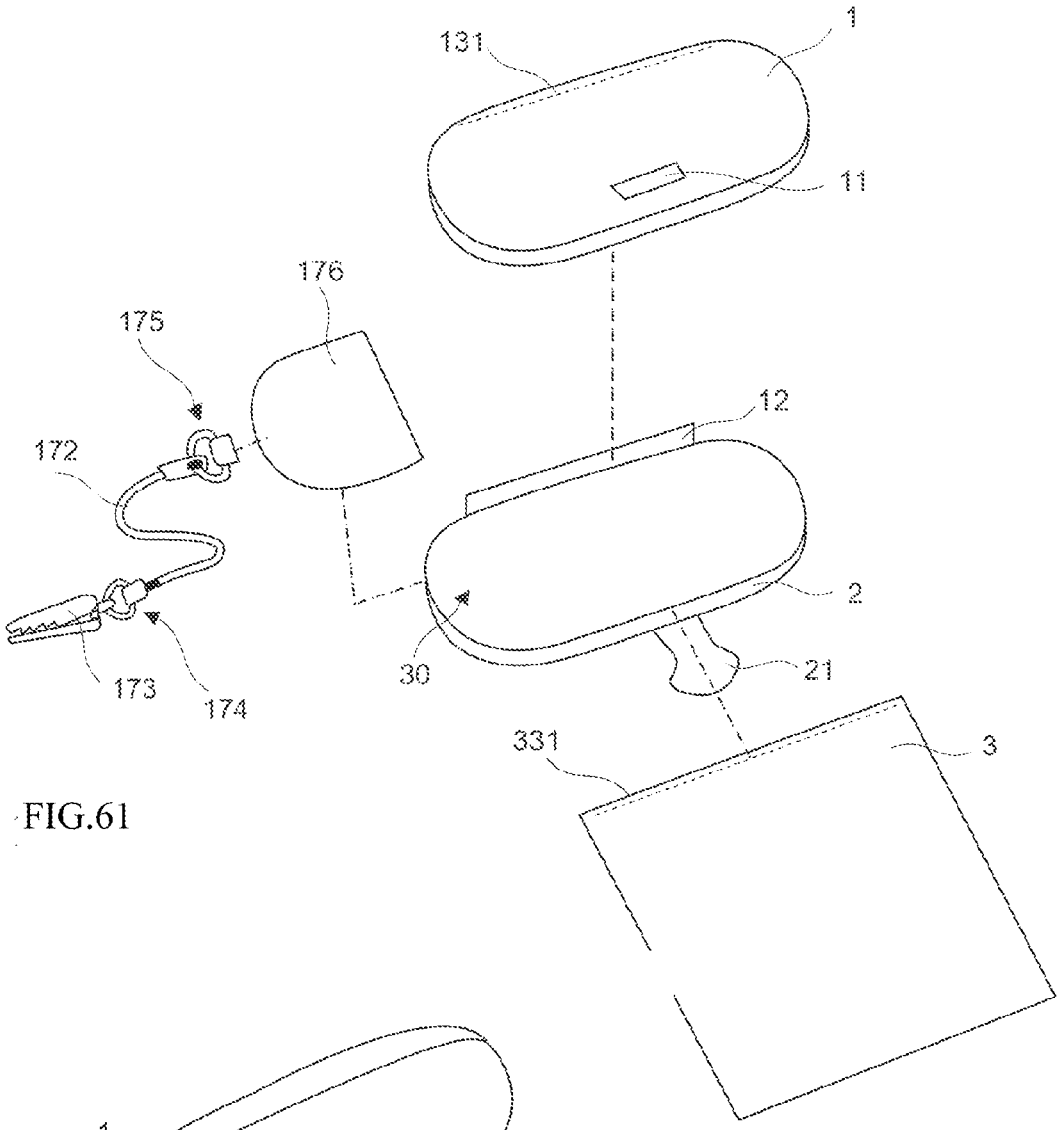

In addition, the containing structure is provided with a clipping piece 173 at an appropriate location of the front cover sheet 1, the rear cover sheet 2, the connection portion 12 or holding portion 4 thereby clamping and fixing the containing structure to the preferable objective (e.g. the user's shirt or pant pocket) such that it can prevent the personal items placed inside the containing structure from inadvertently losing. Moreover, the containing structure is provided with a partition layer 176 and a layer port 177. Also, the clipping piece 173 can be put into practice with a string piece 172 along with a first linking member 174 and a second linking member 175. When the clipping piece 173 is not in use, the string piece 172, the first linking member 174 and a second linking member 175 can be placed from the layer port 177 and stored into the partition layer 176 (as illustrated in FIG. 60).

The embodiment in applying the flexible enclosure to a wiping cloth can also be referred to the first embodiment (FIG. 3 to FIG. 9) to attach the front cover sheet 1 onto the flexible enclosure 3 by connecting the first joining edge 131 corresponding to the second joining edge 331, or to make the second joining edge 331 partially engaged with the first joining edge 131. such that a containing port 301 is formed at a place where the first joining edge 131 is not engaged with the second joining edge 331, thereby enabling the rear cover sheet 2 being put in the containing space 30 between the front cover sheet 1 and the flexible enclosure 3 from the containing port 301. The embodiment can also be applied by the structure as illustrated by second embodiment (FIG. 10 to FIG. 18) of the invention, such that the rear cover sheet 2 and the flexible enclosure 3 can be folded and put into the first containing portion 14 and the second containing portion 35 through the port 34 respectively.

Referring to FIGS. 67 to 71, a eighth embodiment of the present invention is applied the flexible enclosure 3 to an outer belt 16 of a bag unit, so that the outer belt 16 can be concealed in the containing structure when not in use. For examples, in case the user simply wants to carry a backpack by using a handle 31, or using an additional shoulder strap (not shown in the drawings) to carry the bag and do not wish being affected by the dual shoulder straps swinging away, the containing structure of the embodiment can be applied to have the straps concealed completely. Moreover, when user want to conceal the outer belt 16 inside the first interlining 23 as illustrated in the third embodiment of the invention (FIG. 34 to FIG. 40), the containing structure of the embodiment can be applied as well.

Figure 71:
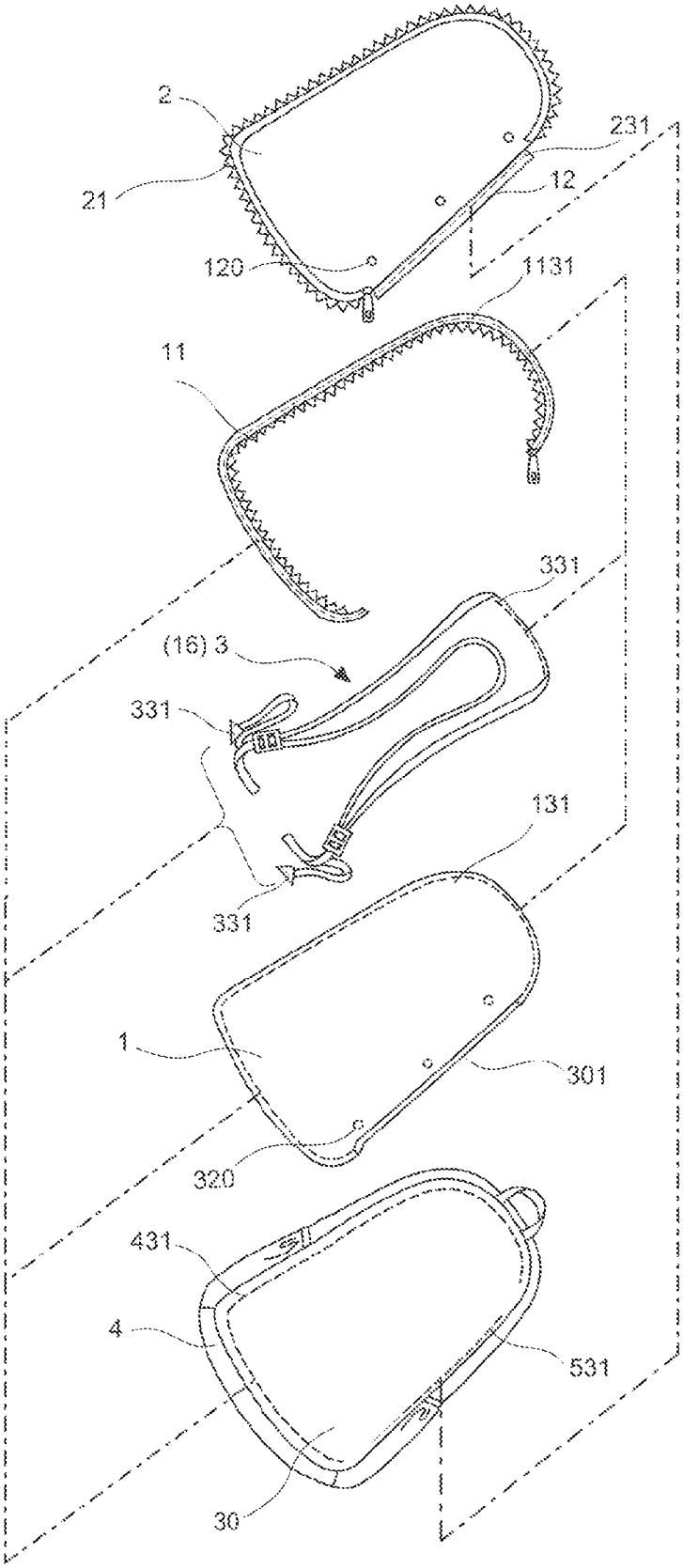
FIG. 71 shows an exploded schematic view of the eighth embodiment of the present invention.

Referring to the exploded view as shown in FIG. 71, the embodiment of the invention primarily consists of a front cover sheet 1, a rear cover sheet 2, a cover piece 11 disposed on a circular rim of the front cover sheet 1, a holding portion 4 disposed on the front cover sheet 1, a connection portion 12 disposed on a side of the rear cover sheet 2 and the flexible enclosure 3 (the outer belt 16) configured between the front cover sheet 1 and rear cover sheet 2 (with the cover piece 11), wherein, a first joining edge 131 is provided on a circular rim of the front cover sheet 1; a second joining edge 331 is provided on an upper side of the flexible enclosure 3 (the outer belt 16), a third joining edge 1131 is provide on a circular rim of the cover piece 11, a fourth joining edge 431 and a fifth joining edge 531 are provided on the holding portion 4 respectively.

Moreover, a containing port 301 is formed at a place of the front cover sheet 1 where the first joining edge 131 is not engaged with the fourth joining edge 431. The connection portion 12 is provided with a six joining portion 231 disposed on a side of the rear cover sheet 2, by which the rear cover sheet 2 is connected with the fifth joining portion 531 at the place of front cover sheet 1 where approaching the containing port 301, thereby enabling the rear cover 2 sheet being opened and then put in a containing space 30 between the front cover sheet 1 and the flexible enclosure 3 from the containing port 301 when the flexible enclosure 3 (the outer belt 16) is in use, More specifically, the third joining edge 1131, the first joining edge 131, the fourth joining edge 431 are in corresponding U-shape and are connected from up to down in sequence. A plurality of second joining edge 331 consists of the second joining edge 331 on upper side and the lower side of the flexible enclosure 3 (the outer belt 16) in I-shape, which are connected respectively between the first joining edge and the third joining edge at the upper side and lower side thereof.

Figure 67:
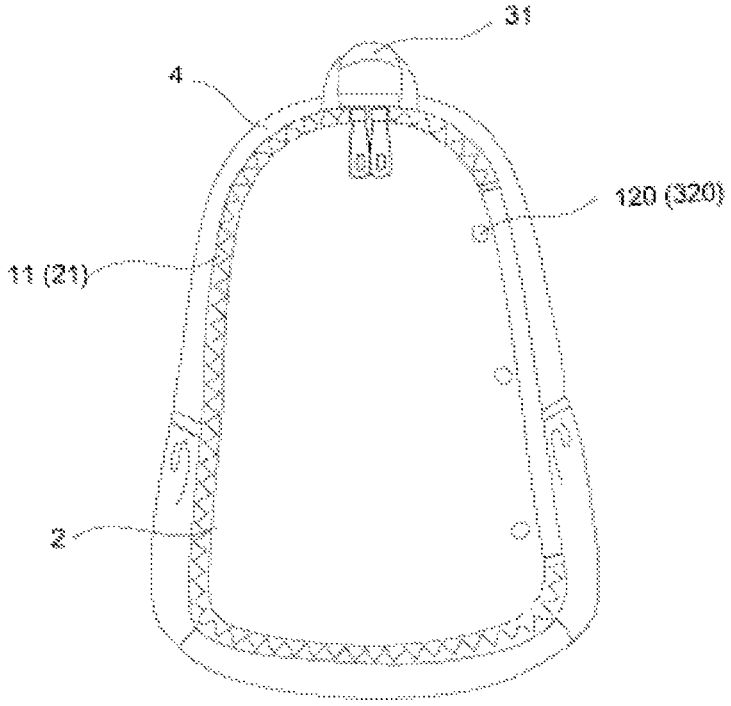
FIGS. 67 to 70 show a schematic view of an unfolding process of the eighth embodiment of the present invention.
Figure 68:
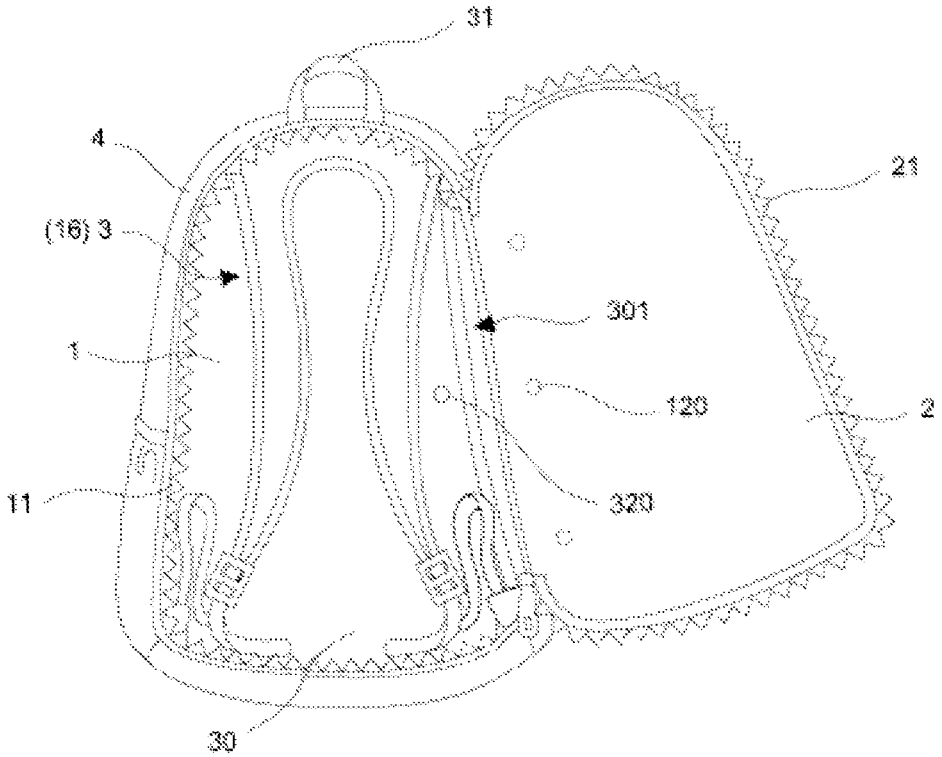
Figure 69:
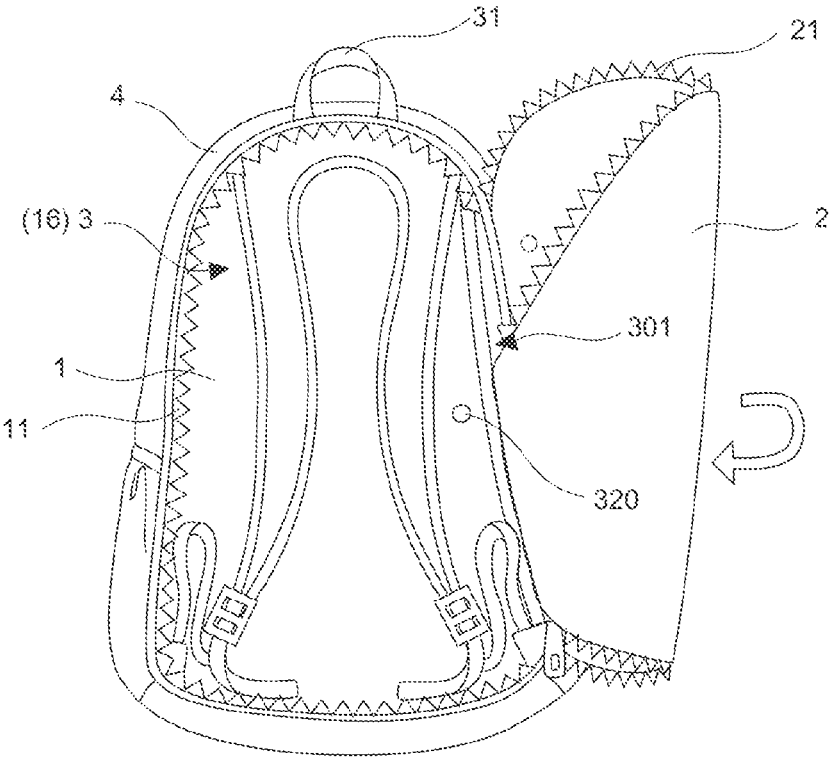
Figure 70:
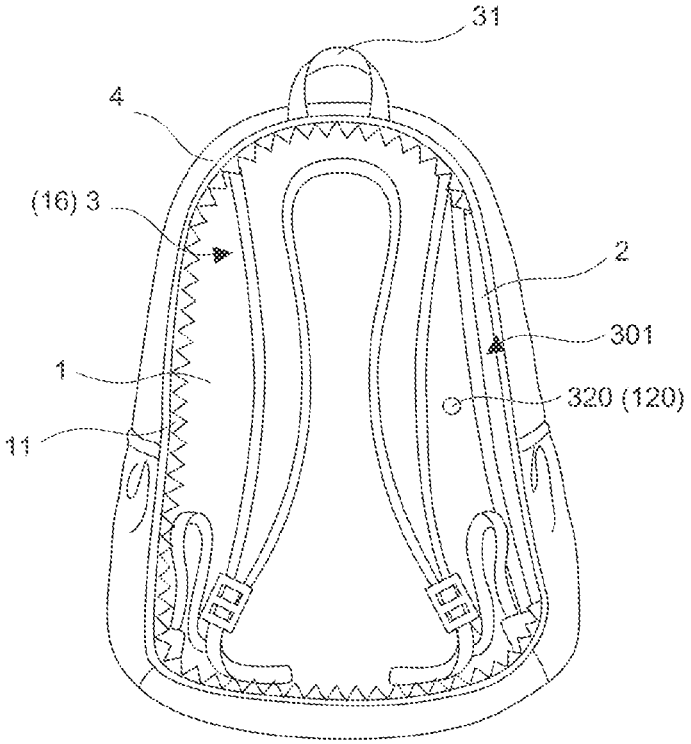

As shown in FIG. 68, the flexible enclosure 3 (the outer belt 16) is in curve shape, so the overall length the flexible enclosure 3 (the outer belt 16) and also its covering scale should a bit longer than the containing space 30 from by front cover sheet 1 and the rear cover sheet 2. When not in use, the lower ends of flexible enclosure 3 (the outer belt 16) can be folded in curve shape within the containing space 30 (FIG. 68).and to be concealed by the cover piece 11 and the cover piece assembly 21 (FIG. 67). Referring to FIG. 67 to FIG. 70, when using flexible enclosure 3 (the outer belt 16), the rear cover sheet 2 can be opened and inserted from the containing port 301, such that the rear cover sheet 2 can be placed inside the containing space 30 between the front cover sheet 1 and the holding portion 4 and further fixing the rear cover sheet 2 onto the containing port 301 by a sealing piece 120 with a corresponding sealing assembly 320.

The embodiment in applying the flexible enclosure 3 to the outer belt 16 is basically referred to the structure of the first embodiment (FIG. 3 to FIG. 9) However, the embodiment can also be applied by the structure as illustrated by second embodiment (FIG. 10 to FIG. 18) of the present invention. On the other hand, the structure as further defined in the embodiment can also be referred to relative structures as illustrated in all the other embodiments as mentioned above.

Accordingly, in addition to the abovementioned embodiments, the present invention can be further applied to other bag units of various functions.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A cover-type containing structure for flexible enclosures, comprising:

a front cover sheet, an edge of which is provided with a cover piece; a rear cover sheet, an edge of which is provided with a cover assembly corresponding to the cover piece;

a connection portion which is provided between the front cover sheet and the rear cover sheet to connect the two sheets;

a first joining edge which is provided at the front cover sheet, the rear cover sheet, between the front cover sheet and the rear cover sheet, or at the connection portion; and a flexible enclosure which includes a second joining edge, the front cover sheet and the flexible enclosure being fixed by engaging the first joining edge with the corresponding second joining edge;

a containing space being formed between the front cover sheet and the rear cover sheet to contain the folded flexible enclosure, the front cover sheet and the rear cover sheet being closed by the cover piece and the cover assembly;

a containing port is formed at a place of the front cover sheet where the first joining edge is not engaged with; thereby enabling the rear cover sheet being opened and then put in a containing space between the front cover sheet and the flexible enclosure from the containing port when the flexible enclosure is in use.

2. The cover-type containing structure for flexible enclosures, according to claim 1, wherein the flexible enclosure is an outer belt, the first joining edge is provided at the front cover sheet, and a plurality of second joining edges are provided at the outer belt.

3. The cover-type containing structure for flexible enclosures, according to claim 2, wherein the cover piece is provided with a third joining edge; the outer belt is a shoulder strap; the shoulder strap is included with the second joining edges on an upper end as well as a lower end of the outer belt, the upper end and the lower end being connected between the first joining edge and the third joining edge, respectively;

wherein the front cover sheet is connected with a holding portion fanning a bag unit and the holding portion including a fourth joining edge and a fifth joining edge, the containing port is formed at a place of the front cover sheet where the first joining edge is not engaged with the fourth joining edge; a connection portion having a six joining portion is provided on a side of the rear cover sheet, by which the rear cover sheet is connected with the fifth joining portion at the place of front cover sheet where approaching the containing port.

* * * * *